US012553325B2

(12) United States Patent
Chambers, Sr. et al.

(10) Patent No.: US 12,553,325 B2
(45) Date of Patent: Feb. 17, 2026

(54) METHOD OF CONTROLLING TENSILE-SPLITTING AND HYDRO-SHEARING PARAMETERS DURING COMPLETION OF ENHANCED GEOTHERMAL SYSTEM WELLS

(71) Applicants: Michael Roy Chambers, Sr., Lindale, TX (US); Timothy David Gray Hillesden Lines, Hayling Island (GB); Carl Bradley Pate, Fort Smith, AR (US); Robert Mansell Pearson, Calgary (CA); Abdell Wadood M El-Rabaa, Plano, TX (US); David Lynn Copeland, Carrollton, TX (US)

(72) Inventors: Michael Roy Chambers, Sr., Lindale, TX (US); Timothy David Gray Hillesden Lines, Hayling Island (GB); Carl Bradley Pate, Fort Smith, AR (US); Robert Mansell Pearson, Calgary (CA); Abdell Wadood M El-Rabaa, Plano, TX (US); David Lynn Copeland, Carrollton, TX (US)

( * ) Notice: Subject to any disclaimer, the term of this patent is extended or adjusted under 35 U.S.C. 154(b) by 0 days.

(21) Appl. No.: 19/226,414

(22) Filed: Jun. 3, 2025

(65) Prior Publication Data

US 2025/0290396 A1 Sep. 18, 2025

Related U.S. Application Data

(63) Continuation-in-part of application No. 18/818,873, filed on Aug. 29, 2024, now Pat. No. 12,352,133,
(Continued)

(51) Int. Cl.
*E21B 43/26* (2006.01)
*F24T 10/20* (2018.01)
*F24T 10/00* (2018.01)

(52) U.S. Cl.
CPC ..... *E21B 43/26* (2013.01); *F24T 10/20* (2018.05); *F24T 2010/53* (2018.05)

(58) Field of Classification Search
CPC ..... E21B 43/112; E21B 43/26
See application file for complete search history.

(56) References Cited

U.S. PATENT DOCUMENTS 724,904 A * 4/1903 Mack ..... E21B 43/112 166/55.3
973,994 A * 10/1910 Swan ..... E21B 43/112 294/102.1

(Continued)

*Primary Examiner* — David Carroll
(74) *Attorney, Agent, or Firm* — Eric M. Adams

(57) ABSTRACT

Methods and systems for geothermal energy production wherein multiple horizontal or vertical wells may be used to pass fluids through the Earth from an injector well to a producer well through induced cracks, splits, fractures, conduits, or channels in the rock. Such methods and systems may include controlling tensile-split conduits in a subterranean geothermal formation by providing an injection well, providing a production well, configuring the injection well for injection of a tensile-splitting fluid into a production zone, configuring the production well to produce a heated fluid from the production zone, applying pressure to the production well, creating a plurality of tensile-split conduits, raising or lowering the pressure in the production well, establishing fluid communication between the injection well and the production well, and producing the heated fluid to the surface.

15 Claims, 55 Drawing Sheets

Related U.S. Application Data which is a continuation-in-part of application No. 18/644,250, filed on Apr. 24, 2024, now Pat. No. 12,140,344.

(60) Provisional application No. 63/540,435, filed on Sep. 26, 2023, provisional application No. 63/535,469, filed on Aug. 30, 2023.

(56) References Cited

U.S. PATENT DOCUMENTS

| | | | | |
|---|---|---|---|---|
| 9,394,768 | B2 * | 7/2016 | Pasvandi | E21B 43/112 |
| 2003/0136562 | A1 * | 7/2003 | Robison | E21B 43/108 166/55.7 |
| 2015/0226032 | A1 * | 8/2015 | Kratochvil | E21B 34/103 166/55.1 |
| 2016/0230526 | A1 * | 8/2016 | Crews | E21B 43/26 |
| 2017/0248014 | A1 * | 8/2017 | Chanpura | E21B 47/00 |
| 2018/0080309 | A1 * | 3/2018 | Althoff | E21B 43/17 |
| 2019/0128068 | A1 * | 5/2019 | Danko | E21B 47/022 |

* cited by examiner

| 570 Injector | 575 Producer |
|---|---|
| **1. Have Pumped design volume and not intersected Producer**<br>• Pump Diverter Materials<br>• Increase pump rate in injector<br>• Increase viscosity of fluid (x-link)<br>• Decrease viscosity of fluid<br>• Pump twice design volume, no contact - move to next location | • Lower Bottom Hole Pressure (BHP) - Monitor<br>• Raise Bottom Hole Pressure - Monitor |
| **2. After Communication**<br>• Pump proppant or swell material | • Monitor for proppant<br>• Raise BHP to increase width of fracture<br>• Reduce BHP to decrease width of fracture and capture proppant at formation face |
| **3. Poor injectivity test**<br>• Restart frac with pad<br>• Pump higher concentrations of proppant than first attempt<br>• Increase Pump rate and fluid viscosity | • Flow well and monitor for proppant, raise and lower choke to understand affect on injector stimulation pressure<br>• Raise or lower BHP as required to affect fracture width and height |

FIG. 12

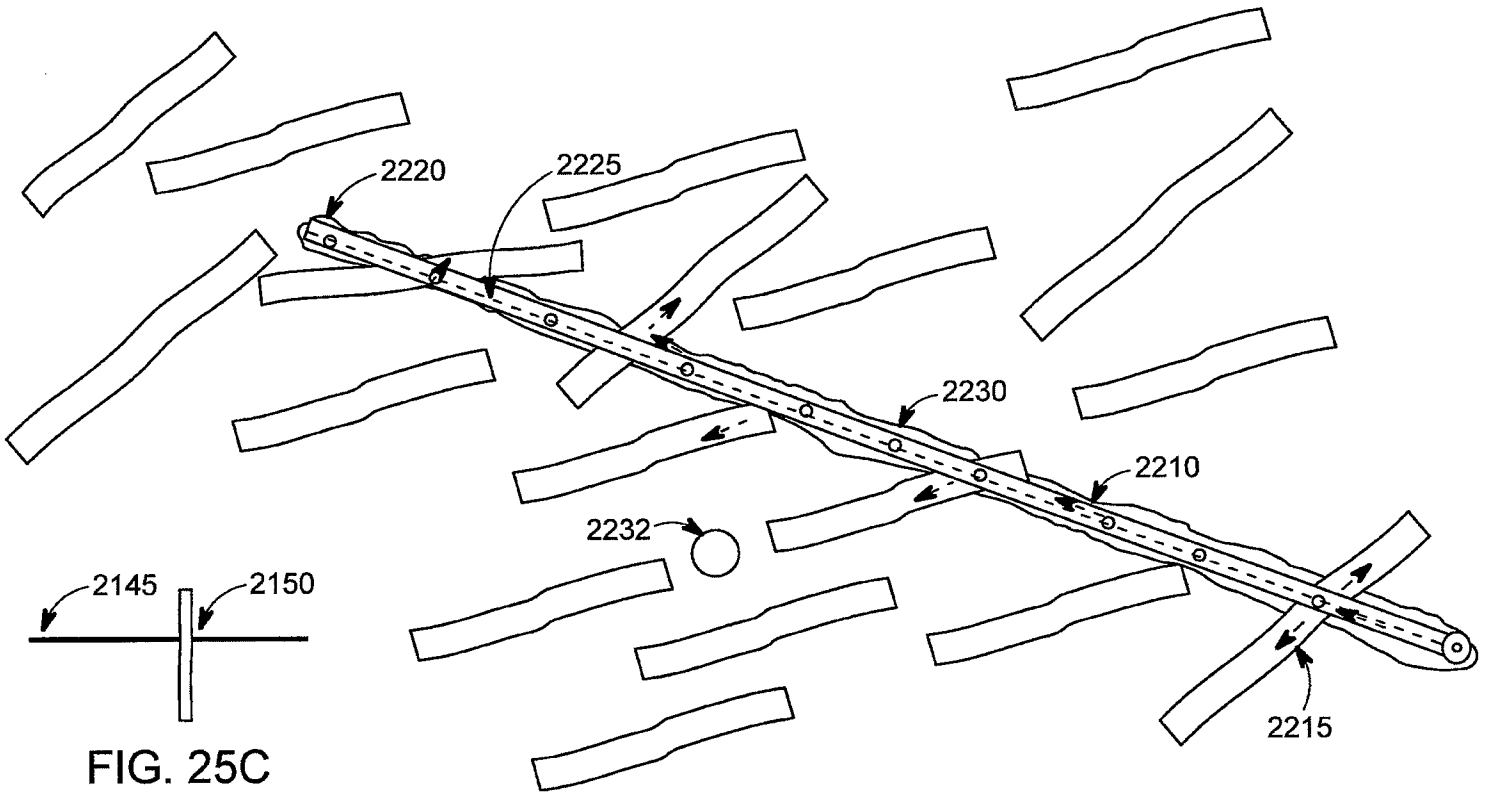
FIG. 25A
FIG. 25C
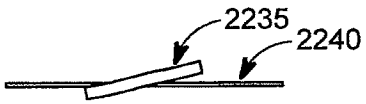
FIG. 25B

DRILL A VERTICAL PILOT GEOTHERMAL WELL

FIG. 32A

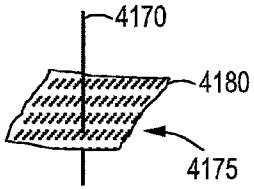

Hit Fractures
Produce

FIG. 32B

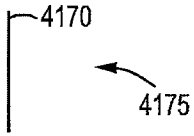

No Fractures
Deepen to Get Oriented Core / Logs
For Horizontal Lateral eddition

SIDETRACK WELL AND DRILL HORIZONTAL – direction to cross naturat fractures (from core / logs / regional geotogy study)

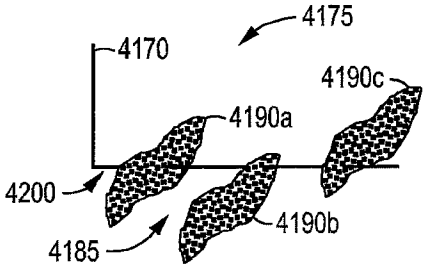

Hit Fractures

- Equip w/GF equipment
- Equip w/Partial Cement Liner (for control)
- Flow/produce well

FIG. 32C

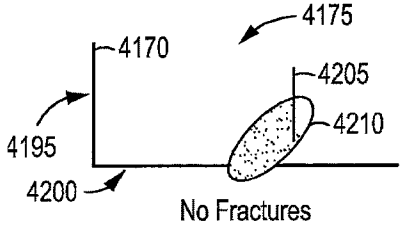

No Fractures

- Pump From Vertical to horizontal to determine frac direction

FIG. 32D

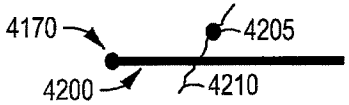

FIG. 32E

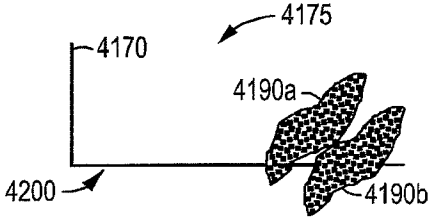

Hit Fractures Near Toe
(or localized to small area)

- Equip w/GF equipment
- Equip w/Partial Cement for isolation
- Flow/produce well
- Drill 2nd Horizontal - EGS Completion Fracture Exchange Network, Direct Contact

FIG. 32F

HORIZONTAL EGS COMPLETION OPTIONS

METHOD OF CONTROLLING TENSILE-SPLITTING AND HYDRO-SHEARING PARAMETERS DURING COMPLETION OF ENHANCED GEOTHERMAL SYSTEM WELLS

CROSS-REFERENCE TO RELATED APPLICATIONS

This application is a continuation-in-part of U.S. patent application Ser. No. 18/818,873 filed on Aug. 29, 2024, which is a continuation-in-part of U.S. patent application Ser. No. 18/644,250 filed on Apr. 24, 2024, and issued as U.S. Pat. No. 12,140,344 on Nov. 12, 2024, which claims priority to U.S. Provisional Application No. 63/535,469 filed on Aug. 30, 2023, and U.S. Provisional Application No. 63/540,435 filed on Sep. 26, 2023, which are all herein incorporated by reference in their entirety.

BACKGROUND

1. Field of Inventions

The field of this application and any resulting patent is methods and systems for geothermal energy production. More specifically, methods and systems for energy or mineral production wherein multiple horizontal or near-horizontal wells may be used to pass fluids through the Earth from an injector well to a producer well through induced cracks, splits, fractures, conduits, or channels in the rock, as well as methods and systems for energy or mineral production wherein horizontal or near horizontal wells are drilled, completed, and equipped for production or injection service.

2. Description of Related Art

Various methods and systems have been proposed and utilized for geothermal energy production, including some of the methods and systems disclosed in the references appearing on the face of this patent. However, those methods and systems lack all the steps or features of the methods and systems covered by any patent claims below. As will be apparent to a person of ordinary skill in the art, any methods and systems covered by claims of the issued patent solve many of the problems that prior art methods and systems have failed to solve. Also, the methods and systems covered by at least some of the claims of this patent have benefits that could be surprising and unexpected to a person of ordinary skill in the art based on the prior art existing at the time of invention.

Large quantities of heat are captured in the Earth's subsurface formations. From the surface to the Earth's core the temperature increases. It is an almost inexhaustible source of energy.

There are many uses for the Earth's heat from home or industrial heating to electricity generation. Generating electricity, however, requires temperatures which will boil fluids and generate vapor to turn turbines to turn generators. This process is not very efficient but can be improved by using even higher temperatures and new power fluids within the many variants of Organic Rankine Cycle (ORC), Brayton Cycle and other heat-to-electricity-generation methods.

Due to the economics of extraction, historically conventional methods to capture and use this heat for electricity generation have been limited to relatively shallow but hot rocks containing a network of natural fractures usually containing naturally flowing water. These types of source rocks are relatively few globally, residing near subduction and volcanic zones such as found in California, Nevada, Indonesia, and Iceland where convection and advection of water at deeper horizons transports heat to shallower fractured networks.

Deep in the Earth, typically below sediment layers, reside rocks which are impermeable and are not fractured, like obsidian (basically glass). There are also many impermeable rocks like granite, basalt, and granodiorite which contain micro fractures and are essentially available everywhere in the world.

There are two primary methods being proposed to access this deep hot source of energy: Closed Loop (collectively named "Advanced Geothermal Systems," AGS), where fluids are circulated within, or proximate to, a single well, and "Enhanced Geothermal Systems" (EGS) where fluids are exchanged between wells. Even if an EGS method were planned for the final completion, the well may be arranged in an AGS configuration and the system tested to gather reservoir data. This could be done while the rig is drilling additional wells.

The Closed Loop method typically requires hotter temperatures than EGS due to its smaller footprint to extract heat from the Earth before it depletes the near well area to unusable temperatures. Tensile-splitting conduits or drilled laterals (branches) may be added to the main well to improve heat transfer from the far field back to the main well. U.S. Patent Publication 2023/0120246 discusses a system comprising a thermal enhancement structure that has longitudinal complex multi-fractured geometry where the structures are filled with thermally conductive cement and fillers.

EGS methods involve injecting fluids through tensile-splitting the two rock planes to create conduits and by hydro-shearing to reopen in-situ micro fractures (sometimes referred to as frac'ing, or cracking, or simply shearing), in typically impermeable formations, between wells to capture heat. The hydro-shearing method of EGS has also been used to improve conventional naturally fractured reservoirs.

Creating conduits between the wells provides flow paths for fluids to move and come in contact with the hot formations. For the same reservoir depth and diameter and length of well bores, EGS accesses and extracts heat over a much larger area than AGS. As a result, EGS exhibits a much smaller (semi)-steady-state temperature drop from the bulk reservoir to the near-well region of the producer wells, compared to AGS.

Two common methods for tensile-splitting the rock to create conduits are: (1) the plug and perf (P&P) method, where clusters of perforations (for example 4 clusters of perforations) are treated simultaneously; and (2) the sleeve method (SM), where typically one single shear conduit at a time is created through holes in the body of a single sliding sleeve, or single set of perforations.

An advantage of the P&P method is the well can be completed quickly. A disadvantage is that typically more than one foot (30 cm) at each cluster is perforated, and this may lead to multiple shorter conduits being generated, rather than the intended one long conduit.

An advantage of the SM method is a more precise treatment for each shear entry point as well as less surface equipment, and thus a smaller surface footprint is required to execute the process. Furthermore, since only a short section of the well is exposed, it will generate only one and thus a longer conduit.

Recently, Fervo Energy in its Blue Mountain Geothermal Field, Nevada, drilled two horizontal wells (Injection Well 34A-22 and Production Well 34-22) parallel to one another approximately 360 feet apart in a 360-degree Fahrenheit hot reservoir for geothermal heat extraction. Fervo then used the conventional plug and perf method of shale fracturing to create a network of induced fractures between the wells. This fracture network method is created by conduits (shear planes) which start at each well. The hope is the conduits will intersect or create a secondary network of perpendicular conduits to connect them. In the Fervo example, Injector Well 34A-22 was drilled and tensile-split shear conduits were installed before drilling the second well 34-22 intended to be the producer. In Fervo's paper entitled "A Review of Drilling, Completion, and Stimulation of a Horizontal Geothermal Well System in North-Central Nevada," the authors referred to this area between the two wells as the "Stimulated Rock Volume" or SRV. International Publication No. WO2013/169242 also discloses using two parallel stimulated horizontal wells for geothermal heat extraction and refers to the area between the wells as a "Production Sub Zone."

In EGS methods there are at least two wells. One well is typically the injector where cooler fluids are pumped from the surface and exits the injector well to encounter the hot rock, and the second well is typically the producer where the now-heated fluids exit the rock to enter the producer well and return to surface. However, additional producers and injectors may be added depending on the amount of thermal power required by the development and the amount of heat energy that is to be recovered.

There are two primary methods for creating flow paths between injectors and producers. The first method is to tensile-split both the injector and producer creating separate conduits from each well. In between the wells the fractures may intersect or otherwise come into communication due to additional smaller fractures created like the branches of a tree. Hydro-shearing may be able to reopen the in-situ fractures and allow communication between separate tensile-split conduits. In this method, typically the injector and producer are cased and cemented. This method is referred to as the "Fracture Exchange Network" (FEN).

An example of this method is described in the Fervo paper previously mentioned. It is difficult to tensile-split granite type rocks, and the resulting conduits tend to be shorter and less contained than in layered sedimentary rock sequences (which typically restrict vertical fracture growth). When trying to extract heat from an area greater than about 350 feet between wellbores, an advantage of the FEN method is it is easier to create two intersecting conduits from an injector-producer pair of wells than it is to create one long conduit. Hence the FEN method creates a larger area to extract heat.

The second method is to tensile-split and create a conduit directly from the injector to intersect the producer. In this method, typically the injector is cased and cemented to control where the fracture is created, but the producer is left open hole (not cemented) or has an uncemented liner (steel tubing). This allows a much larger area for the fracture to intersect the well. This method is referred to as the Direct Contact Method (DCM). An example of this method is described in SPE paper SPE-210210-MS entitled "Development of Multi-Stage Fracturing System and Wellbore Tractor to Enable Zonal Isolation During Stimulation and EGS Operations in Horizontal Wellbores." An advantage to this method is there is better assurance that the conduits between the injector and producer provide effective fluid transmission and pressure communication.

Tensile-splitting from one well to create a conduit that intersects another well ("a frac hit") is something that has been avoided in the oil and gas industry since inception (in direct contrast to frac hits being the planned outcome of EGS tensile-splitting). Methods like those discussed in SPE 194333 (Konstantin Vidma et al., "Fracture Geometry Control Technology Prevents Well Interference in Bakken") and U.S. Pat. No. 10,683,740 to prevent frac hits or intersections are common. Likewise fracturing in the oil and gas industry has targeted low permeability rocks to provide flow channels back to the parent well. However, in EGS tensile-splitting, the rock may have little to no permeability or porosity and therefore behaves differently. However, loss of injection water ("leakoff") has been observed when tensile-splitting these types of formations, indicating that some contain natural micro fractures.

The term Sealed Wellbore Pressure Monitoring (SWPM) has been termed in the shale industry to track frac hits in multiple wells. Thus, methods to avoid frac hits have been proposed. However, methods to encourage the intersection and fluid communication have not been required of shale or conventional oil and gas production.

The following are four methods proposed for oil and gas wells that could be used in EGS methods to keep open the flow channel/conduit network.

The first method is to emplace proppants like sand, resin-coated sand, and/or bauxite dependent on the overburden stress. (Stress is defined herein as the force acting on the unit area of a material. It is a second order tensor and can be decomposed into nine components). This is the method used by Fervo as mentioned above. This method is referred to herein as the "Conventional Method."

The second method is disclosed by Dr. Carlos Fernandez in 20150217 PNNL EGS (DOI: 10.1039/c4gc01917b) Polymer paper and U.S. Pat. No. 9,873,828, wherein he proposes expandable polymers combined with carbon dioxide to expand the fracture opening (hereinafter, the "Fernandez Method"). Fernandez's above patent proposes using proppant to keep the fracture open, but this may not be required, or only in reduced quantities compared to the Conventional Method. The Fernandez Method, due to the triggered expansion of the treatment fluid and/or the effect of pumping cold fluids on the hot rock, may create an uneven sheared surface that still provides an effective flow path/conduit after the pressure is released. The Pacific Northwest National Laboratory has trademarked the name STIMU-FRAC™ for this expansion fluid method.

The third method has been proposed by Nevels in U.S. Publication No. 2019/0323329 entitled "Fracture Formation with a Mortar Slurry." In this method, mortar or cement is added to the fluid used to split the rock. After placement it may set to allow fluids to flow as long as it is permeable or has etched surfaces interacting with the formation.

The fourth method is to maintain liquid or super-critical fluid pressure on the fracture to keep it open, whilst not increasing its dimensions; this is possible because the pressure required to hold open a fracture is less than that required to increase its dimension. In essence, this method simply replaces proppant with pressure.

The above proposed methods focus on controlling the fracturing parameters from the injection well alone.

The Closure Stress for granite-type formations worldwide is on the order of 0.66 psi/ft. It is difficult to tensile-split this rock and generate an aperture between the split rock faces of more than 4.0 mm. These formations are typically vertically very thick, and so lack other formations above or below to stop vertical fracture growth. Therefore, tensile-split conduits created in granite type formations are typically approximately circular ("penny-shaped"), i.e., of similar height and length. In these types of formations, it is also difficult to create split radii much greater than 350 feet, and hence it is very important to manipulate this process as much as possible to achieve the optimum conduit parameters of height, aperture width, and length. The methods of achieving this are discussed below.

Pressures can be applied directly to the rock face through cemented and open hole wells. In cased and cemented wells, it is difficult to induce stress further away than 20 to 30 times the casing diameter. By contrast, in open holes any stress applied is transmitted far into the rock.

Altering stresses in one well whilst tensile-splitting a second well materially affects the direction of the conduits generated by the second well. If not executed correctly the conduits may veer away from the first well and fail to establish flow paths between the wells.

In SPE 17533 by Warpinski ("Altered Stress Fracturing" in the Journal of Petroleum Technology, September 1989, pp. 990-996), the author shows fractures propagating from one well were perpendicular to the usual direction, when simultaneously fracturing two nearby vertical wells.

Once a formation has been tensile-split, if the resulting conduit were subsequently propped this would permanently change the stress state of the formation. To avoid the direction-altering influence of this changed stress state, any new tensile-split conduit must be initiated at a horizontal distance along the lateral well that is at least half the distance into the formation of the diameter or major axis of the previously created conduit.

In summary, applied stresses must be applied at the correct location, and time in both injector and producer wells to create the desired intersection of conduits between them.

The following is a worked example: Stresses adjustment around fracture initiated and kept inflated by pressure Po can be assessed by (SPE 17533):

$$1/2(\sigma_x + \sigma_y) = -p\{L/\sqrt{L_1 L_2} \quad (1)$$

$$x\cos[\theta - 1/2(\theta_1 + \theta_2)] - 1\},$$

$$1/2(\sigma_y - \sigma_x) = p\{L\sin\theta/h/2(h^2/4/L_1 L_2)^{3/2} \quad (2)$$

$$x\sin[3/2(\theta_1 + \theta_2)]\},$$

$$\tau_{xy} = -p\{L\sin\theta/h/2(h^2/4/L_1 L_2)^{3/2} \quad (3)$$

$$x\cos[3/2(\theta_1 + \theta_2)]\},$$

$$\text{and } \sigma_z = \mu(\sigma_x + \sigma_y), \quad (4)$$

Fracture rotation from injector will follow: a=½*tan−1 ($\tau_{xy}$/(S1−S2)). The distance B should satisfy 10 deg fracture rotation, therefore: $\tau_{xy}$/(S1−S2)~0.364, where $\tau_{xy}$ is shear stress induced by fracture in cartesian coordinates;

And new effective stress S1=Shmin−Sx; S2=Shmax−Sy;

P is the internal fracture treatment pressure above closure;

h is the fracture height;

L is distance from center of fracture to point;

L1 is distance from negative fracture tip to point;

L2 is distance from positive fracture tip to point;

x, y, z cartesian coordinates;

Θ is angle from center of fracture to point;

$\Theta_1$ is angle from negative fracture tip to point;

$\Theta_2$ is angle from positive fracture tip to point;

(σH) max maximum horizontal principal in-situ stress;

(σH) min minimum horizontal principal in-situ stress;

σx, σy, σz stresses induced by fracture in Cartesian coordinate directions;

σ1, σ2, σ3 stresses in reservoir layers;

and the geometric relations are given by:

$$L = (x^2 + y^2)^{0.5}$$

$$\Theta = \tan^{-1}(x/-y)$$

$$L_1 = (x^2 + (y + h/2)^2)^{0.5}$$

$$\Theta_1 = \tan^{-1}[x/(-y - h/2)]$$

$$L_2 = x^2 + (y - /h/2)^2)^{0.5}$$

$$\Theta_2 = \tan^{-1}[x/(h/2 - y)]$$

Negative values of Θ, $\Theta_1$, and $\Theta_2$ should be replaced by Π+Θ, Π+$\Theta_1$ and Π+$\Theta_2$, respectively.

Furthermore, it is well known that heat is recovered from fractured and non-fractured geothermal reservoirs by drilling a wellbore into the heat reservoir. It is also very important to understand the direction tensile-split conduits propagate so that procedures can be imposed to ensure connection between adjacent laterals.

Current methods including acoustic anisotropy from oriented cores, micro-seismic fracture mapping, borehole breakouts, Formation Microresistivity Imaging (FMI logs), etc. are all useful but far less accurate than required for proper lateral placement. Many of the previously disclosed methods may only be accurate to +/−20%. They may also require other wellbores to be drilled or for sensors to be cemented in place.

In SPWLA-1989-v30n2a1 paper, Dr. David Yale detailed how he developed a set of techniques called "shear acoustic anisotropy" that utilizes shear-wave birefringence to determine the direction of maximum horizontal stress from core measurements and thus predict the azimuth of propagation of fractures. This method was reported to be within 15% of other fracture direction measurements such as anelastic strain relaxation, tiltmeter surveys, core fracture descriptions, over coring of mini fracs, and horizontal velocity anisotropy.

Mathew Bray details many of the problems associated with processing micro-seismic data in his SEG-2018-2998425 paper. He also shows the data scatter that is typically associated with the process.

CA 2934771C patent describes using down hole strain measurements in determining hydraulic fracture system geometry. However, the author notes it is desirable to couple the fiber to the formation as efficiently as possible. Typically, this requires cementing the fiber in an epoxy filled tube attached to the casing. The strain sensing fiber may be run in tandem with a temperature sensing and an acoustic sense optical fiber. However, for the strain sensing fiber to function it must be in contact with the formation as described above (i.e. cemented in the wellbore).

Maximizing the probability that fractures initiated from two adjacent laterals intersect each other may require their initiation points to be within 20 feet of a perpendicular line between the wells. Therefore, it is imperative the tensile-split conduit orientation be as accurate as possible.

Another method for determining the height of tensile-split and hydro-sheared conduits is radioactive tagging. In U.S. Pat. No. 4,415,805, the author disclosed a method whereby radioactive tracer elements are injected into the fluid of a hydraulic tensile-split stimulation. After the stimulation, a gamma ray logging tool was run across the injected wellbore zone and gave an indication of the top and bottom of the created conduit. Typically, the radioactive tracer element was coated on a grain of sand or other similar material, and thus the height or base of the fracture was more related to where the tracer element last traveled. Nowadays there are polymer embedded tracers as well. Companies like ProTechnics, which is now owned by Core Lab, have been in the business since the 1980s and are still active in this business of supplying tracers and analyzing data. It is common to run a temperature tool, a gamma ray recording tool and a casing (or tubing) collar locator in tandem. The collar locator can help with depth control as it records the location of every collar, which can be compared to a tally sheet and depths recorded with other gamma-ray logs. Other tools used for noise or other diagnostic methods may also be substituted in a tandem string. It is common to look for radioactive isotopes or similar non-radioactive tracers in the injected wellbore, but it is not common to look for them in another wellbore.

Almost all the above techniques that use conventional downhole logging tools (i.e. FMI, BHTV, and Gamma log) currently have temperature limitations which may confine them to certain depths or certain reservoirs without new insulator housings or other cooling methods.

Additionally, it is well known that heat is recovered from fractured and non-fractured geothermal reservoirs by drilling vertical or inclined wells into the heat reservoir. As disclosed in The Society of Petroleum Engineers Paper SPE-214409-MS "*Maintaining the Integrity of Geothermal Wells During the Construction Process*", copyright 2023, well control related risks in drilling geothermal wells are amongst the highest operation risks. Well control events in geothermal wells are typically initiated by the uncontrolled release of thermal energy, called a "thermal or steam kick". The steam kick comes to the surface as hot brine, steam, or mix of these two with a minority of non-condensable gases such as $CO_2$ and $H_2S$.

It is also well known that the extreme heat found in geothermal reservoirs will cause electronic instruments such as those used in directional drilling tools to fail. Therefore, it is desirable to use methods to cool the instruments or limit the time instruments are exposed to reservoir temperatures. Insulating the drilling pipe to prevent premature heating of the fluid prior to its emergence at the subsurface tools near the bit is one method.

U.S. Patent Publication 2023/0228155 discloses using TK-340XT (400 μm) epoxy novolac resin coating, which is available from NOV, on drill pipe to generate a length-normalized thermal resistance of 0.0024, and it also discloses applying an outer e-glass coating to the drill pipe. Applying the coating may reduce the temperature exchange between pumping down and circulating out drilling fluids.

Another method is to use surface coolers to cool the mud before pumping down hole. CA2946598 titled "Drilling Mud Cooling System" describes a surface system to cool mud and cuttings.

Another concern in drilling naturally-fractured reservoirs is the loss of fluids while drilling. This can cause well control issues as well as the potential sticking of the drill string.

In SPE 19825 entitled "Drilling and Production Aspects of Horizontal Wells in the Austin Chalk," the authors discuss some considerations in drilling fluid hydraulics to ensure proper hole cleaning.

Continuous Measurements or Logging while Drilling (MWD/LWD) data transmission from downhole to surface can be accomplished using several different technologies. The two most popular are mud pulse and electromagnetic (EM) telemetry. Mud pulse uses a downhole valve to restrict fluid flow and create a pressure pulse through which data is sent to the surface via the mud column. EM telemetry uses a downhole transmitter and surface receiver to transmit data through the formation using electromagnetic waves. Mud pulse can be inside or outside the drill pipe and inside is recommended when drilling potential lost circulation zones. EM systems can be more reliable and move data faster but can be depth and/or formation limited. Means to transmit the data via the casing or using repeaters can be employed in deep wells or where formations have a high resistivity.

MWD/LWD tool operating temperature limits are generally 175 degrees Celsius (or about 350 degrees Fahrenheit). If operating temperatures exceed these limits, tool failure can be expected leading to costly time to replace failed components and a worst-case scenario that it is not possible to meet the overall well directional profile objectives.

Wireline retrievable survey tools like the HP/HT (High Pressure/High Temperature) version built inside a thermal flask and sold by Stockholm Precision Tools are capable of operating in bottom hole circulation temperatures (BHCT) up to 205 degrees Celsius (about 400 degrees Fahrenheit), and 20,000 psi may be pumped down to the tool face and recovered via a slick line or wireline. When run in conjunction with an orientation sub near the bit they will provide the inclination and orientation of the bit. The draw back from this survey method is the significantly long duration and cost associated with each survey. Therefore, this approach would only be considered if MWD/LWD surveying was not possible and significant flexibility exists in subsurface target accuracy, i.e., this method of downhole surveying is not practical to follow a prescribed directional profile and can only be used for very limited hole angle and azimuth constraints.

SUMMARY

The embodiments disclosed herein relate to geothermal energy production, but, more generally, to any energy or mineral production where multiple horizontal or vertical wells are used to pass fluids through the Earth from an injector well to a producer well through induced cracks, splits, fractures, conduits, or channels in the rock. The embodiments disclosed herein also relate to geothermal energy production (and any other energy or mineral production) where there is more than a single injector and producer well. More specifically, the embodiments relate to how the flow paths or conduits between the injector(s) and producer(s) may be constructed. The embodiments are based on the understanding that rock stresses may be altered during tensile-splitting and hydro-shearing processes and that previous in-situ fractures may have altered the pre-stimulation rock stress.

Altering the rock stress in one well either before and/or during the tensile-splitting treatment in a second well may affect the in-situ reservoir rock stresses and improve or impede the ability of a shear-plane/conduit to grow towards or away from the first well.

From rock mechanics theory it can be shown that increasing the rock stress in a well oriented 90 degrees to the least principal stress of a rock formation may cause the generated shear plane from a second well undergoing tensile-splitting to favor growing in the direction of the first well. However, if the induced stress from the first well is too high this may cause the shear plane to turn and grow parallel to the first well. Furthermore, lowering the wellbore stress in a well may also cause the shear plane to not intersect it.

In one embodiment two wells (an injector and a producer) with parallel, and facing, horizontal hole-sections ("laterals") may be constructed in a geothermal heat reservoir. The horizontal hole section in one, the injector, may have inserted along its full horizontal length a steel tube (a "liner"), which is cemented to the rock. In the other, the producer, the horizontal hole section may be open or may have a liner inserted, but cement may not be placed in the horizontal hole. Prior to the start of the tensile-splitting operation in the injector, water may be pumped into the producer well to raise the pressure in the horizontal hole to just below the rock fracture (split) Pressure; this may increase the stress at the producer and further into the rock near the producer.

During the tensile-splitting operation from the injector, the pressure in the producer may be monitored to determine when the induced shear on the formation created by pumping in the injector has intersected the producer. This may be seen by a dramatic pressure increase in the producer.

Once communication has been established (by noting increased pressure or another method) the operator has the ability to increase the pressure in the producer (or producers if there are more than one in proximity of the injector); decrease the pressure in the producer(s); or remove fluids, lowering the hydrostatic bottom hole pressure or surface pressure from the producer(s) so the pressure remains constant or is lower or higher. This pressure control may have a direct impact on the formation and progression of the tensile-splitting of the rock from the injector. For example, lowering the pressure in a producer may cause the conduit approaching that producer to stop growing and cause a conduit further away from that producer to grow, potentially improving the ability of a conduit from the injector to intersect one or more other producers.

In another embodiment, allowing water from a producer to flow to the surface could allow for improved proppant placement between that producer and the injector, as this may cause proppant-laden water from the injector to move in the direction of the producer.

Furthermore, the fluid injection rate in the injector may be varied once communication through conduits has been proved in one or more producers. By such means, the emplacement of plugging agents and fluid loss materials and the cross-linking of injected gels may be carefully controlled by pumping fluid from the injector and monitoring the effect on the producer(s).

If sand or other proppants are pumped in the injector to keep the conduits open permanently without applied water pressure, monitoring the flow in the producer using downhole fiber or other methods may allow the operator to optimize the tensile-splitting and hydro-shearing designs and to ensure sufficient proppant has been placed in the tensile-split conduits and any newly opened in-situ conduits.

Additionally, at the end of the stimulation, the pressure in the producer may be reduced to the anticipated production pressure and an injectivity test performed in the injector. If an insufficient rate is achieved, the zone may be restimulated and additional proppant placed, or other stimulation parameters altered.

If expandable fluid systems like those described by Fernandez above are used, the required fluid injection pressure in the injector may be much lower than the Common Method; and carbon dioxide or other activators may also be pumped into the producer to contact and swell the fluid near the producer. Likewise, carbon dioxide or another activator may be injected into the conduit from the producer.

To improve injection control in the producer, sections of the well may be segregated through the use of open hole packers and ported sleeves to limit the area being contacted by internal pressure or frac hits generated from the injector.

The above methods may be applicable in the following instances: using the single sleeve or plug and perf completion method targeting a single or multiple fractures; a variation/combination of the two methods; and any other method where monitoring of the conditions in the producing well may result in changes made to the injection well treatment.

As mentioned previously, many reservoirs contain in situ natural fractures. However, due to faulting and tectonic stresses there may be areas of the same reservoir at the same depth that do not contain fractures. The EGS methods and techniques described herein are applicable to both. In a preferred embodiment there is a reservoir that has areas containing a population of in situ tectonically produced fractures while other areas may be devoid of such fractures. A horizontal lateral well may be drilled through the reservoir intersecting both regimes. In the non-fractured section methods described utilizing the FEN method or the DCM method may be used. However, in the fractured area many of the same techniques described to control fracture growth by manipulation of pressures in offset lateral wells may also be used to reactivate and connect the fracture systems between the two or more laterals.

Prior to or once the first tensile-splitting operation has been performed, computer software and artificial intelligence methods may be used to monitor the treatment data to suggest changes to the creation and ultimate conductivity of the conduits.

Artificial Intelligence (AI), Machine Learning (ML) and Large Language Models (LLM) can customize and optimize EGS Completions and Operations. Conventionally the system designer must try to take data from many different sources and use many different software and learnings to develop a development plan. Geologic rock properties and in situ fracture knowledge must be integrated with heat flow modeling, wellbore sizes, induced fracture design, circulation rates and fluid distribution along the lateral, to optimize the optional number of wells/laterals for the required amount of energy needed and lifespan of the project, whilst simultaneously minimizing the total project cost and parasitic loads and operating costs for a given amount of heat produced. With the correct programming AI can access the global on-line repository of software and LLMs and deploy these to integrate geologic, stimulation, operational, and financial models and data to determine the optimum design. In a preferred embodiment AI, ML, and or LLM are used to optimize the design and development of an EGS completed geothermal reservoir wherein the optimum operational and financial conditions are met.

There are three primary methods to monitor the tensile-splitting treatment in the producer. The first may be to attach pressure, radioactive, noise, or other sensors to the producer's casing. Data may then be gathered by wire, fiber, RFID Tag, or other means. The second method may be to attach sensors to coiled tubing or wireline run from the surface inside the production casing to the "toe" of the horizontal section. Data from the sensors (such as pressure, radioactivity, noise, and other) may then again be collected by either a wire, fiber, RFID tag, or other means. The third method may be to use micro-seismic sensors in the producer or in a nearby offset well.

The heat collecting and stress altering properties of a matrix of achievable distances between created tensile-split conduits and intersecting wells may be determined by computer modeling, for different circulation rates. This modeling may yield the optimum project economics of well life before fluids fall below the temperature threshold required to generate electricity or satisfy a direct heat specification. This distance is also designed to minimize interaction between the newly altered stress state of the rock.

Induced fractures are depicted herein in many places as being vertical. However, due to tectonic stresses especially in deep hot reservoirs created by narrow depths to magma or in areas where plate tectonics has created localized changes in stress-fields the fractures may be tilted in any orientation. Localized stresses may for example grow fractures at a 45-degree angle versus a 90-degree angle. In a preferred embodiment the placement of the horizontal laterals rather than being at the same vertical depth may be altered where one is higher or lower than the other to improve the intersection of induced fractures and/or the intersection with another horizontal lateral.

Likewise, this newly created conduit network between wells may be used as a method to create a pressurized reservoir storage system. In embodiments, at appropriate times excess fluid pressure may be released from the wells to produce fluids to the surface to turn hydro turbines to generate electricity. This power may be used initially to run pumps to bring the system to a heated condition to run steam turbines.

Fluid temperatures selected for stimulation may influence the effectiveness of tensile-splitting and hydro-shearing. Cooling the rock may apply additional stress to the rock. Either circulating fluid in the producer to cool it during the stimulation or cooling injection fluids in the injector may have a beneficial effect on the creation of conduits and also may reduce the Darcy skin factor of the wells by creating near-wellbore fracture networks.

By using either the DCM or FEN process detailed herein heated fluids will be returned to the surface. These superheated fluids may then be used for multiple processes including the generation of electricity through the direct steam flash processes, or using a binary cycle whereby the fluids are passed through a surface heat exchanger to transfer heat to a working fluid to be used directly by heat consumers; and/or to generate electricity using the Rankine, Brayton and other vapor cycles; and/or to convert to process steam; and/or to manufacture substances like Hydrogen, Ammonia, or synthetic fuels derived via for example the electrochemical syngas and thermal Fischer Tropsch processes. If the temperature of the fluids is too low to meet a specific industry specification, it may be supplemented by other sources of heat derived from electricity or from fuels like methane or propane to reach the required temperature. In addition to water, other fluids such as supercritical $CO_2$ may either be used independently or in conjunction with water as the fluid circulated through the earth to extract geothermal energy. In a preferred embodiment two or more horizontal wells may be exchanging fluids between injector(s) and producer(s). These fluids may transfer their heat to another fluid via a surface heat exchanger, or be used directly, or be supplementally heated with another source and used directly or used in combination with the syngas and Fischer Tropsch processes to reach the desired outcome.

Turning now to the FEN method, in other embodiments, two wells with parallel, and facing, horizontal hole-sections ("laterals") may be constructed in a geothermal heat reservoir. The horizontal hole section in one, the injector, may have inserted along its full horizontal length a steel tube (a "liner"), which may be cemented to the rock. In the other, the producer, the horizontal hole section may have inserted along its full horizontal length a steel tube ("liner"), which may also be cemented to the rock. The tensile-splitting conduit formation operation may be started and pumped from the injector or the producer first. The entire planned conduit formation operation may be designed to extend slightly more than half the distance separating the wells. At the conclusion, pressure may be bled to just below the shear-splitting extension pressure but still above the hydro-shearing pressure, so keeping open the conduits. The placement of the perforations in the second well should be as close to a perpendicular line intersecting the first well's stimulation as possible. Distances off this line of greater than approximately 20 feet may result in no intersection of the conduits. The stimulation in the second well should contain sufficient fluid and pumping power to extend more than half the distance separating the two wells. Pressure may be monitored in the opposing well until communication is observed. At this point, proppant, expansion fluids, permeable cement, or another method may be used to prop, and hence leave open, the newly created conduit between the wells. When sufficient fluid has been pumped, or proppant or other material noted in the producer, the operation may be halted and pressures bled.

If difficulty is experienced with connecting conduits between the two wells, the fluid viscosity and the fluid pump rate may be varied. If difficulty continues, fracture plugging or diverter or plugging materials may be added. If still unsuccessful, further attempts may be discontinued and the operation moved to the next well section. At this point attempts should be made to align the initiation points closer. Stimulation volumes should also be increased. It may also be necessary to conduct a mini-frac to assess formation leak-off, height and other properties.

Tensile-stress initiation points along the horizontal section of the well should ideally be no closer than the distance of the length of conduit created between the wells to ensure the new stimulation is in an area of unaltered stress. For example, if the distance between the parallel wells is 400 feet and the designed tensile-stress conduit extends 250 feet towards the other well, then the horizontal distance along the well between conduits should ideally be no less than 250 feet. However, if the difference between the maximum and minimum rock tensile stresses is low, the horizontal separation distance between the conduits may be reduced below the above guideline to better remove heat from the reservoir. When well pressure approaches the planned production circulation pressure, a flow test may be performed by pumping at the desired production rate to establish whether an economic mass flowrate of water can be achieved.

In the EGS method of heat extraction from the earth one of the primary controlling factors is the pumped fluid circulation rate from the injection wells, through the fractures and back up the production wells to the surface. The pump power required to overcome frictional losses from injecting and producing fluid at a given circulation flowrate is a function, amongst other, of the internal diameter of the steel casing/tubing through which the fluid flows. Hence, for a given circulation flowrate, parasitic power and parasitic energy requirements (defined as the amount of power & energy spent to extract the heat from the reservoir, and of which this pump power is the most significant) can be reduced by increasing the diameter of the tubing/casing. Although oil and gas production casings are typically 7" or smaller, in geothermal developments sizes of 13⅜" or 16"

may become commonplace to balance the lower frictional power losses and higher capital costs of larger sizes to optimize the profitability of the development. Likewise different sizes may be used in combination to refine this balance. Similarly, friction-reducing chemicals may also be added to reduce the parasitic loads. In a preferred embodiment, a string of 9⅝" casing is used as a liner in a horizontal lateral in conjunction with a string of 16" intermediate casing to reduce heat gathering circulation rates. In the same embodiment friction reducing chemicals may be added to the fluid stream to further reduce friction-related horsepower requirements. In another preferred embodiment large submersible pumps or other forms of pumping equipment may be inserted in the large intermediate production casing wellbore to further reduce friction pressures.

One or more specific embodiments disclosed herein includes a method of controlling tensile-split conduits in a subterranean geothermal formation, comprising the following steps: providing an injection well extending from a surface to a subterranean geothermal formation, wherein the injection well comprises a plurality of cemented casing sleeves, wherein each of the plurality of cemented casing sleeves is capable of being opened, closed, or choked; providing a production well extending from the surface to the subterranean geothermal formation, wherein the production well comprises an uncemented liner, wherein the uncemented liner comprises a slotted/predrilled liner; configuring the injection well for injection of a tensile-splitting fluid into a production zone, wherein the production zone is defined within the subterranean geothermal formation, and further wherein the production zone requires tensile-splitting to enhance fluid conductivity; configuring the production well to produce a heated fluid from the production zone; applying pressure to the production well at a pressure below the tensile-splitting initiation point, wherein the shear stress is increased in the maximum horizontal stress direction and a tensile-splitting conduit is encouraged to intersect the production well; creating a plurality of tensile-split conduits by injecting the tensile-splitting fluid into the production zone of the injection well, and further wherein each of the plurality of tensile-split conduits intersects the production well; raising or lowering the pressure in the production well in response to acquired real-time data during the tensile-splitting operation, wherein the raising or lowering of the pressure in the production well facilitates changing the height, width, and/or length parameters of the induced plurality of tensile-splitting conduits, and further wherein the pressure is raised in the production well by pumping a pressure fluid into the production well while simultaneously pumping the pressure fluid into the injection well, and further wherein the pressure is lowered in the production well by lowering the hydrostatic level by employing a pump, jetting, or flowing, and further wherein the real-time data comprises pressure, temperature, seismic information, or a combination thereof, wherein the real-time data is input into a computer equipped with artificial intelligence; establishing fluid communication between the injection well and the production well by imposing a hydraulic pressure above the hydro-shear pressure and below the tensile-splitting pressure on the plurality of tensile-split conduits, wherein the plurality of tensile-split conduits are maintained in an open condition, in order to extract heat by circulating a supercritical carbon dioxide between the injection well and the production well; and producing the heated fluid to the surface, wherein the heated fluid is employed as direct heat, for electricity generation, or for creating energy carrier fluids.

Further, some embodiments disclosed herein relate to geothermal energy production but may also be used in conventional or unconventional oil and gas operations where it is important to know the orientation that shear-stress induced tensile-split, or hydro-shear conduit grows.

In one embodiment two wells (one vertical and one near-horizontal) are located in a geothermal heat reservoir. The vertical well is cased, cemented, and perforated at the same horizon as the lateral in the near-horizontal wellbore. The horizontal well is not cased but has a string of drill pipe or another tubular run to near the "toe" (farthest point) of the well. Inside the drill pipe an acoustic and strain sensing fiber like that marketed by Halliburton under the ExpressFiber™ has been deployed by pumping it to the toe of the drill pipe, and thus runs from the surface to the toe of the well. Similarly, temperature-sensing fiber data could be used or a combination of fibers calibrated to measure acoustic, temperature and strain could be deployed. Attached to the fiber at the surface is a computer to transmit and decode the optical fiber. A common system for this, known as Distributed Temperature Sensing (DTS) is one that uses the natural Rayleigh backscatter in optical fiber to deliver a virtually continuous line of temperature measurements. A base line temperature reading is taken across the length of the lateral. Through the perforations in the vertical well, stimulation fluid is pumped at high pressure so that the induced stress exceeds the rock breakdown pressure of the geothermal reservoir and a tensile-split conduit propagates away from the vertical wellbore. Simultaneously acoustics or temperatures on the fiber are monitored in the horizontal wellbore. When sufficient volume has been pumped, a dramatic temperature/acoustic change will be seen in the lateral section of the horizontal well at the point of intersection. Triangulation between the location of the vertical well and the location of the intersection point in the lateral section of the horizontal well will be the orientation of the conduit. Once an intersection has occurred, testing by producing the tensile-splitting fluid may be conducted at various rates to determine the capacity to withdraw heat from the reservoir.

Precise depth control for the fiber has been a common issue as fibers can stretch or may not be fully deployed to the end of the wellbore. To improve depth control, small injection ports may be installed on the drill pipe or tubular at known points. Once the fiber has been deployed, fluid may be circulated down the drill pipe and through the ports. There will be an acoustic or temperature change at the point of the port and can be sensed by the fiber giving a known depth correlation.

Although a pump down temperature fiber is preferred, the fiber would be just as effective if inserted in a tube like a common capillary tubular used for injecting chemicals in a well, and either inserted, pumped, or attached to the drill pipe or other tubular. Similarly, an acoustic or strain fiber may be substituted for the temperature fiber or three fibers run in combination.

In another embodiment a temperature fiber may also be located in the vertical well to assess other properties like (a) the top and bottom of the tensile-split conduit; and (b) the difference in temperatures at the face of the conduit and at the face of the intersection point in the lateral section of the horizontal well, at varying rates.

In another embodiment it may be advantageous, where regional stresses are not constant, to have two vertical wells and one long lateral section of a horizontal well. In this manner two separate tensile-split conduits can be created and the change in orientation over a given distance measured.

In another embodiment it may be beneficial for the path of a lateral section of the horizontal well to be a half circle pattern to eliminate any areas where an induced tensile-split conduit would be parallel to a straight lateral section of a horizontal well and therefore never intersect it.

In another embodiment it may be beneficial to learn if the induced tensile-split conduit has split. In such a case multiple intersections may be made on the lateral section of the horizontal well.

In another embodiment, a temperature recording tool may be run on a conductor cable to the toe of well. Once intersection is determined, the tool may be recovered from the well indicating the temperature at the intersection.

In another embodiment, radioactive tracer or non-radioactive elements may be injected into the flow stream of the stimulation emanating from the vertical well. Once they have traveled through the induced conduit their entry point may be detected in the horizontal wellbore by pumping down a gamma ray or spectral gamma ray or similar logging tool down the drill pipe to the toe of the lateral and logging as it is removed out of the wellbore. Excess tensile-splitting-related materials may need to be circulated out of the annulus using sweeps of viscous fluids prior to logging to prevent masking of the entry point by excess material in the annulus. Conversely the logging tool may be pulled out of the hole while pumping from the vertical well continues. It is common to run a tandem temperature, gamma ray tool, and collar locator for depth control and multiple analytics.

In another embodiment during the stimulating of the vertical wellbore it may be beneficial to circulate cool fluid in the drill pipe and up the annulus to reduce the temperature to which the fiber is exposed, to prolong its life.

In another embodiment, if an in-situ natural fracture, or swarm of fractures has been encountered in the vertical well and also has been encountered in the lateral section of the horizontal well the same techniques described for induced tensile-split conduits may also be used to determine the orientation of in-situ fractures, splits, conduits, etc.

In another embodiment, coiled tubing, tractors or other conveyance means may also be used to manipulate fiber or other traditional wireline-deployed real-time tools for sensing changes inside the lateral due to temperature, noise, flow rate, etc.

In another embodiment, memory tools for recording, temperature, noise, gamma ray, collars, etc. may be attached to tubing, drill pipe, coiled tubing, slick line, tractors, or other convenience means. Once retrieved their data can be downloaded to determine the intersection point.

In another embodiment, once intersection from the vertical well to the lateral section of the horizontal well has been established, fluid may be pumped from the lateral section of the horizontal well and produced out of the vertical well to further confirm the connection as the cooling change or acoustic change may be more pronounced.

Further, the process of drilling a hot potentially naturally fractured horizontal well lateral is much more complex than drilling either a vertical well into fractures of a hot geothermal well that has minimal chance of loss circulation or well stability issues. In addition, how the well is going to be completed and how the hot geothermal fluid is to be used bear much consideration as well.

Table 1 details the process that must be undertaken to result in a successful economic project.

TABLE 1

| Drilling/Completion Process | |
|---|---|
| Pre-Planning | |
| | Analyze offset well information<br>Define well design parameters<br>Establish preferred location/options<br>Determine number of required wells and lateral length<br>Define fluid extraction temperature and rate for surface use (total &/well) |
| Vertical Pilot Well | |
| | Plan and Execute Pilot Well<br>Determine induced and natural fracture orientation<br>Gather rock property data from cores and logs |
| Horiz. Expl. Well | |
| | Take learnings from pilot well and design development<br>Standalone scenario<br>Flow/Pump Well<br>Greenfire Closed Loop Circulation<br>Pump between wells scenario<br>Direct Contact EGS Method<br>Fracture Exchange EGS Method |

Table 2 details the drilling operational decisions that must be undertaken to result in a successful economic project.

TABLE 2

| Drilling Operational Considerations | |
|---|---|
| Anticipate Risks | |
| | Fractures resulting in drilling fluid losses<br>Lost Circulation<br>Well instability<br>Managed Pressure Drilling to control bottom hole pressure and ensure full drilling fluid circulation |
| Equipment Limits | |
| | Directional Drilling Motors and Well survey Tools<br>Mitigation Plan<br>Major Fluid Losses - in this scenario, much of the drilling fluid is lost and so not recycled back to the surface. Therefore, fresh ambient temperature drilling fluid is always injected at surface. This keeps the survey measurement equipment within maximum temperature operating limits |

TABLE 2-continued

| Drilling Operational Considerations |
|---|
| No Fluid Losses |
| Cool the drilling fluid with the use of mud coolers and surface retention time |
| Dilute fluid with additional circulation method |
| Utilize coatings on drill pipe for insulation |
| Utilize pump down - wireline recovery systems |
| Run low-cost expendable directional and measurement tools |
| Surface Equipment |
| Temperature resistant elastomers |
| Special piping and steam vent systems |

BRIEF DESCRIPTION OF THE DRAWINGS

FIG. 12 presents methods proposed to be employed in injectors and producers when certain conditions have not been met.

FIG. 25A is an aerial view of a method of determining the orientation of natural fissures or fractures in a rock formation.

FIG. 25B is an alternative aerial view of a method of determining the orientation of natural fissures or fractures in a rock formation.

FIG. 25C is an alternative aerial view of a method of determining the orientation of natural fissures or fractures in a rock formation.

FIG. 32A illustrates an embodiment of a vertical pilot geothermal well in which fractures are encountered.

FIG. 32B illustrates an embodiment of a vertical pilot geothermal well in which no fractures are encountered.

FIG. 32C illustrates an embodiment of a sidetrack horizontal well in which fractures are encountered.

FIG. 32D illustrates a side view of an embodiment of a sidetrack horizontal well in which no fractures are encountered.

FIG. 32E illustrates a top view of an embodiment of a sidetrack horizontal well in which no fractures are encountered.

FIG. 32F illustrates an embodiment of a sidetrack horizontal well in which natural fractures are encountered near the toe of the well.

DETAILED DESCRIPTION

1. Introduction

Figure 1A:
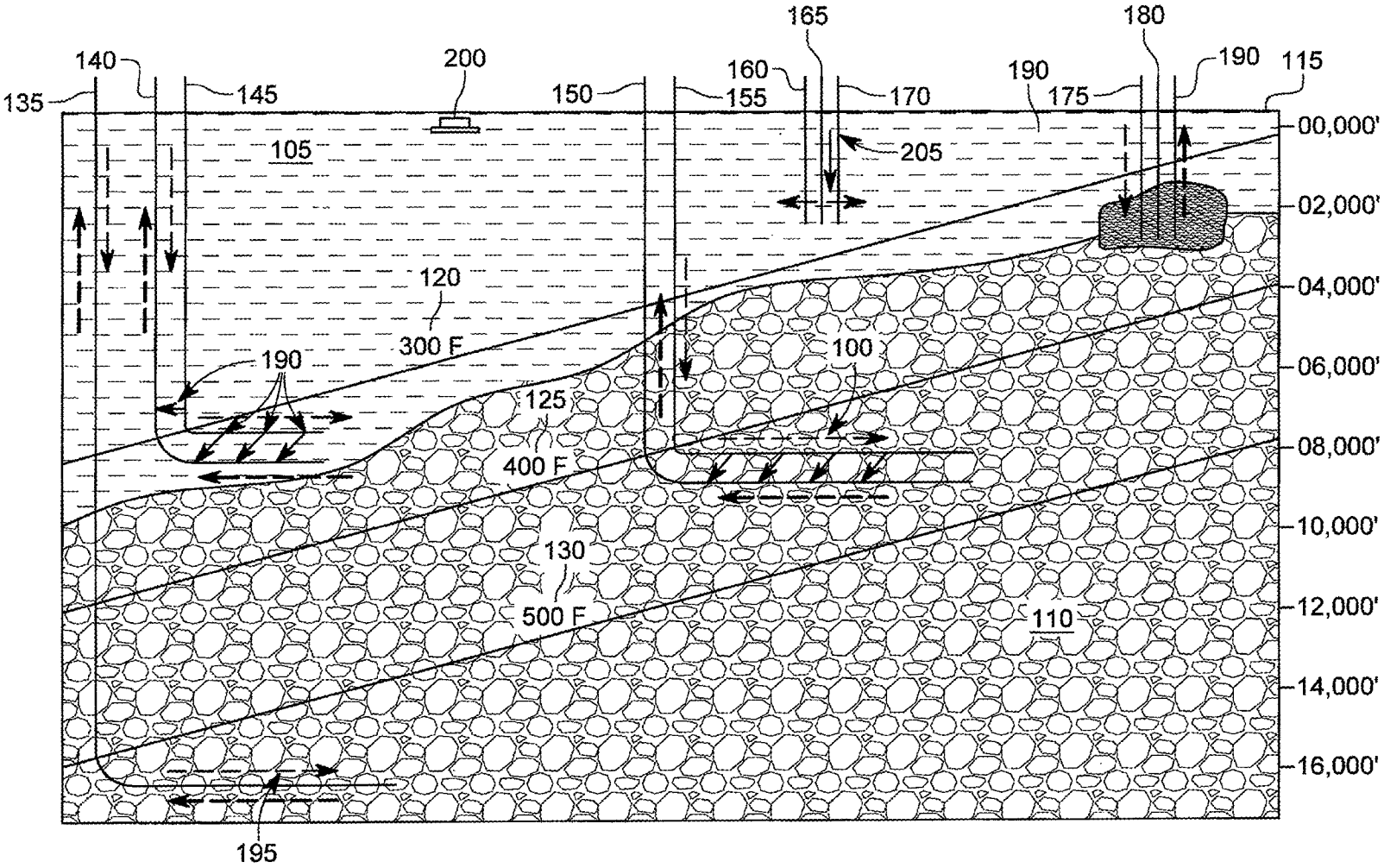
FIG. 1A is an illustration of embodiments of multiple geothermal systems.

A detailed description will now be provided. The purpose of this detailed description, which includes the drawings, is to satisfy the statutory requirements of 35 U.S.C. § 112. For example, the detailed description includes a description of the inventions defined by the claims and sufficient information that would enable a person having ordinary skill in the art to make and use the inventions. In the figures, like elements are generally indicated by like reference numerals regardless of the view or figure in which the elements appear. The figures are intended to assist with the description and to provide a visual representation of certain aspects of the subject matter described herein. The figures are not all necessarily drawn to scale, nor do they show all the structural details of the systems, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in any printed publication, dictionary, or issued patent.

The embodiments disclosed herein disclose novel approaches to extracting geothermal heat and/or minerals from deep beneath the Earth's surface. For example, in embodiments tensile-splitting or hydro-shearing the rock between an injector well and one or more producer wells may occur simultaneously in order to connect these wells to one another with flow conduits. In other embodiments involving an injector well and a plurality of producer wells, the flow conduits being created may be steered in specific directions towards specific wells. Additionally, in other embodiments an injector well and a producer well may have multiple conduits, and control over the flow of fluids through each conduit may be controlled independently of the other conduits. Plus, in embodiments tensile-splitting and hydro-shearing to establish flow conduits between an injector well and one or more producer wells may be accomplished in granites and other crystalline and volcanic rocks, metamorphic rocks, naturally and artificially cemented solid materials, and sedimentary rocks and shales. These are merely some of the unique aspects of the embodiments disclosed herein. Further, the embodiments disclosed herein substantially decrease the risk and cost of extracting heat and/or minerals from impermeable or low-permeability rock that needs to be tensile-split or hydro-sheared to enable extraction fluids to be circulated through it. In embodiments, this may be achieved by precisely controlling the geomechanical stress between injector and producer wells and thus enabling the reliable creation of flow conduits of known and predetermined dimensions between them.

Additionally, other embodiments disclosed herein disclose novel approaches to determining the orientation of shear-stress induced tensile-splitting or other types of tensile-splitting or of hydro-shearing to create conduits within the rock deep beneath the Earth's surface. For example, in embodiments tensile-splitting the rock from a vertical well to intersect a near-horizontal uncemented lateral is proposed. Methods to determine the intersection point along the lateral by the conduit created from the vertical well using temperature, gamma ray detection, velocity, acoustics, etc. are contemplated. Such temperature sensing methods include optical fibers deployed along the length of the lateral or traditional temperature, gamma ray, and other logging tools deployed by pumping down on wire and wire line retrieval. Tractors, coiled tubing, or other means of insertion and retrieval are also contemplated.

2. Certain Specific Embodiments

Now, certain specific embodiments are described, which are by no means an exclusive description of the inventions. Other specific embodiments, including those referenced in the drawings, are encompassed by this application and any patent that issues therefrom.

One or more specific embodiments disclosed herein includes a method of controlling tensile-split conduits in a subterranean geothermal formation, comprising the following steps: providing an injection well extending from a surface to a subterranean geothermal formation, wherein the injection well comprises a plurality of cemented casing sleeves, wherein each of the plurality of cemented casing sleeves is capable of being opened, closed, or choked; providing a production well extending from the surface to the subterranean geothermal formation, wherein the production well comprises an uncemented liner, wherein the uncemented liner comprises a slotted/predrilled liner; configuring the injection well for injection of a tensile-splitting fluid into a production zone, wherein the production zone is defined within the subterranean geothermal formation, and further wherein the production zone requires tensile-splitting to enhance fluid conductivity; configuring the production well to produce a heated fluid from the production zone; applying pressure to the production well at a pressure below the tensile-splitting initiation point, wherein the shear stress is increased in the maximum horizontal stress direction and a tensile-splitting conduit is encouraged to intersect the production well; creating a plurality of tensile-split conduits by injecting the tensile-splitting fluid into the production zone of the injection well, and further wherein each of the plurality of tensile-split conduits intersects the production well; raising or lowering the pressure in the production well in response to acquired real-time data during the tensile-splitting operation, wherein the raising or lowering of the pressure in the production well facilitates changing the height, width, and/or length parameters of the induced plurality of tensile-splitting conduits, and further wherein the pressure is raised in the production well by pumping a pressure fluid into the production well while simultaneously pumping the pressure fluid into the injection well, and further wherein the pressure is lowered in the production well by lowering the hydrostatic level by employing a pump, jetting, or flowing, and further wherein the real-time data comprises pressure, temperature, seismic information, or a combination thereof, wherein the real-time data is input into a computer equipped with artificial intelligence; establishing fluid communication between the injection well and the production well by imposing a hydraulic pressure above the hydro-shear pressure and below the tensile-splitting pressure on the plurality of tensile-split conduits, wherein the plurality of tensile-split conduits are maintained in an open condition, in order to extract heat by circulating a supercritical carbon dioxide between the injection well and the production well; and producing the heated fluid to the surface, wherein the heated fluid is employed as direct heat, for electricity generation, or for creating energy carrier fluids.

In any one of the methods or systems described herein, each of the plurality of tensile-split conduits may be created simultaneously.

In any one of the methods or systems described herein, fluid communication between the injection well and the production well may be improved by employing a mined or man-made proppant.

In any one of the methods or systems described herein, operations may be halted and pressures bled when the mined or man-made proppant is detected in the production well.

In any one of the methods or systems described herein, the production well may comprise a tubular string.

In any one of the methods or systems described herein, the method may further comprise circulating a circulating fluid, wherein the circulating fluid removes the mined or man-made proppant.

In any one of the methods or systems described herein, fluid communication between the injection well and the production well may be improved by employing an expandable electrophilic acid-gas-reactive fracturing and recovery fluid.

In any one of the methods or systems described herein, a mechanical device may be employed in the production well, wherein a rock near the production well is weakened in the direction of the injection well.

In any one of the methods or systems described herein, the step of establishing fluid communication between the production well and the injection well may employ a cooled fluid, wherein the cooled fluid causes the subterranean geological formation to fracture from the thermal shock effect.

In any one of the methods or systems described herein, the method may further comprise creating an energy storage reservoir by injecting an injection fluid to increase the pressure of the plurality of tensile-splitting conduits, wherein the depressurizing of the injection fluid provides energy to generate electricity or to distribute direct heat.

In any one of the methods or systems described herein, an artificial intelligence system may be utilized to optimize the well layout, stimulation, rate of heat extraction, heat exchanger selection and design, power generation equipment selection and design to economically optimize heat extraction from the reservoir.

In any one of the methods or systems described herein, perforations may be employed within the injection well as an alternative to the plurality of cemented casing sleeves.

One or more specific embodiments disclosed herein includes a method of determining the orientation of shear-stress induced tensile-split conduits, and conduits induced or reactivated by other means, in a subterranean geothermal formation, comprising the following steps: providing a vertical well extending from a surface to a subterranean geothermal formation, wherein the injection well comprises a cemented casing penetrating a geothermal formation; providing a production well extending from the surface to the subterranean geothermal formation, wherein the production well comprises an uncemented tubular (like drill pipe, tubing, or casing), configured to circulate fluid from the surface to the toe of the lateral and returned to surface, wherein the production zone is defined within the subterranean geothermal formation, and further wherein the production zone requires shear-stress induced tensile-splitting to enhance fluid conductivity, or conduits induced or activated by other means, perforating the vertical well casing at the same subsurface depth (below sea level) as the horizontal lateral (or by installing an openable frac sleeve at the depth), deploying a tubular system in the wellbore in which a temperature sensitive fiber can be installed into (or acoustic fiber or strain fiber or any combination of the three) the horizontal lateral from the surface to the toe of the well by pumping a reel containing the fiber at 1-2 barrels/minute (BPM), the fiber is connected to an optical process unit (like a DTS), creating a shear-stress induced tensile-split conduit using fluid pumped at high pressures through the perforations (or frac sleeve) in the vertical well and further wherein each of the shear-stress induced tensile-split conduits intersects the production well, evaluating the induced change in the fiber properties along the production well to determine the intersection point, calculating the distance of the conduit and calculating the orientation between the vertical well and the intersection point, continuing to pump tensile-splitting fluid in the injection well and producing the fluid in the production well at surface to determine the fracture properties.

In any one of the methods or systems described herein, the fiber may be substituted with conventional wireline-deployed real-time temperature, gamma ray, noise, collar locators, flow meters, etc. data-collection instruments that can be used after intersection of the conduit from the vertical well has been detected, and could be slowly retrieved from the toe of the horizontal wellbore to determine the intersection point.

In any one of the methods or system described herein, the fiber may be attached on the outside of the drill pipe or the inside of coiled tubing. To cool the tools, surface fluids can be circulated while running the drill pipe in the hole. Likewise, placement of the fiber can be installed in the horizontal well after the intersection connection between the vertical and horizontal wells has been detected. This will allow lower temperature rated tools to be used in reservoirs with higher temperatures than they are rated for.

In any one of the methods or systems described herein, the real-time downhole data collection instruments may be substituted for memory-battery-operated tools that can be used after the intersection of the conduit from the vertical well has been detected, and could be slowly retrieved from the toe of the horizontal wellbore to determine the intersection point.

In any one of the methods or systems described herein, the data recording instruments could be run singularly or in tandem with one another.

In any one of the methods or systems described herein, the long-term fluid communication and conductivity between the injection well and the production well may be improved by placing a mined or man-made proppant in the conduit.

In any one of the methods or systems described herein, the tensile-stress stimulation fluid temperature could be measured after intersection to gather additional data on the thermal heat recovery from the system.

In any one of the methods or systems described herein, an in-situ natural fracture conduit intersecting both the vertical wellbore and horizontal lateral, could be substituted for the shear-stress induced tensile-split conduit and the orientation and dimensions of the natural conduit could be determined using the same methods.

In any one of the methods or systems described herein, radioactive or non-radioactive materials could be inserted during the tensile-stress splitting process and recorded at the horizontal lateral using a gamma ray tool.

In any one of the methods or system described herein, the horizontal lateral may be drilled in a pattern like arc to improve the chance of the shear-stress induced tensile-split conduit intersecting the lateral.

In any one of the methods or systems described herein, artificial intelligence could be used from the data gathered to utilized to optimize the well layout, stimulation processes and parameters, rate of heat extraction, heat exchanger selection and design, power generation equipment selection and design to economically optimize heat extraction from the reservoir.

In any one of the methods or systems described herein, a casing sleeve containing a choke position could be substituted for perforations in the vertical well to evaluate the ability to regulate flow.

In any one of the methods or systems described herein, the lateral section of the horizontal well may be used to locate two or more shear-stress induced tensile-split conduits generated from two or more vertical wells.

In any one of the methods or systems described herein, a shear-stress induced tensile-split conduit may have originated from the lateral of a horizontal well.

3. Specific Embodiments in the Figures

The drawings presented herein are for illustrative purposes only and are not intended to limit the scope of the claims. Rather, the drawings are intended to help enable one having ordinary skill in the art to make and use the claimed inventions.

In the drawings and descriptions that follow, like parts are typically marked throughout the specification and drawings with the same reference numerals. The drawn figures are not necessarily to scale. Certain features of the embodiments may be presented exaggerated in scale or in somewhat schematic form, and some details of conventional elements may be excluded in the interest of clarity and conciseness. The present invention may be implemented in embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between these elements and may also include indirect interaction between these elements.

Unless otherwise specified, use of the terms "up," "upper," "upward," "uphole," "upstream," or other like terms shall be construed as generally toward the surface of the formation and of shallower depth below exposed earth. Likewise, use of the terms "down," "lower," "downward," "downhole," or other like terms shall be construed as generally toward the bottom, terminal end of a well, regardless of the well orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Unless otherwise specified, use of the terms "tensile-splitting," "hydro-shearing," "soft hydraulic simulation," "hydraulic fracturing," and "conduit creation" refer to cracking, splitting, opening, or reopening the rock and extending the created crack in three dimensions. Whereas "tensile-splitting" typically refers to the initial splitting of the rock and "hydro-shearing" typically refers to reopening and or extending existing fissures or fractures or splits in the rock.

Unless otherwise specified, use of the terms "conduit," "created conduits," "flow channel," and "crack" refer to the void in the rock between the rock's faces.

Unless otherwise specified, "the heel" is the start of the horizontal (or inclined) production/injection interval, and "the toe" is the far end of it.

Unless otherwise specified, the terms "producer," "producer well," "production well," and "production wellbore" are used synonymously in this patent. Further, unless otherwise specified, the terms "injector," "injector well," "injection well," and "injection wellbore" are used synonymously in this patent.

Unless otherwise specified, the term "casing" is a steel tubing of a particular diameter that is inserted into a well to, e.g., shore up the hole and/or to isolate a particular rock interval. The casing may be cemented to the rock and/or to a larger casing through which it has been inserted, or a void may be left between them. Unless otherwise specified, the term "liner" is a casing that does not extend back to the surface.

Tensile-splitting a deep hot impermeable formation to create new conduits between wells to flow fluids and capture heat is relatively new. The fracturing of shales and hydrocarbon reservoirs is fairly well understood, but with the emphasis of stimulating production in the well whilst avoiding frac hits with other wells at all costs.

However, for geothermal applications it is most desirable for flow channels to connect wells. To achieve the optimum flow connection between wells, the tensile-splitting parameters must be controlled in both the well where fluid is being injected and any other wells where there is a desire for the conduit to intersect and/or to establish fluid communication with. Further, to achieve the optimum flow connection between wells, the orientation of the tensile-splitting conduit is critical to the ability to connect in formations like granite. Likewise, it is desirable to understand the flow capacity of created conduits and the amount of heat they can extract from the reservoir.

It has long been understood what controls the parameters of height, width, and length in tensile-split and hydro-sheared channels and conduits. Part of the tool kit to change these parameters is the type of stimulation fluid and its characteristics such as its viscosity, density, flow rate and compressibility. Likewise, how pressure applied to rock affects and changes a rock's maximum and minimum stresses is well understood.

In EGS methods, the (near)-parallel horizontal wells may be from 50 feet apart to more than 1,000 feet apart, with the wider separation accessing a larger area from which to draw heat. However, depending on rock stress in granite type formations, "wing lengths" (i.e., the length of a conduit created from one well towards another) of greater than 350 feet may be difficult to reliably obtain using current technology, but the disclosure herein foresees no absolute upper limit to that distance.

The wells may be vertical or inclined rather than horizontal. The lengths of the production (or injection) intervals through which fluids flow to/from the rock range from 50 feet to more than 15,000 feet, with 3,000 feet to 5,000 feet commonplace.

Injectors and producers are typically nearly parallel, but it is not required to maintain an exact distance between them, and deviations of over 50 feet do not materially affect calculated performance. Furthermore, deviations from parallel are sometimes intended to help stabilize the flood front of water advancing through the many conduits from the injector(s) to the producer(s) as explained below.

Tensile-splitting and hydro-shearing conduits may have heights of many hundreds, or even thousands of feet, and this allows latitude in the well placements.

In the production/injection interval, casing diameters of 4½ inch to 9⅝ inch are typical, but larger sizes are possible. Selection of casing size is influenced by balancing the higher cost of larger sizes against the lower friction of the circulating fluid at the flowrate required to recover the desired thermal power. For example, in reservoirs at 350° F. it may be desirable to have 5½" or 7" casing sizes to reduce circulation friction when pumping 20 barrels per minute ("BPM"—a barrel is 42 U.S. gallons or 5.615 cubic feet) between wells 5,000 feet long and 350 feet apart containing 20 to 100 tensile-split conduits to recover enough heat to generate 5 $MW_e$ of net electrical power.

It is desirable to equalize the fluid flow injected into each tensile-split-enhanced and hydro-shear-enhanced conduit from the injector to create a stable flood front moving toward the producer(s). This reduces the bypassing of areas of hot rock. The challenge increases with the length of the injection interval and the number of conduits. At high circulation rates the pressure at the heel of the well will be materially higher than at the toe and will therefore force more fluid to enter the conduits near the heel than the toe. Sleeves, like those made by NCS Multistage, may be open, closed, or choked. These types of sleeves facilitate the initial creation of multiple conduits and then permit the conduits to be closed or choked to maintain a stable flood front. A supporting technique is to deviate the injector and producer(s) from parallel so that the "toes" of the two wells are nearer than the "heels". This helps control the stability of the flood front since the injection pressure decreases through flow friction from heel to toe and the production pressure reduces through flow friction from toe to heel.

Stimulation fluids may be recovered from the producer and reused, resulting in less use of chemicals and water.

Knowledge of how to effect rock stresses during stimulation operation in wells is discussed in U.S. Pat. No. 10,801,307, but those efforts have been focused on how to space conduits so they will not come in contact, and only with operations performed in one well at a time rather than simultaneously.

Computer-generated heat models may be used (e.g., TOUGH2, DARTS, Waiwera, GeoDT, ResFrac and Geophires) to calculate the optimum lateral lengths, distances apart, flow conduits, and circulation rates for a specific geologic temperature and thermal heat capacity of the formation.

The embodiments disclosed herein relate to developing conventional oil field fracturing and tensile-splitting methods further, thereby providing a method to optimize the placement of the tensile-split and hydro-sheared conduits to ensure contact and communication with another well and a conduit with sufficient permeability (permeability is a measure of the ability of fluids to flow through rocks and conduits) to circulate fluids without undue friction losses.

Knowing if and when the tensile-split-created conduits come into contact with the target well allows optimization of the stimulation treatment. Chemicals and proppants used in the treatment, as well as equipment hire, are expensive. Knowing when to stop the treatment is a major contributor to optimizing its cost-effectiveness.

Placement of the tensile-split conduit can be optimized by coupling the actions undertaken in the injector and in the producer, as well as leveraging the sensory information collected from the wells.

FIG. 1A depicts an exemplary operating environment where many different geothermal reservoir development methods are depicted including the Enhanced Geothermal System 100. FIG. 1A shows two different formations. One formation is sedimentary rock formation 105 formed of rock such as clay, sandstone, limestones, carbonates, etc. The other formation is igneous and metamorphic rock formation 110 formed of marble, basalt, granite, etc. The Earth's material is constantly exposed to erosion and weathering, and the resulting accumulated loose particles eventually settle and form sedimentary rock. Igneous rocks are formed when magma (or molten rocks) cool down and become solid. Metamorphic rocks are the result of the transformation of other rocks. Rocks that are subjected to intense heat and pressure change their original shape and form, and become metamorphic rocks.

Generally, a formation is a rock unit that is distinctive enough in appearance that a geologic mapper can tell it apart from the surrounding rock layers. Sedimentary rock formations typically have significantly higher permeability than igneous and metamorphic rocks. Permeability in igneous and metamorphic formations is generally through fractures. Depths of formations may range from a surface 115 increasing to a depth very much greater than 16,000 feet below the surface 115.

As shown in FIG. 1A, as formation depths increase, temperatures may also increase. For example, FIG. 1A shows a level 120, a level 125, and a level 130, wherein the temperatures are 300°, 400°, and 500° Fahrenheit, respectively. Also shown are horizontal wells 135, 140, 145, 150, and 155 and vertical wells 160, 165, 170, 175, 180, and 185. Conventional geothermal developments 190 are shown in sedimentary rock formation 105 and flow between the laterals of horizontal wells 140 and 145 is accomplished by pumping through permeable formations. Closed loop developments 195 are typically found in deeper, hotter igneous formations, and heat is extracted by circulating fluid in a single well, such as horizontal well 135. Home heating developments 200 are typically accomplished by circulating in a closed loop in very shallow sedimentary rocks. Carbon sequestration projects 205 typically involve storing gases like $CO_2$ in sedimentary rocks. Conventional geothermal projects 190 may also involve circulating fluids or flowing fluids from deep underground formations in shallow fractured or highly permeable formations. Enhanced geothermal systems 100 involve circulating fluids between long laterals of horizontal wells in hot igneous rocks. Circulation is accomplished by creating permeable conduits between the laterals of horizontal injector and producer wells in minimally fractured impermeable igneous rock formations.

Figure 1B:
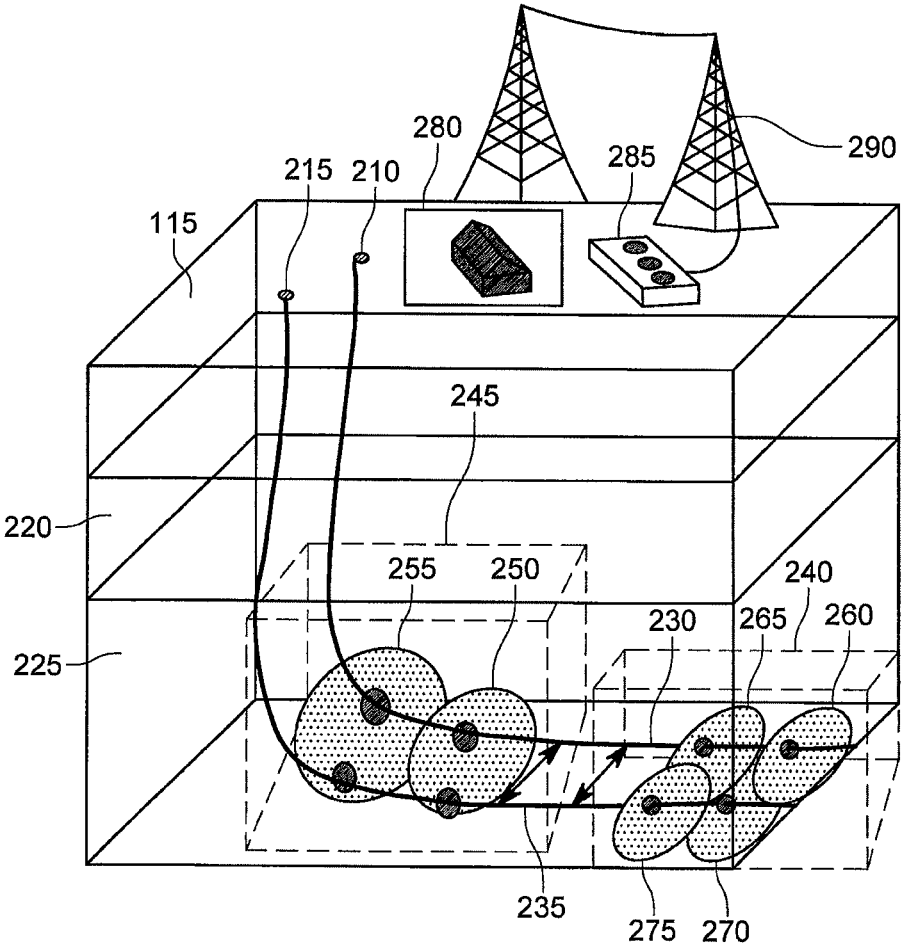
FIG. 1B is an illustration of an embodiment of an enhanced geothermal system.

FIG. 1B depicts an exemplary operating environment of an embodiment of the methods, systems, and apparatuses disclosed herein. Unless otherwise stated, the horizontal, vertical, or deviated nature of any figure is not to be construed as limiting the well to any particular configuration. As depicted, in embodiments the operating environment may suitably describe a well 210 and a well 215 that have been drilled by a conventional drilling rig or other means. In embodiments, wells 210 and 215 may emanate from the surface 115 and intersect a geologic sedimentary formation like sandstone formation 220 before passing through a geothermal formation like granite formation 225 (or a marble or basalt formation) forming a lateral 230 and a lateral 235, respectively. In embodiments, laterals 230 and 235 may be parallel, perpendicular, or obtuse to one another. In embodiments, laterals 230 and 235 may be vertical, deviated, horizontal, curved, or porpoise up and down in a specified window. In embodiments, a typical window may be 50 feet up and 50 feet sideways but may be smaller or greater as required to meet heat production requirements and drilling parameters. In embodiments, laterals 230 and 235 may be separated by 350 feet as depicted by the two solid arrows in FIG. 1B. However, in embodiments separation distances potentially much greater than 350 feet or less than 350 feet may be performed. In embodiments, a window may also be used to set acceptable separation distance between laterals 230 and 235. For example, the window may be 350 feet plus or minus 20 feet. In embodiments, other distances may be used depending on heat modeling to determine the optimum distance for a project life.

In embodiments, the graphical representations are presented to explain the enhanced geothermal, potential well configurations, and completion methods. In embodiments, well 210 may comprise a producer well, and well 215 may comprise an injector well. In other embodiments, well 210 may comprise an injector well, and well 215 may comprise a producer well. In embodiments, wells 210 and 215 may have parallel horizontal laterals 230 and 235, respectfully.

In other embodiments, such wells may have non-parallel horizontal laterals. In the embodiment of FIG. 1B, well 210 is an injector well, and well 215 is a producer well. In embodiments, in between wells 210 and 215 is shown heat reservoirs 240 and 245, which are part of the granite formation 225. Generally, heat reservoirs are a subset of a main reservoir. In embodiments, induced tensile-split conduits, discussed below, are shown emanating from one or both of wells 210 and 215, creating an altered zone in between wells 210 and 215 and on each side of the laterals 230 and 235.

In embodiments, heat reservoir 245 may convey the DCM completion process. In embodiments, well 210 may be intended to be an injector well and have tensile-split conduits 250 and 255 emanating at lateral 230 and growing to intersect lateral 235, which may be intended to be a producer well. In FIG. 1B, only two tensile-split conduits 250 and 255 are illustrated, but in embodiments several hundred tensile-split conduits may be employed. In embodiments, the distance between the emanation points of tensile-split conducts 250 and 255 may be 350 feet, but greater or lesser distances may exist depending on information from the heat modeling and rock stress affected area. In the embodiment shown in FIG. 1B, well 210 may be cased and cemented at least across granite formation 225. In embodiments, emanation points may be from holes or created holes in shear sleeves like those described by SPE paper 210210-MS entitled "Development of Multi-Stage Fracturing System and Wellbore Tractor to Enable Zonal Isolation During Stimulation and EGS Operations in Horizontal Wellbores." In other embodiments, conventional explosive or jetted perforations may be employed. In alternative embodiments, a single tensile-split conduit may be created emanating from lateral 230 and additional tensile-split conduit may also be created emanating from lateral 235. In embodiments, conventional limited entry (LE) perforating and treatment methods like those described by K. W. Lagrone in his 1960 paper entitled "Better Completion by Controlled Fracture Placement Limited-Entry Technique" may be employed wherein two or more tensile-split or hydro-shear conduits may be created simultaneously.

In another alternative embodiment, heat reservoir 240, noted in the cross-hatched lines, describes the FEN completion process. In embodiments, well 210 may comprise an injector well and comprise tensile-split conduits 260 and 265 emanating from lateral 230. In embodiments, tensile-split conduits 260 and 265 may or may not intersect lateral 235. In embodiments, well 215 may comprise a producer well and also be either open hole (bare foot) or be cased and cemented and have tensile-split conduits 270 and 275 emanating from lateral 235. Similarly, in embodiments, open hole methods using packers and sleeves may be employed. In embodiments, the tensile-split conduits 270 and 275 may or may not intersect lateral 230. In embodiments, hydro-shearing of in-situ micro cracks in the rock comprising granite formation 225 may also enable communication between the tensile-split conduits 270 and 260, as well as between the conduits 275 and 265.

In embodiments, in either the DCM (depicted in heat reservoir 240) or FEN (depicted in heat reservoir 245) process completion described above, a pumping facility 280 and a generator facility 285 would not be limited to only two wells 210 and 215. In embodiments, a plurality of wells may be employed, wherein the plurality of wells may be horizontal, vertical, deviated or a combination thereof. While the operating environment depicted in FIG. 1B refers to wells 210 and 215 penetrating the Earth's surface on dry land, it should be understood that one or more of the methods, systems, and apparatuses illustrated herein may alternatively be employed in other operating environments, such as within offshore wells where at least a portion of one or both wells is beneath a body of water. In embodiments, FIG. 1B may refer to wells 210 and 215, wherein each well 210 and 215 comprises sections in granite formation 225. In embodiments, granite formation 225 may comprise heat reservoirs 240 and 245 denoting completion methods conventional and DCM, respectively. In embodiments, the following may be found on the surface: a pumping facility 280, a generator facility 285, and electrical transmission lines 290. In embodiments, cool fluid may be injected down well 210 across granite formation 225 picking up heat before returning to the pumping facility 280 through well 215. In embodiments, heat may be extracted from the fluid circulated between wells 210 and 215 in the generator facility 285, and electricity may be sent to the electrical grid through transmission lines 290. In embodiments, heat may be extracted from the fluid circulated between wells 210 and 215 with no generator facility 285 but instead a heat exchanger giving up heat to another fluid supplying direct heat or steam to another party.

Figure 2A:
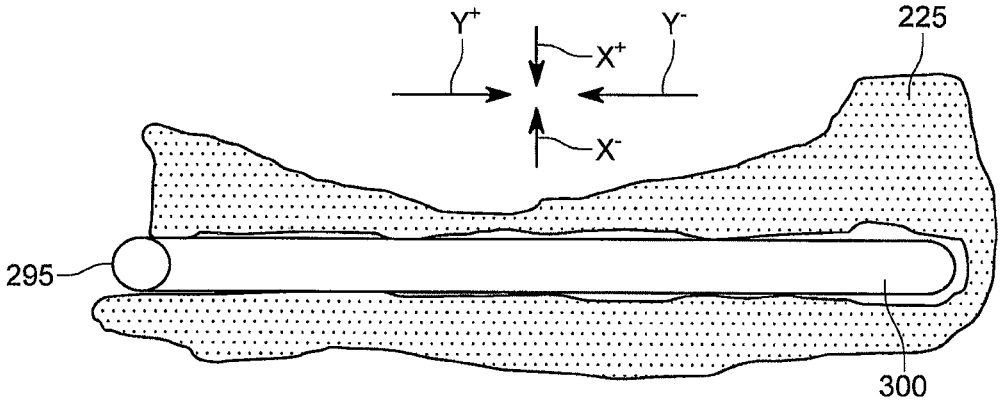
FIG. 2A illustrates an embodiment of an enhanced geothermal system wherein a horizontal plane extends through a subterranean formation as well as horizontally-acting forces along an x-axis and along a y-axis.
Figure 2B:
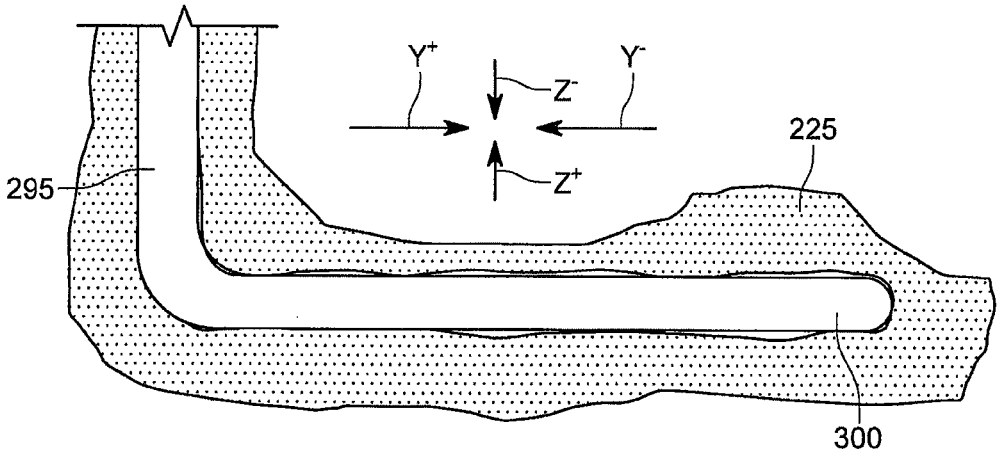
FIG. 2B illustrates an embodiment of an enhanced geothermal system wherein a vertical plane extends through a subterranean formation as well as horizontally-acting forces along the y-axis and vertically-acting forces along the z-axis.

Stresses of varying magnitudes and orientations may be present within a geothermal-heat-containing subterranean formation. Although the stresses present may be complex and numerous, they may be effectively simplified to three principal stresses. FIGS. 2A and 2B illustrate the various forces acting at a given point within a subterranean formation. FIG. 2A illustrates a horizontal plane extending through the subterranean granite formation 225 (i.e., a top view as if looking down a well) and horizontally acting forces along an x-axis and along a y-axis. In FIG. 2A, vertically acting forces along a z-axis would extend in a direction perpendicular to this plane. Similarly, FIG. 2B illustrates a vertical plane extending through the subterranean granite formation 225 (i.e., a side view of a well) and horizontally acting forces along the y-axis and vertically-acting forces along the z-axis. In FIG. 2B, horizontally acting forces along an x-axis would extend in a direction perpendicular to this plane.

As shown in FIGS. 2A and 2B, the forces may be simplified to two horizontally acting forces (i.e., the x-axis and the y-axis) and one vertically-acting force (i.e., the z-axis).

FIGS. 2A and 2B describe the standard force directions a well may be exposed to in the subterranean granite formation 225. FIG. 2A depicts a vertical section 295 from the top view, which also shows a horizontal lateral 300 in the x/y plane. FIG. 2B shows vertical section 295 down the x-axis or side view depicting the orientation of the y/z plane.

In embodiments, it may be assumed that the stress acting along the z-axis is approximately equal to the weight of the formation above (e.g., toward the surface) a given location in the subterranean granite formation 225. With respect to the stresses acting along the horizontal axes, cumulatively referred to as the horizontal stress field, for example in FIG. 2A the x-axis and the y-axis, one of these principal stresses may naturally be of a greater magnitude than the other. As used herein, the "maximum horizontal stress" or $\sigma_{Hmax}$ refers to the orientation of the principal horizontal stress having the greatest magnitude, and the "minimum horizontal stress" or $\sigma_{Hmin}$ refers to the orientation of the principal horizontal stress having the least magnitude. As will be appreciated by one of skill in the art, a $\sigma_{Hmax}$ may be perpendicular to the $\sigma_{Hmin}$. Unless otherwise specified, as used herein "stress anisotropy" refers to the difference in magnitude between the $\sigma_{Hmax}$ and $\sigma_{Hmin}$.

Figure 3:
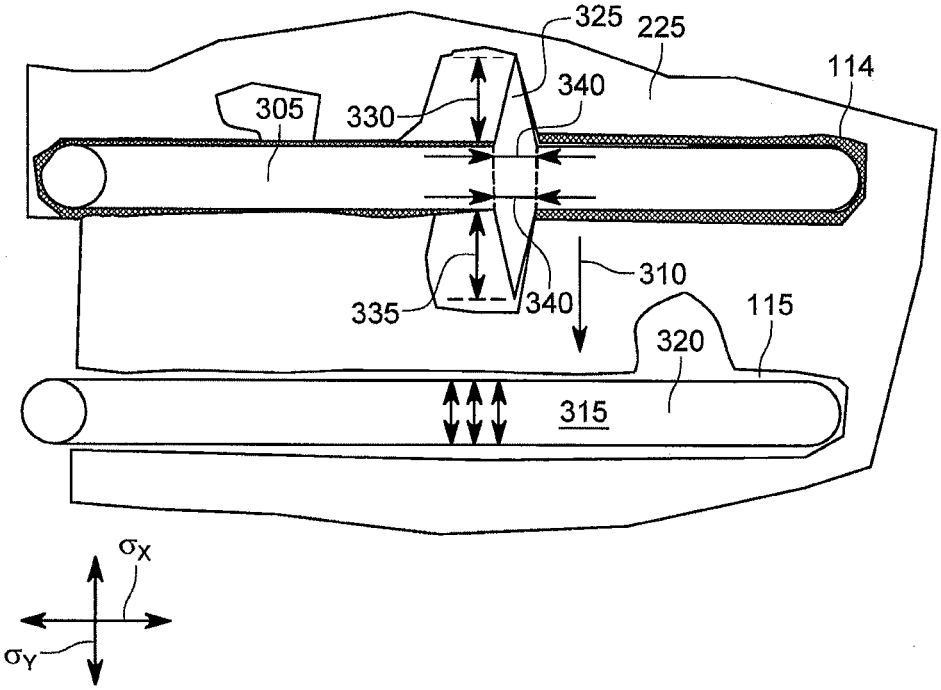
FIG. 3 illustrates an embodiment of a method suitably employed to improve the ability to intersect another geothermal well by altering stress anisotropy of a subterranean formation.

FIG. 3 illustrates graphically an embodiment of a method suitably employed to improve the ability to intersect another geothermal well by altering stress anisotropy of a subterranean formation. In embodiments, during the tensile-splitting or hydro-shearing operation in a cased and cemented wellbore lateral 305 shown by a fracture direction 310, hydraulic pressure is applied (shown by the arrows 315) in an open hole or uncemented wellbore 320 to encourage a degree of change in the stress anisotropy to tensile-split the formation 225 to create an approximately circular flow conduit 325 emanating from lateral 305 to intersect uncemented wellbore 320 in a predictable way. In embodiments, conduit wings 330 and 335 represent in planar view the half circles of the flow conduit 325 either side of lateral 305. These half circle conduits are sometimes referred to "conduit wings" or "wings". In embodiments, flow conduit 325 in the x/y plane comprises a conduit aperture width 340 ("aperture") and the lengths of its conduit wings 330 and 335. In embodiments, although the length and shape of conduit wings 330 and 335 may be shown to be identical, they may be very similar or of totally different lengths and widths dependent on near-well formation stresses. In embodiments, together conduit wings 330 and 335 may be referred to singularly as the conduit 325. Likewise, in embodiments aperture 340 may not be constant but may vary along the conduit wings 330 and 335 and along a height 345 (not shown).

Figure 4A:
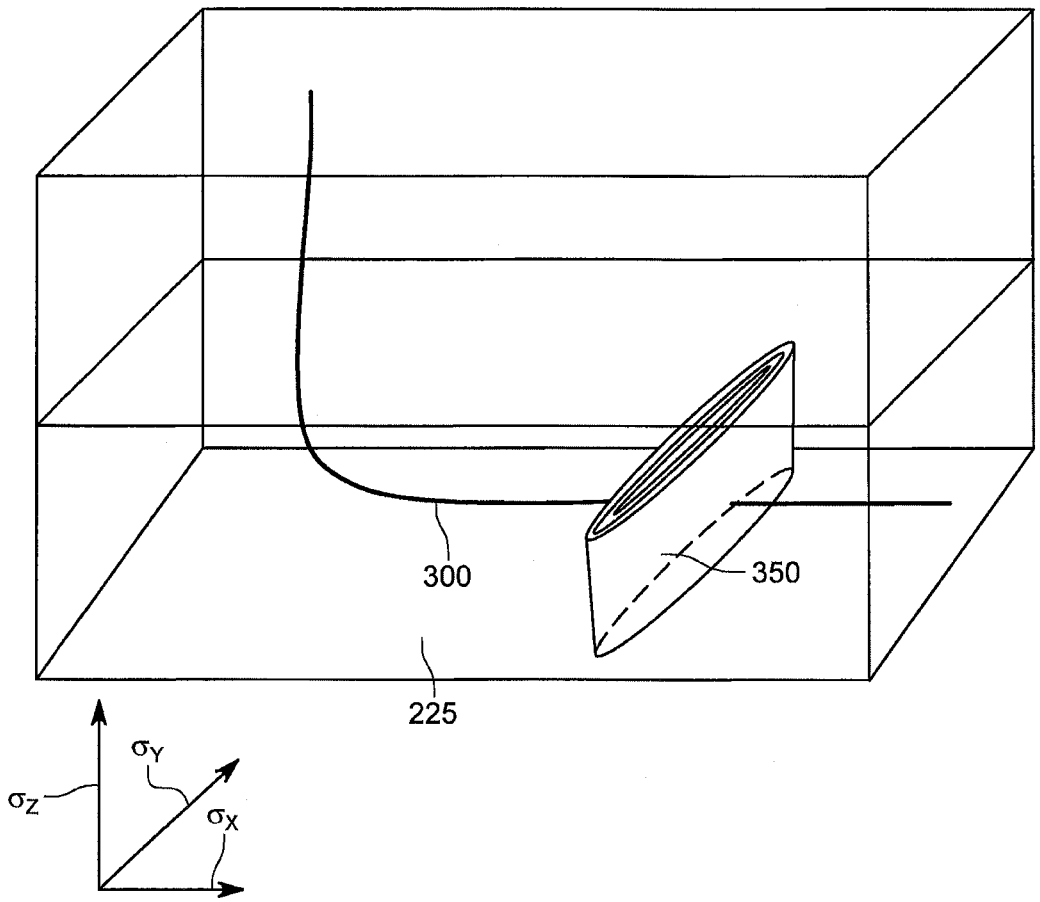
FIG. 4A illustrates an embodiment of an enhanced geothermal system wherein a horizontal plane extends through a subterranean formation.
Figure 4B:
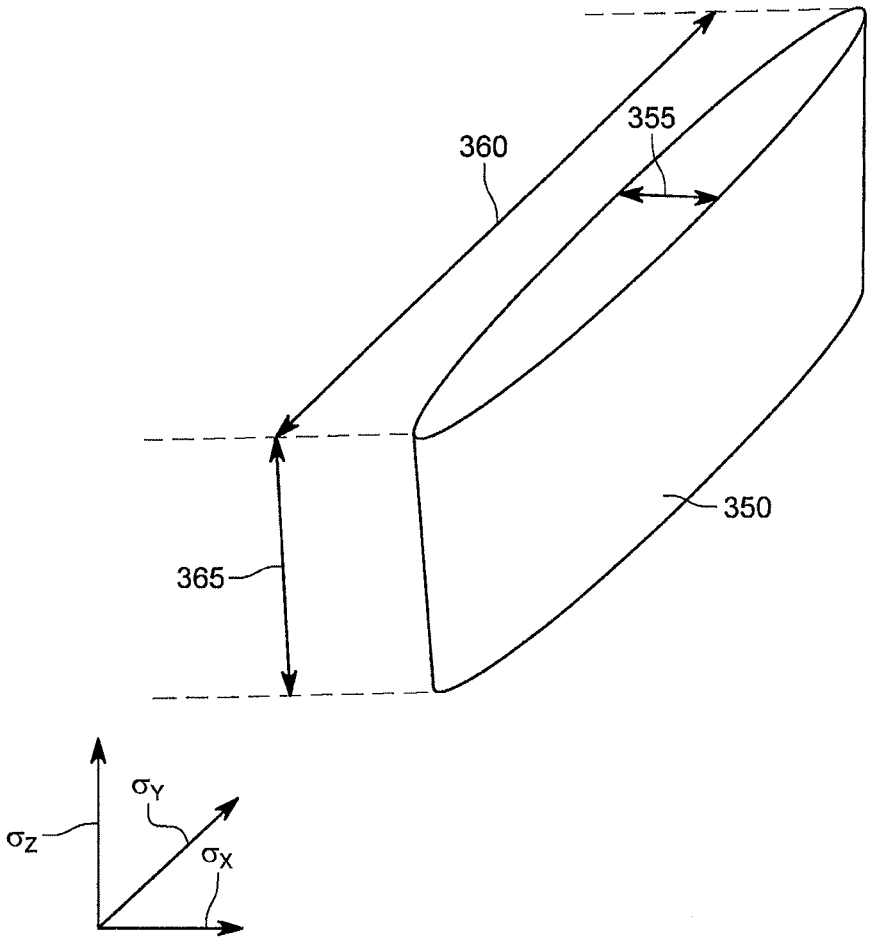
FIG. 4B illustrates an embodiment wherein a conduit may tend to form such that the conduit width may be approximately parallel to the $\sigma Hmin$ and the conduit length may be approximately parallel to the $\sigma Hmax$.

Referring to FIG. 4A, a horizontal plane extending through the subterranean granite formation 225 is illustrated. In embodiments, lateral 300 may extend through the subterranean granite formation 225. In embodiments, lines $\sigma_x$ and $\sigma_y$ represent the net major and minor principal horizontal stresses present within the subterranean granite formation 225. In embodiments, a tensile-split conduit 350 is shown forming in the subterranean granite formation 225. In the embodiment of FIG. 4A, $\sigma_x$ represents the $\sigma_{Hmin}$, and $\sigma_y$ represents the $\sigma_{Hmax}$ (note that the length of lines $\sigma_y$ and $\sigma_x$ corresponds to the magnitude of the stress along these axes; the length of line Øy is greater than the length of line ox, indicating that the magnitude of the stress is greater along the line $\sigma_y$). As illustrated in FIG. 4A, because less resistance is applied against the subterranean granite formation 225 along line $\sigma_x$ (e.g., the $\sigma_{Hmin}$), the tensile-split conduit 350 may form such that the subterranean granite formation 225 is forced apart in a direction perpendicular to line ox. In an expanded view depicted in FIG. 4B, the tensile-split conduit 350 may tend to form such that the conduit aperture width 355 (i.e., the distance between the faces of the tensile-split conduit 350) may be approximately parallel to the $\sigma_{Hmin}$; and a conduit length 360 may be approximately parallel to the $\sigma_{Hmax}$. In embodiments, a conduit height 365 may increase as the conduit propagates along the z-axis.

Figure 5A:
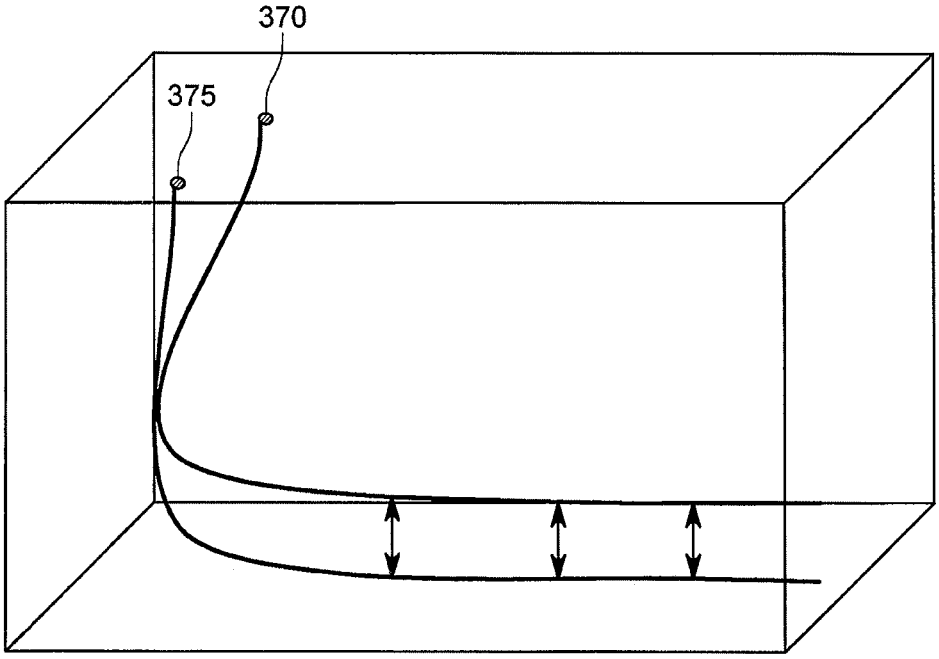
FIG. 5A illustrates an embodiment comprising a first well and a second well, wherein both wells are shown in a horizontal lateral layout with the first well above the second well.
Figure 5B:
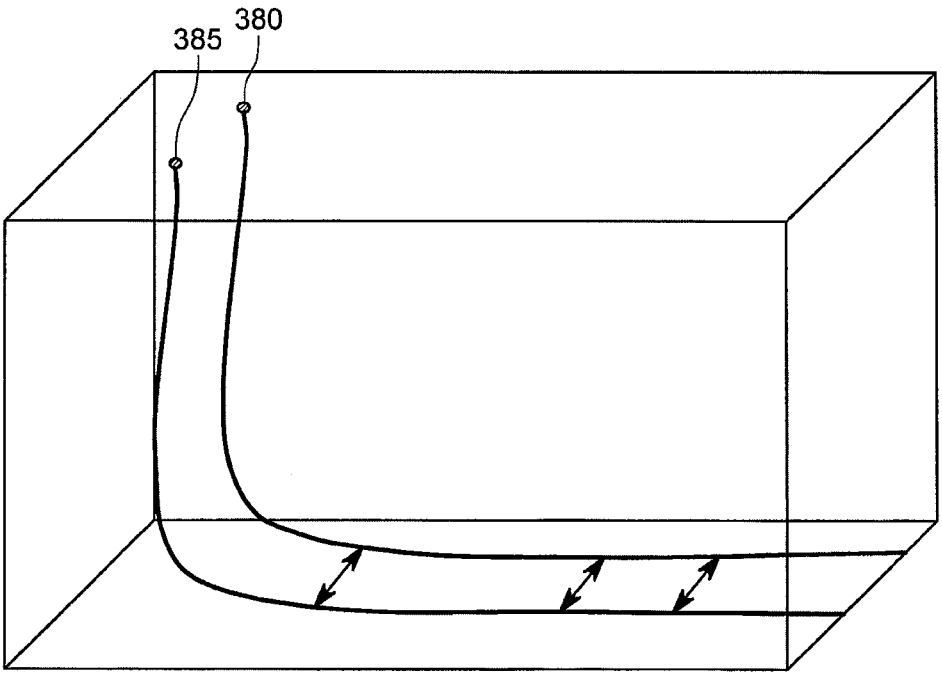
FIG. 5B illustrates an embodiment comprising a first well and a second well, wherein both wells are shown in a horizontal lateral layout with the wells parallel to each other.
Figure 5C:
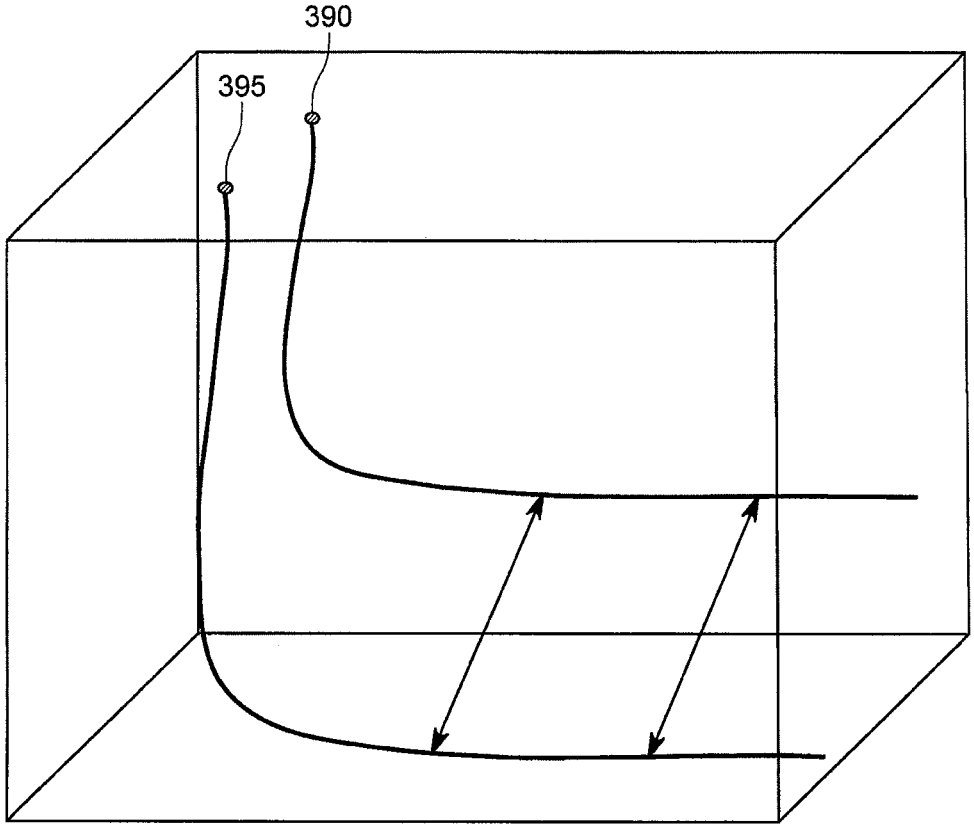
FIG. 5C illustrates an embodiment comprising a first well and a second well, wherein the wells are shown in a horizontal lateral layout with the first well obtuse to the second well.

In embodiments, wells used to extract heat from subterranean formations may be vertical, deviated, horizontal, or a combination of these. FIG. 5A illustrates an embodiment comprising a well 370 and a well 375, wherein wells 370 and 375 are shown in a horizontal lateral layout with well 370 above well 375. FIG. 5B illustrates an embodiment comprising a well 380 and a well 385, wherein wells 380 and 385 are shown in a horizontal lateral layout with wells 380 and 385 parallel to each other. FIG. 5C illustrates an embodiment comprising a well 390 and a well 395, wherein wells 390 and 395 are shown in a horizontal lateral layout with wells 390 and 395 obtuse to each other. Thus, FIGS. 5A, 5B, and 5C illustrate three different possible horizontal lateral layouts: above, parallel, and obtuse, respectively. In embodiments, wells may be used in one of these three fashions, a combination of them, or any other layout where there are two opposing wells in a subterranean formation, whether parallel in any axis or none.

Figure 6A:
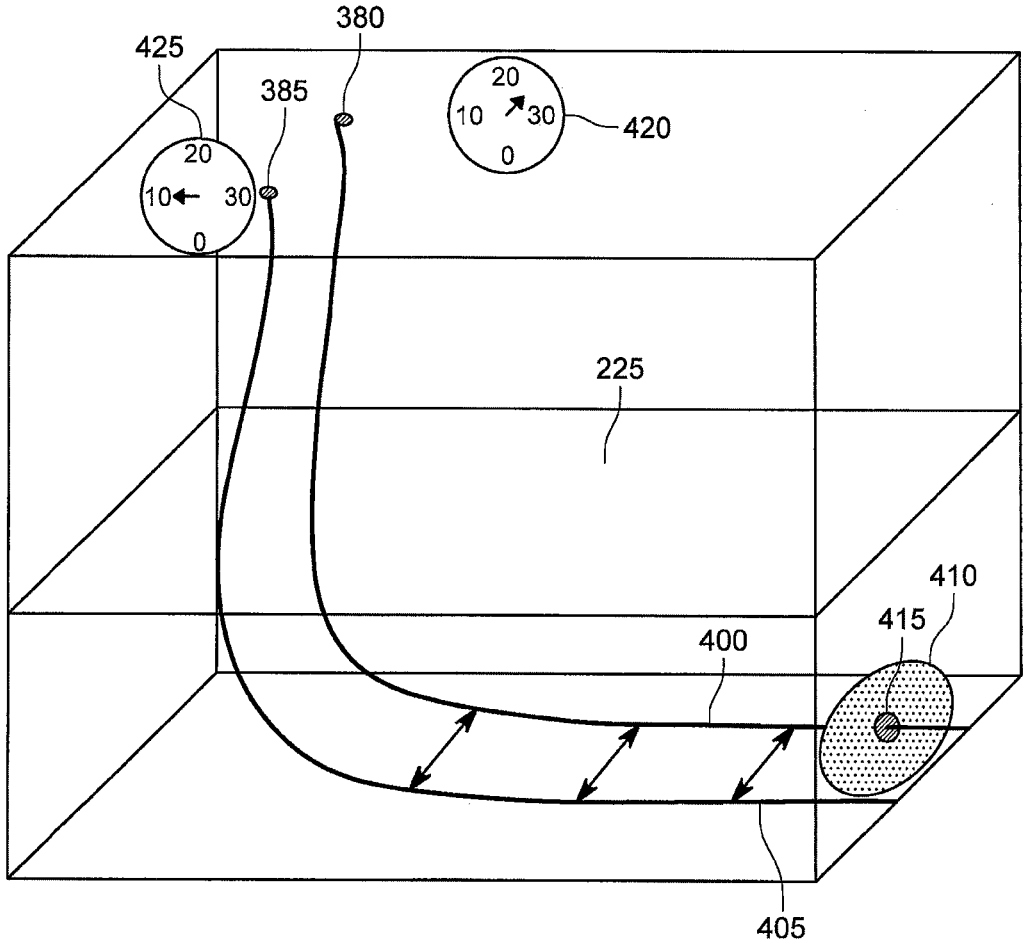
FIG. 6A illustrates two wells in a subterranean formation.
Figure 6B:
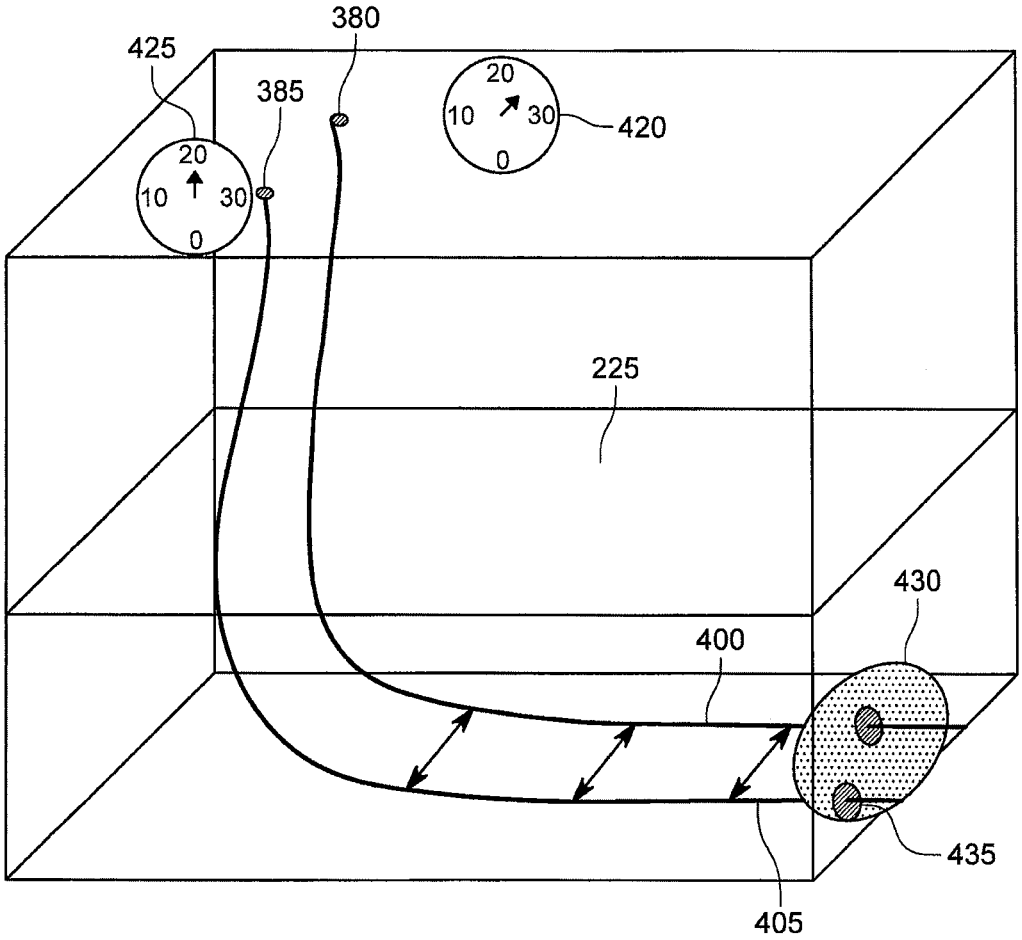
FIG. 6B illustrates a pressure response in a second well, as shown on a pressure gauge, when a tensile-split conduit intersects the second well at a specific point.

FIGS. 6A and 6B show graphical representations of the DCM. FIG. 6A depicts wells 380 and 385 in subterranean granite formation 225. In embodiments, well 380 may be an injector well comprising a lateral 400, which is cased and cemented. In embodiments, well 385 may be a producer well comprising a lateral 405 in the heat reservoir of granite formation 225, which may comprise an uncemented liner, open hole, or barefoot. In embodiments, a tensile-split conduit 410 may be initiated from lateral 400 at a point 415. In embodiments, to encourage the tensile-split conduit 410 to expand towards lateral 405, hydraulic pressure may be applied to stress the granite formation 225 in well 385. In embodiments, the tensile-split conduit initiation hydraulic pressure may be seen on a pressure gauge 420, which may represent hydraulic pressure. Hydraulic pressure may be defined as "continuous physical force exerted on or against an object by something in contact with it." Pressure for this purpose may be created hydraulically by compressing fluids like water or supercritical $CO_2$ for well 380. In embodiments, the applied pressure may be seen on a pressure gauge 425, which may represent hydraulic pressure for well 385. In embodiments, the hydraulic pressure of well 385 may be slightly below a crack initiation point, i.e., the pressure value that is the maximum pressure before a new tensile-split initiation point (for example 7,000 psi). In embodiments, lower pressures may be applied, but the use of lower pressures (for example 5,000 psi) may result in less stress on the granite formation 225. Further, in embodiments if the granite formation 225 had previous contact with other conduits, it may be appropriate to pressure the granite formation 225 to a pressure lower than that required to reopen a conduit (the hydro-shear pressure). FIG. 6B shows the pressure response in well 385, as shown on pressure gauge 425, when a tensile-split conduit 430 intersects well 385 at point 435 (having moved from 10 to 20 on pressure gauge 425).

Figure 7A:
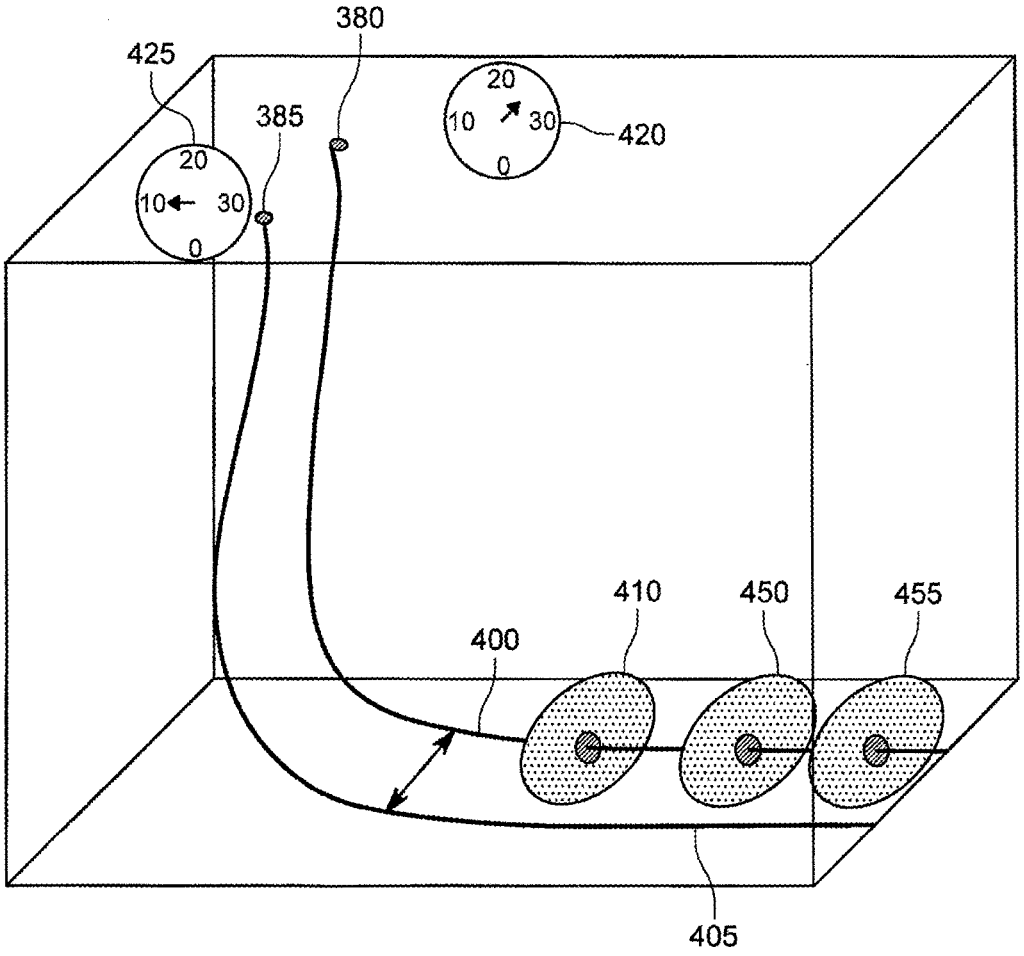
FIG. 7A illustrates an alternative embodiment to that shown in FIG. 6A wherein instead of one single tensile-split conduit, multiple tensile-split conduits are present.
Figure 7B:
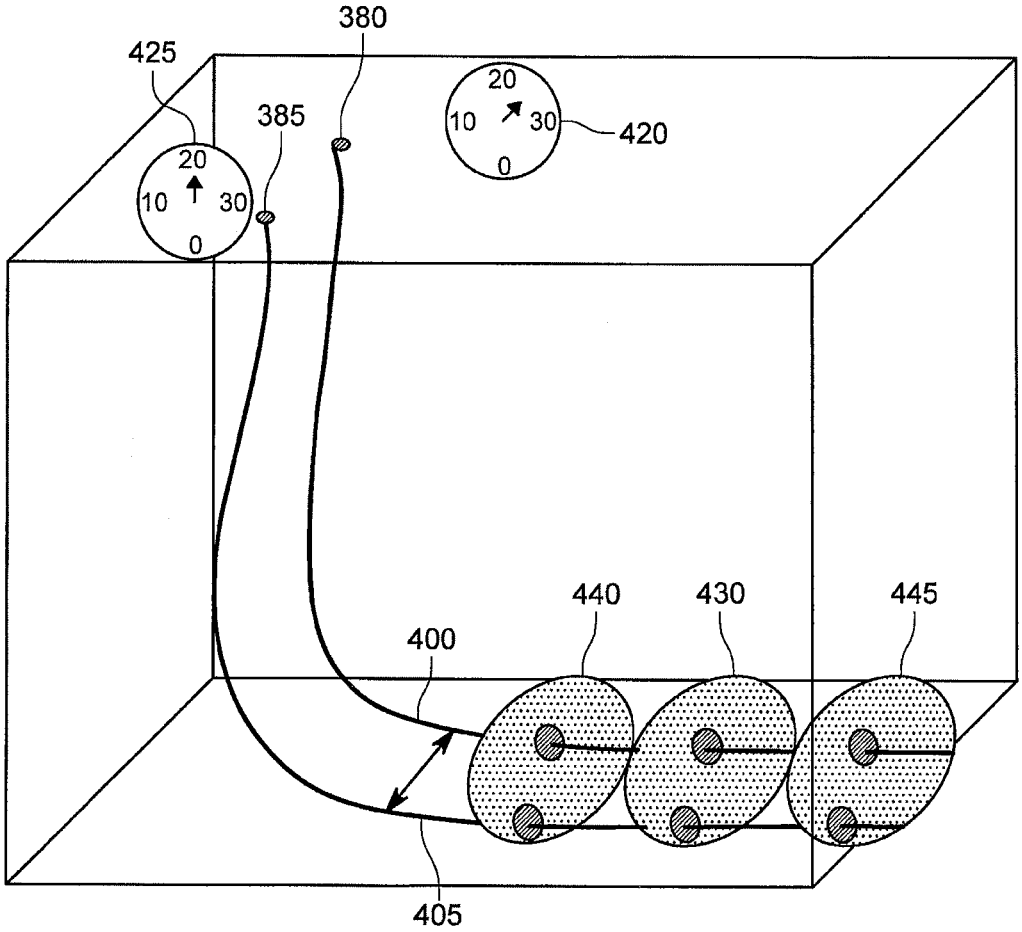
FIG. 7B illustrates an alternative embodiment to that shown in FIG. 6B wherein instead of one single tensile-split conduit, multiple tensile-split conduits are present.

FIGS. 7A and 7B are graphical representations of the embodiments shown in FIGS. 6A and 6B except instead of one single tensile-split conduit 430 as shown in FIG. 6B, the embodiment shown in FIG. 7B shows multiple tensile-split conduits. More specifically, FIG. 7B shows tensile-split conduits 440, 430, and 445. As was discussed previously, the plug and perf completion method creates multiple tensile-split conduits simultaneously. In embodiments, pressure may be applied in well 385 up to slightly below the initiation pressure of the tensile-split conduits 410, 450, and 455 from lateral 400 and before the conduits 410, 450, and 455 intersect the lateral 405 in well 385. In embodiments, the number of conduits to be put into communication between laterals 400 and 405 is not limited to three as illustrated in FIGS. 7A and 7B. Instead, the number of conduits may be determined by the "limited entry calculation" noted earlier by K. W. Lagrone in his 1960 SPE paper entitled "Better Completion by Controlled Fracture Placement Limited-Entry Technique," such that applying pressure to increase the stress in lateral 405 may be appropriate irrespective of how many conduits from lateral 400 were desired to come in contact with lateral 405. In embodiments, once one of the conduits 410, 450, or 455 comes in contact with lateral 405 (e.g., conduit 445), it may be appropriate to raise the pressure of lateral 405 to assist the opening of other tensile-split conduits from lateral 400 to come in communication with lateral 405 (e.g., conduits 440 and 430). Likewise, it may be desirable in embodiments to lower the pressure in lateral 405 from, for example, 7,000 psi to 4,000 psi by flowing the lateral 405 to encourage the tensile-split conduits 410, 450, and 455 to grow in the opposite direction, away from lateral 405.

Figure 8A:
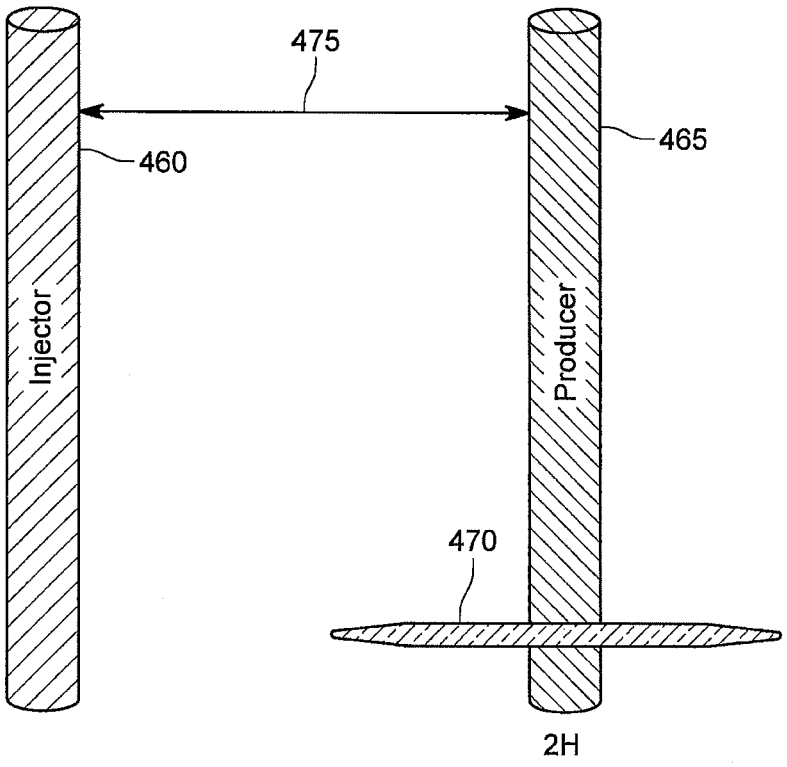
FIG. 8A illustrates a planar view of an embodiment comprising a first horizontal wellbore, which may be an injector, and a second horizontal wellbore, which may be a producer.
Figure 8B:
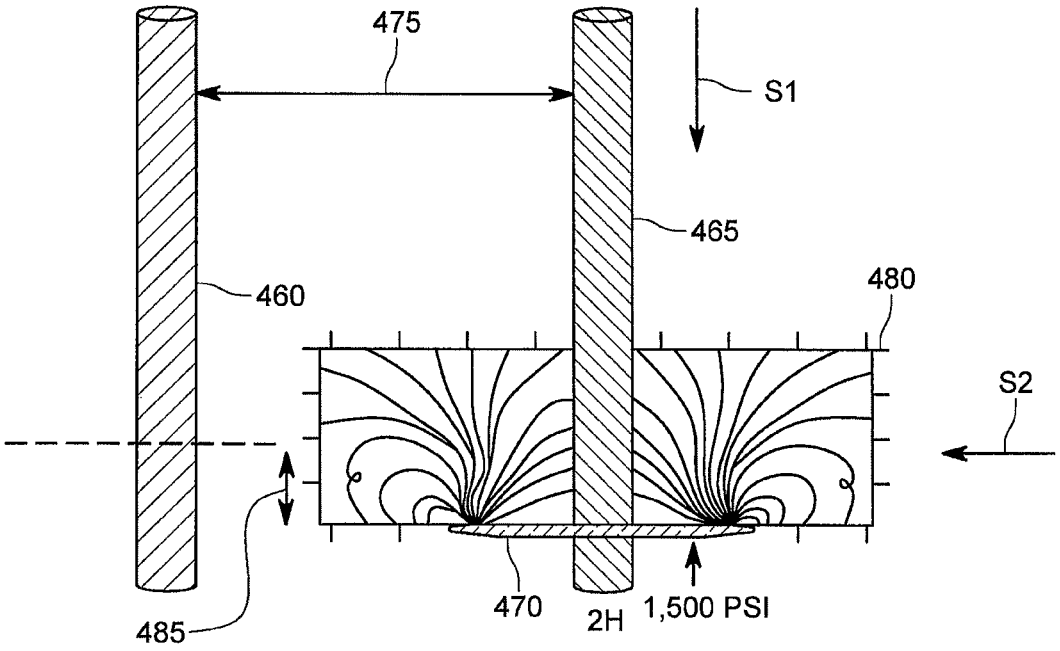
FIG. 8B illustrates an embodiment with a stress region, wherein there are isobaric lines, which decrease with distance from a newly created conduit.
Figure 8C:
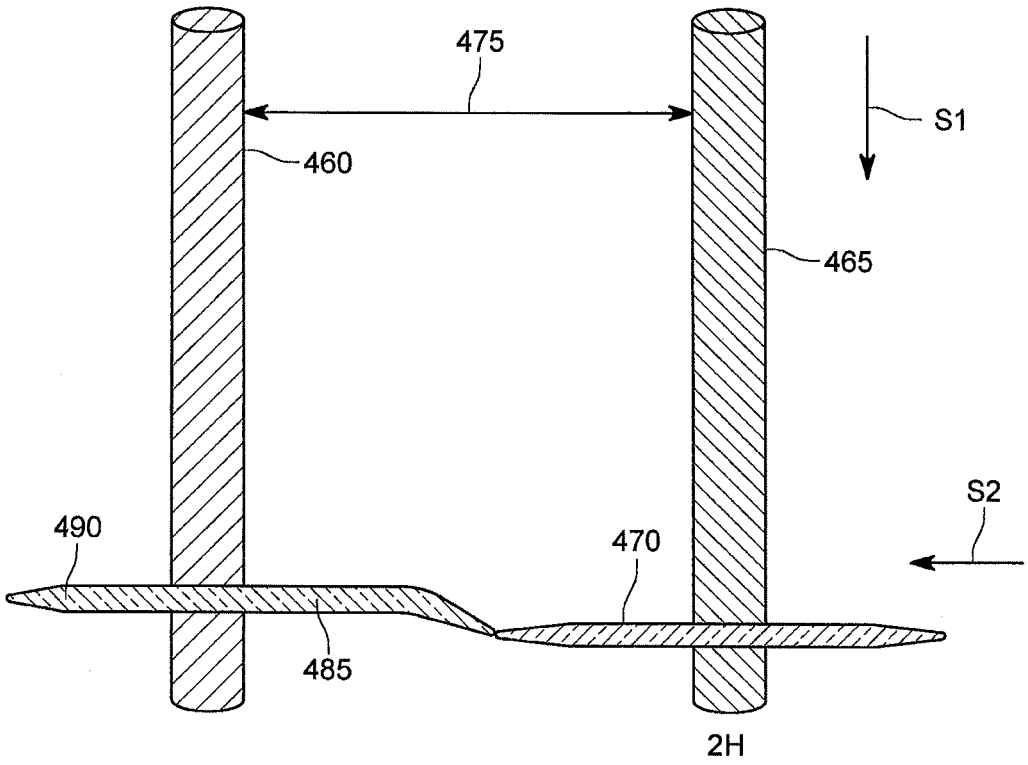
FIG. 8C illustrates an embodiment with a newly created conduit emanating from a wellbore.

FIGS. 8A, 8B, and 8C disclose an embodiment of a method ensuring that factures emanating from two separate parallel horizontal laterals will intersect and form a conduit whereby fluid may be passed between them. FIG. 8A shows a planar view of an embodiment comprising a horizontal lateral 460, which may be an injector, and a horizontal lateral 465, which may be a producer. It should be noted that this method would work even if lateral 460 were designated as the producer and lateral 465 were designated as the injector. In embodiments, a new conduit 470 may be created in the untreated, non-prestressed area between laterals 460 and 465. In embodiments, laterals 460 and 465 may be about 350 feet apart as noted by distance 475 (or very much more or less). FIG. 8B shows an embodiment with a stress region 480, wherein FIG. 8B shows isobaric lines starting at 1,500 psi, which decrease with distance from the newly created conduit 470. FIG. 8B also shows a distance 485, as noted by the arrow, which is the distance from the center of the aperture width of the newly created conduit 470 and a certain displacement along lateral 460. In embodiments, this distance 485 may be the maximum distance conduit 470 may spread from lateral 460 and still intersect conduit 470. FIG. 8C depicts an embodiment with a newly created conduit 490 emanating from lateral 460 at a level at distance 485 from the center of the aperture width of conduit 470. FIG. 8C depicts conduit 490 curving to intersect conduit 470 emanating from lateral 465.

Figure 9A:
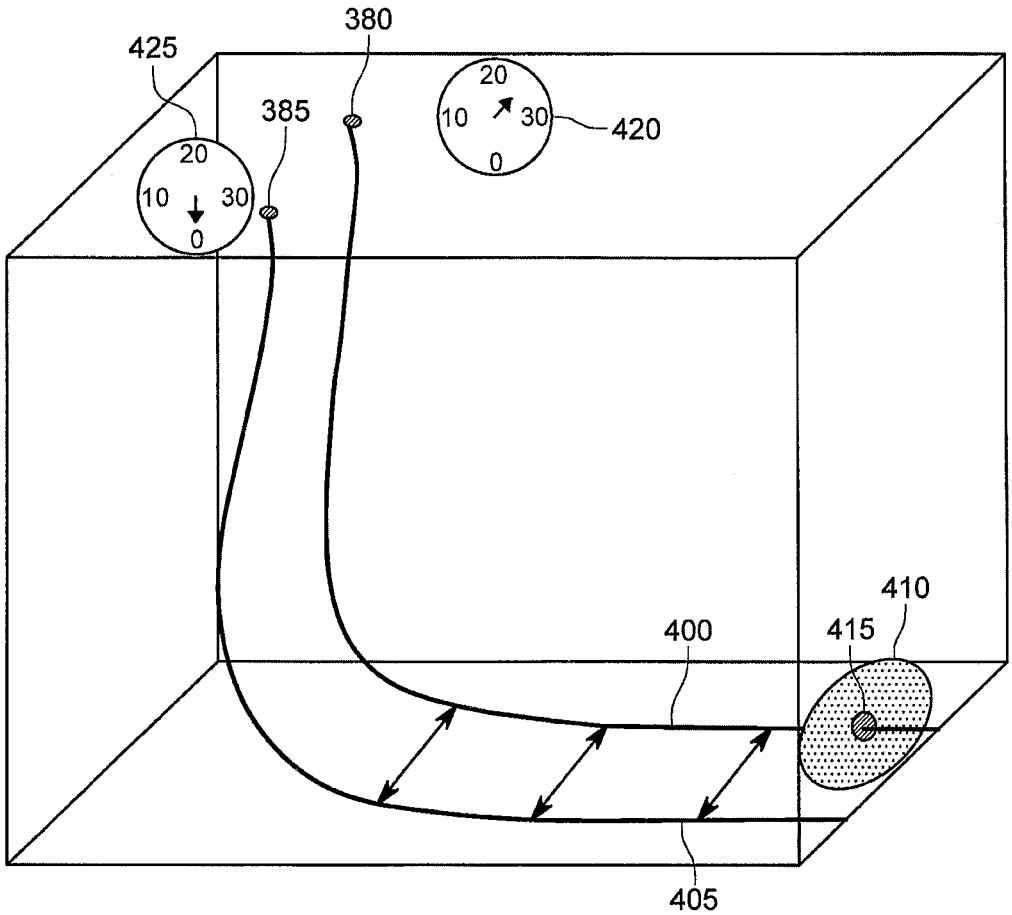
FIG. 9A illustrates an embodiment wherein a well may initiate a tensile-split conduit in an associated lateral.
Figure 9B:
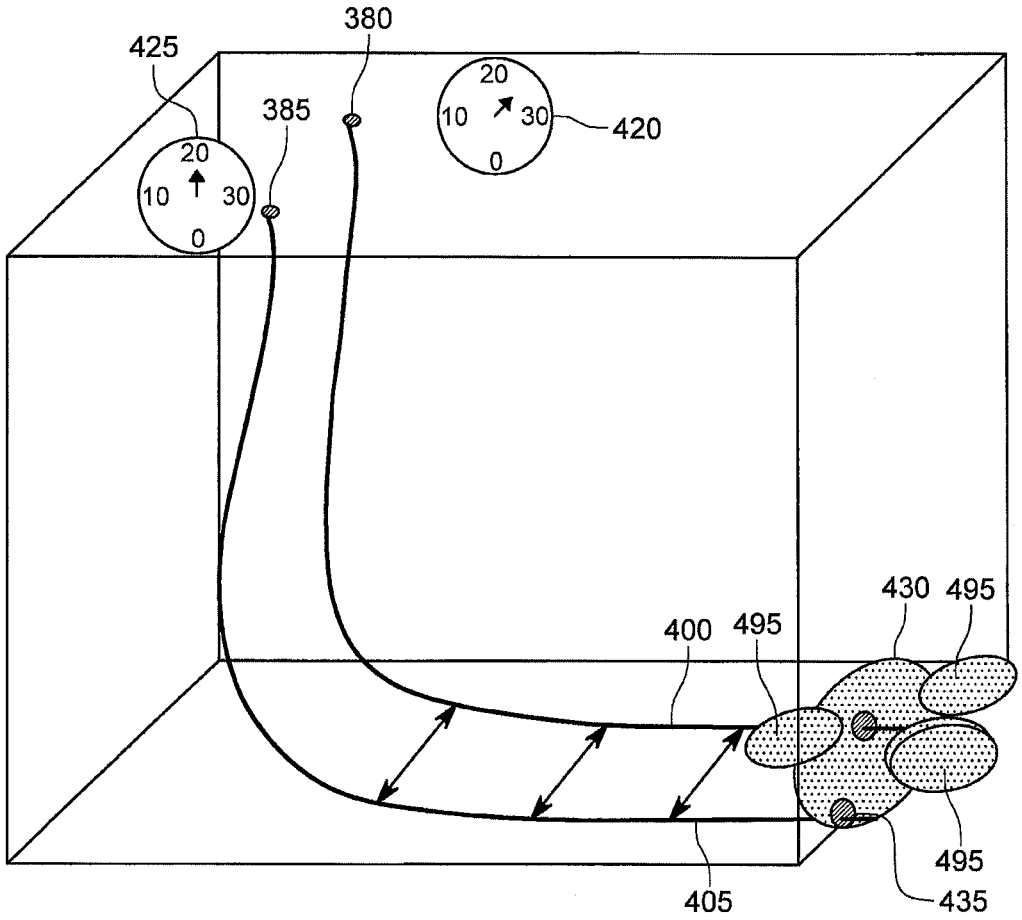
FIG. 9B illustrates an embodiment wherein additional pressure is applied to a well to create a tensile-split or to reactivate a plurality of conduits emanating from an original conduit.

FIGS. 9A and 9B disclose the ability to create, by tensile-splitting additional conduits off of the original conduit, and to reopen additional conduits by hydro-shearing. In embodiments, wells 380 and 385 are an injector/producer pair, respectively. Similar to the embodiments shown in FIG. 6A, in the embodiment shown in FIG. 9A, well 380 may initiate tensile-split conduit 410 in lateral 400 at point 415. In embodiments, the tensile-split conduit (or a pre-existing in-situ conduit) 410 may grow, but not yet intersect lateral 405 of well 385. FIG. 9B depicts applying additional pressure to well 380 to create a plurality of additional tensile-split conduits 495, which may be reactivated in-situ conduits emanating off conduit 430. (Conduit 430 has grown from conduit 410 in FIG. 9A to now intersect lateral 405). This can be seen in the value of gauge 425 changing from 0 in FIG. 9A to 20 in FIG. 9B. In embodiments, the tensile-split or in-situ conduits 495 may themselves intersect further conduits or natural cracks in the rock of the granite formation 225 to enable a more even and hence efficient distribution of heat extraction from the granite formation 225.

Figure 10A:
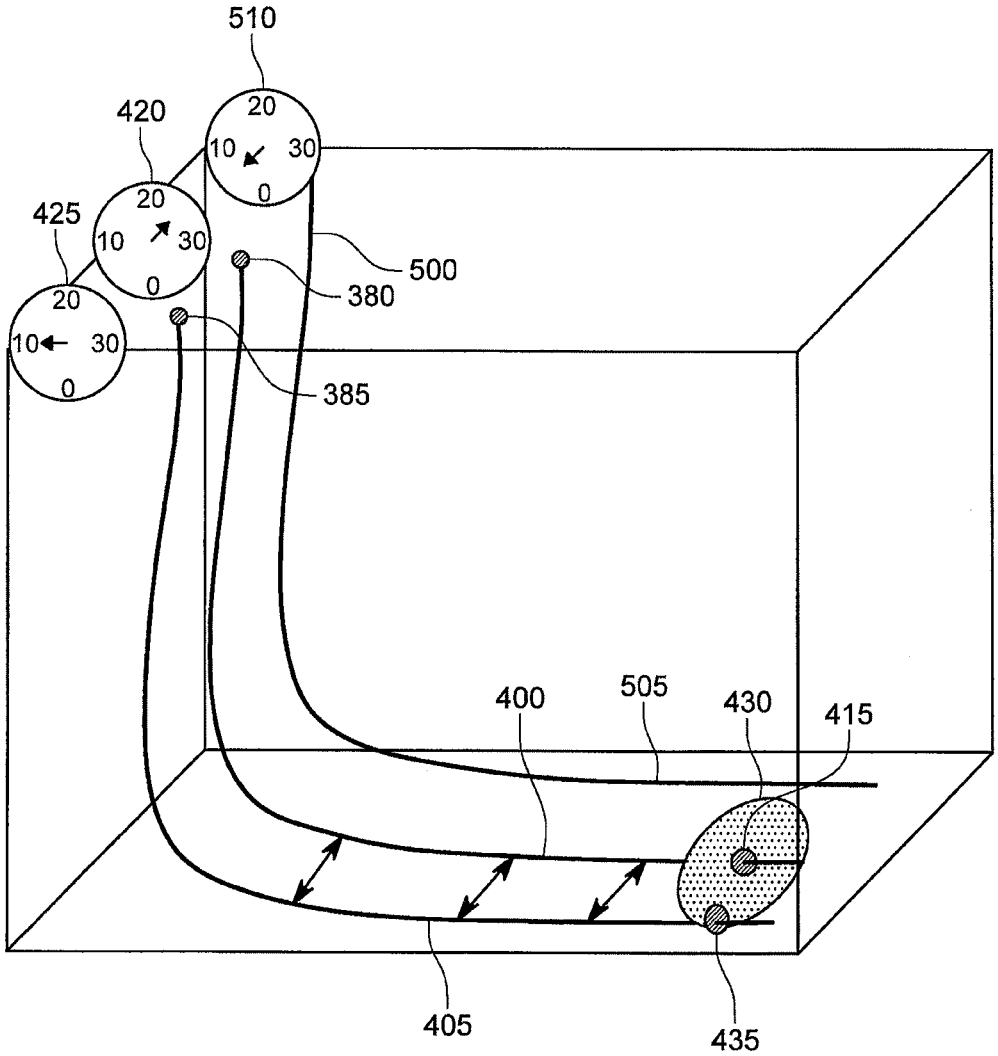
FIG. 10A illustrates an embodiment wherein a tensile-split conduit is initiated in a lateral at a specific point and the conduit grows until intersecting another lateral.
Figure 10B:
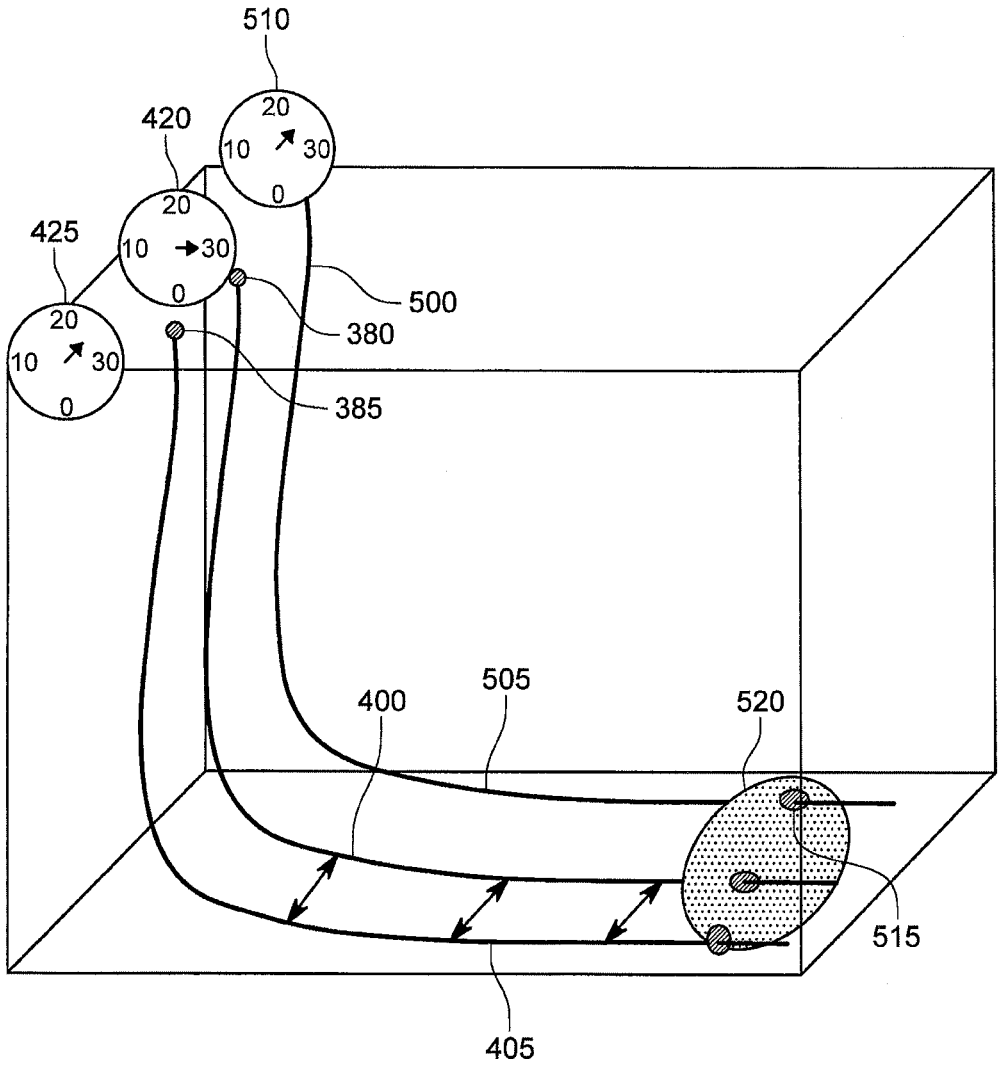
FIG. 10B illustrates an embodiment wherein increased pressure may be applied to encourage growth of a tensile-split conduit to grow in the direction of a specific lateral and contact that specific lateral at a specific point.

FIGS. 10A and 10B disclose the ability to affect the tensile-split conduit-wing growth in another direction along the same plane. In embodiments, well 380 may be an injector well with a cased and cemented lateral 400. In embodiments, well 385 and well 500, may be producer wells with uncemented lateral 405 and uncemented lateral 505, respectively. FIG. 10A discloses an embodiment initiating a tensile-split conduit in lateral 400 at point 415 and the conduit 430 growing until it intersects lateral 405 at a point 435 but not intersecting lateral 505. In embodiments, this may be seen in pressure gauges 425 and 420, as well as a pressure gauge 510, wherein the pressure reading for gauge 420 may be higher than the pressure reading for gauge 425, which may be higher than the pressure reading for gauge 510. In such embodiments, the pressures employed may range from typically 1,000 psi up to 10,000 psi, but the embodiment is not restricted to these values. FIG. 10B shows an embodiment wherein increased pressure as shown by pressure gauge 425 having increased from 10 in FIG. 10A to approximately 25 in FIG. 10B, and the hydraulic pressure may be applied to encourage tensile-split conduit 430 to grow in the direction of lateral 505 and contact lateral 505 at a point 515 to create a newly expanded conduit 520.

Figure 10C:
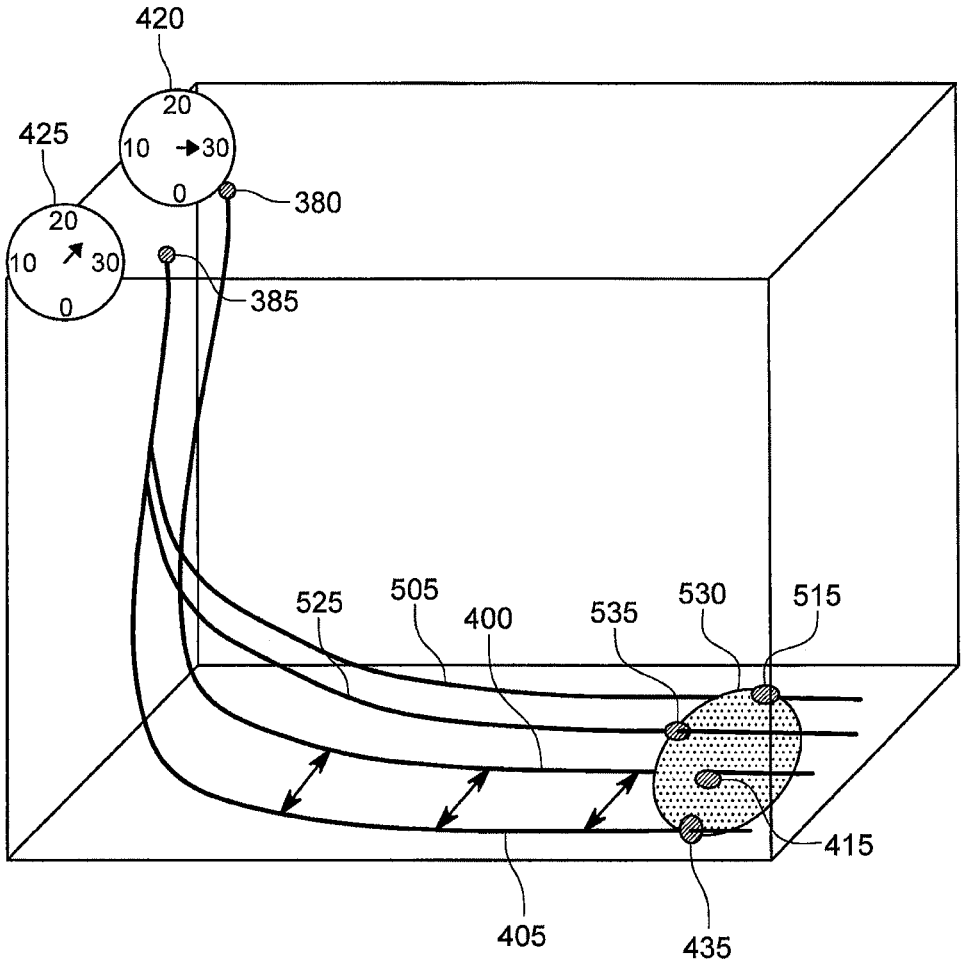
FIG. 10C illustrates a three-dimensional rendering of an embodiment and also shows the ability to affect the tensile-split wing growth in another direction along the same plane and to intersect multiple wellbores emanating from a single wellbore.

In embodiments, geothermal well completions may target granite and other impermeable formations, which are extremely robust, may act like casing, and will not collapse. FIG. 10C is a three-dimensional projection of an embodiment that shows the ability to affect the tensile-split wing growth in another direction along the same plane and to intersect multiple laterals emanating from a single well. In embodiments, two wells 380 and 385 may be present. In embodiments, well 380 with lateral 400 may be an injector and may be cased and cemented. In embodiments, well 385 may be a producer with three laterals 405, 505, and 525. In embodiments, induced tensile-split conduit 530 may emanate from lateral 400. In embodiments, tensile-split conduit 530 may be the first of many conduits that may emanate from this well 380 in lateral 400. In embodiments, twenty or more conduits may be spaced along a 5,000 feet lateral length, wherein the twenty or more conduits may be strategically placed along lateral 400 of well 380. In embodiments, the hydraulic pressure as shown by pressure gauge 425 may be elevated to slightly below tensile shear pressure as shown by the arrow pointing to a value of approximately 25. In embodiments, points 435, 515, and 535 may be the points where the conduit 530 intersects laterals 405, 505, and 525, respectively. In embodiments, fluctuations in pressure as shown on pressure gauges 425 and 420 may indicate hydraulic communication. For example if the pressure in gauge 425 were to increase from 25 to 29 it would be a good indication the conduit 530 had come in contact with one of the laterals 405, 505, or 525. In embodiments, other downhole gauges (not shown) may also be employed to assist in determining if contact with the tensile stress emanating from point 415 has been made with laterals 405, 505, and 525. In embodiments, the pressure may also be reduced in well 385 to assist in determining communication with the tensile stress conduit 530 emanating from point 415. Likewise, in embodiments sleeves (not shown) may be added to well 385 to segregate laterals 405, 505, and 525 to aid in isolating zones for later production control or for aid in ensuring communication with laterals 405, 505, and 525 during the tensile-splitting process. It will be apparent to one skilled in the art that a single wellbore would not be limited to the three laterals shown, but four or more laterals are also possible. In embodiments, multilateral junctions for all of TAML Levels 1-6 (TAML-"Technology Advancement of MultiLaterals") may be employed at the points where the laterals are tied to the parent wellbore. In SPE 51244, M. Chambers discusses the 6 different multi-lateral junction options from an entirely open hole with no casing, to a pressure containing vessel. In embodiments, laterals may be added to the parent well for a fraction of the cost of drilling a new well and may serve the same purpose. In embodiments, the more laterals, and thus larger the area of take points, the greater amount of heat that may be extracted for a given well. In embodiments, four laterals, each present at one of the four points of a compass, may be the most desirable footprint. This method of alternating wellbore pressures between conduit-intersected laterals to encourage the conduit to come into contact with, or grow away from, those and other laterals, may be referred to as the Conduit Propagation Direction Control Procedure (CPDCP).

Figure 10D:
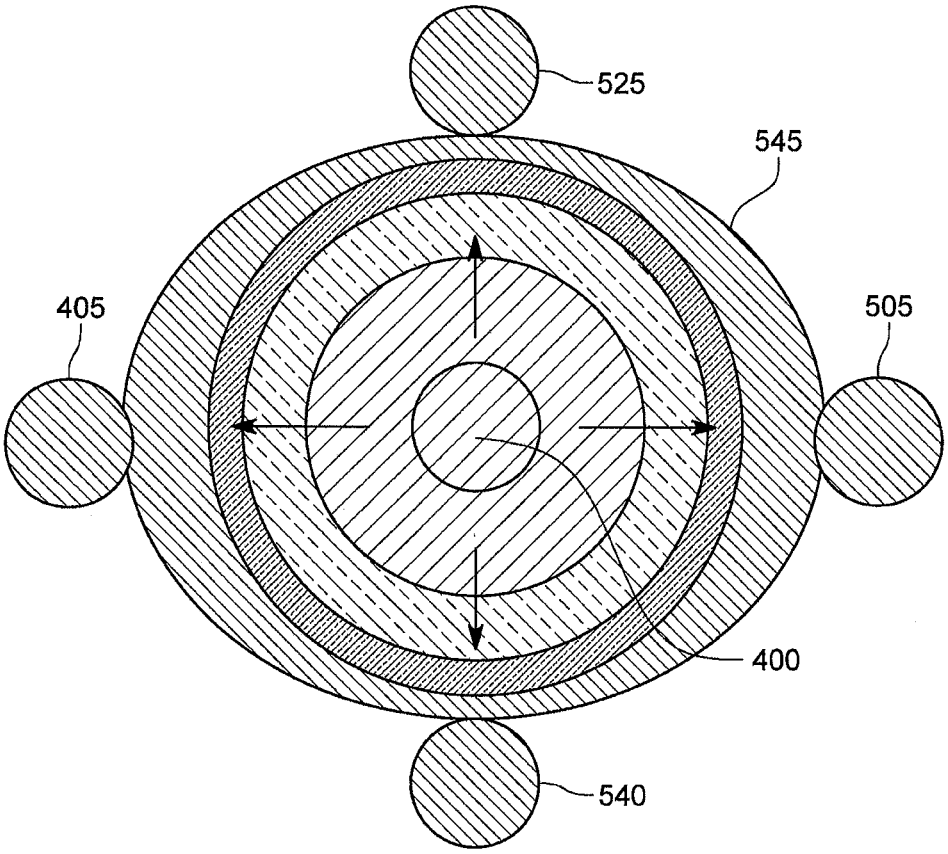
FIG. 10D illustrates is an end view illustrating an embodiment of a tensile-split conduit intersecting multiple wellbores.
Figure 11A:
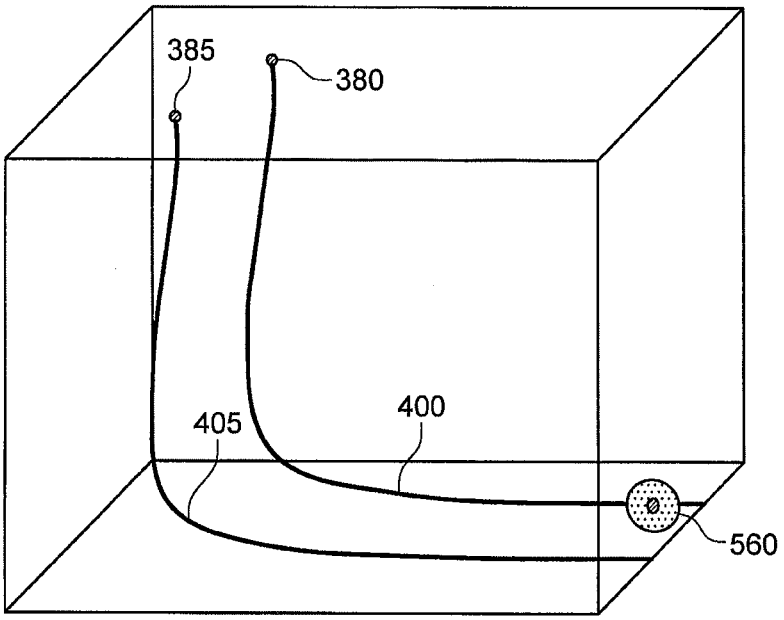
FIG. 11A illustrates an embodiment of a method suitably employed for completing a geothermal well using an enhanced geothermal completion direct contact method.
Figure 11B:
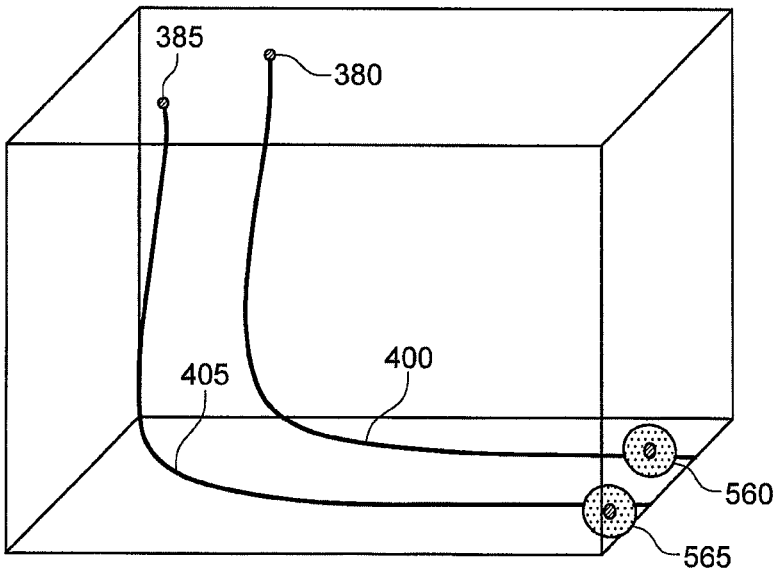
FIG. 11B illustrates an embodiment of a method suitably employed for completing a geothermal well using an enhanced geothermal completion direct contact method.
Figure 11C:
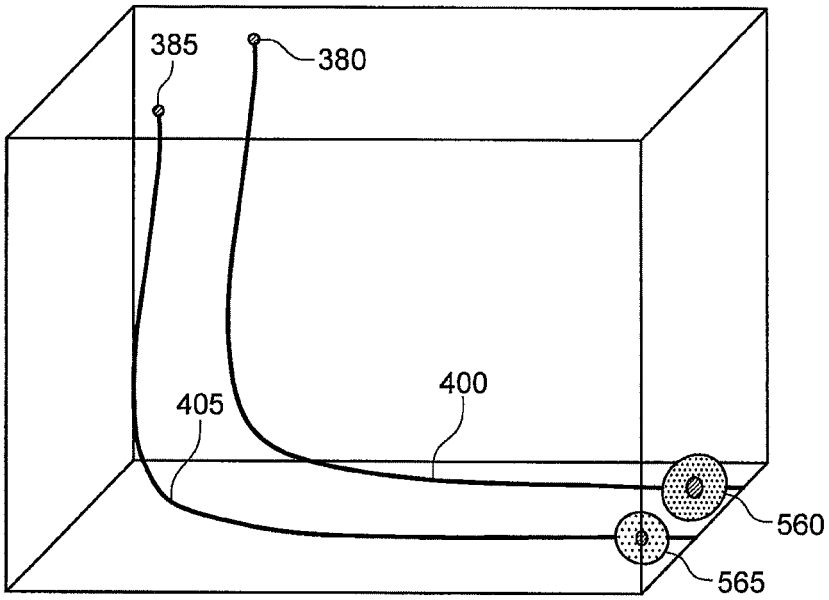
FIG. 11C illustrates an embodiment of a method suitably employed for completing a geothermal well using an enhanced geothermal completion direct contact method.
Figure 11D:
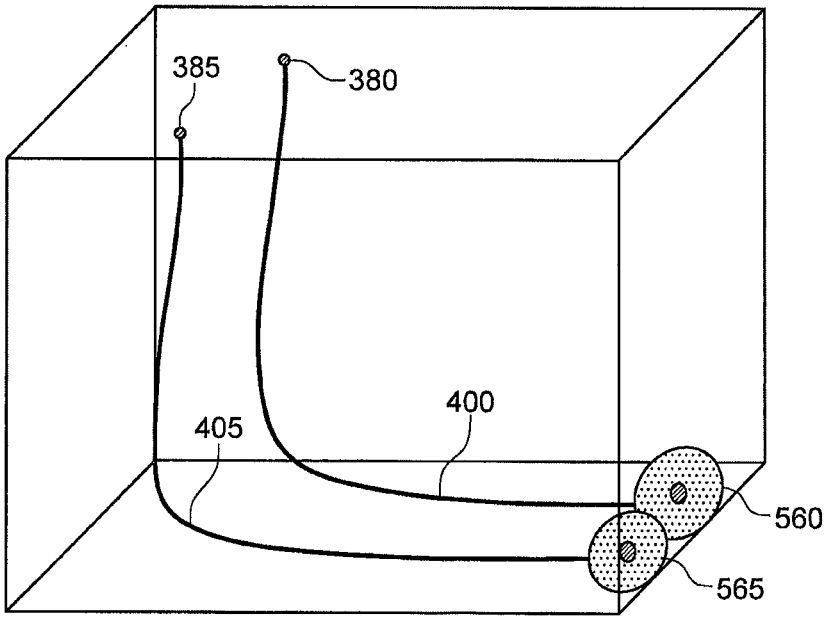
FIG. 11D illustrates an embodiment of a method suitably employed for completing a geothermal well using an enhanced geothermal completion direct contact method.
Figure 11E:
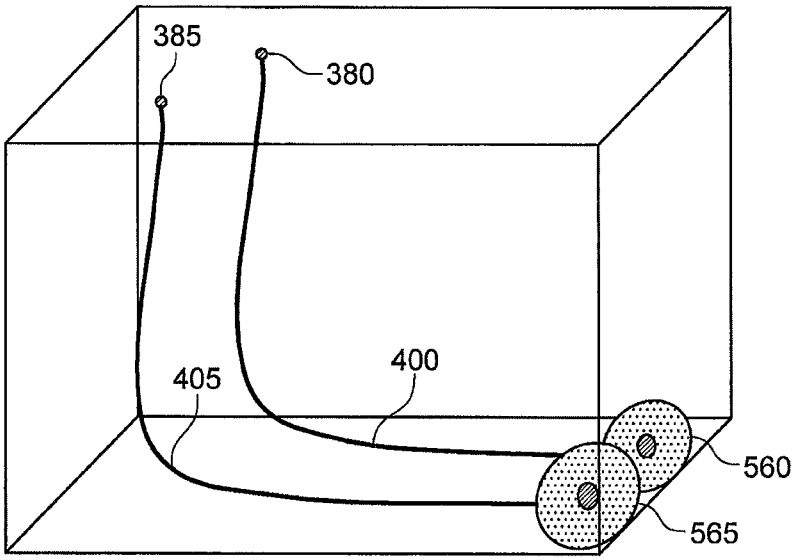
FIG. 11E illustrates an embodiment of a method suitably employed for completing a geothermal well using an enhanced geothermal completion direct contact method.
Figure 11F:
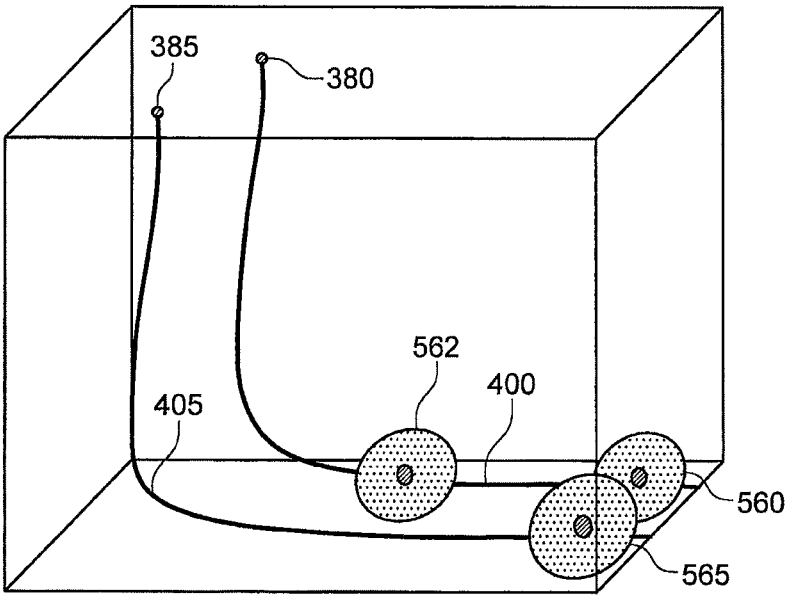
FIG. 11F illustrates an embodiment of a method suitably employed for completing a geothermal well using an enhanced geothermal completion direct contact method.

In embodiments, FIG. 10D shows an end view of injector lateral 400 and four producer laterals 405, 505, 525, and 540 which emanated from a single multilateral well. A conduit 545 has been created by means of pumping fluid into lateral 400 above the tensile-splitting pressure. During the conduit creation process, as conduit 545 expands radially away from lateral 400, pressures in laterals 405, 505, 525 and 540 may be raised or lowered as appropriate to encourage the radial expansion of conduit 545 to come in contact with each lateral. For example, if the pressure in lateral 405 were set at a pressure slightly below the maximum shear stress and conduit 545 intersected lateral 405, then the pressure could be raised to encourage the conduit 545 to stop growing in the direction of lateral 405 and start growing toward laterals 405, 505, 525, and 540. This process can be repeated as the conduit 545 intersects other laterals.

Further, in FIG. 10D the dark arrows show the direction of radial expansion away from lateral 400 toward the four laterals 405, 505, 525, and 540.

Disclosed herein are one or more methods, systems, and/or apparatuses suitably employed for enhancing tensile-splitting (or hydro-shear) conduit parameters in a subterranean formation. As used herein, reference to enhancing tensile-splitting (or hydro-shear) conductivity may include the modification of a conduit's length, width, height, and/or flow conductivity. Further disclosed is the interaction of the tensile-split (or hydro-shear) conduit by affecting the formation stress properties from two or more different wells with laterals suitably placed in the same plane of orientation. Returning to FIGS. 6A and 6B, an embodiment of a method suitably employed for completing a geothermal well using an Enhanced Geothermal Direct Contact Method is also illustrated. In embodiments, the Direct Contact Method compromises performing operations in lateral 400, which may be an injector well, while simultaneously performing operations or monitoring data in lateral 405, which may be a producer well. In embodiments, the laterals 400 and 405 may reside in the same reservoir and may be oriented in the same plane of stress regime. The following Table 1 shows steps for the corresponding pressures and pump rates for each well 380 and 385.

TABLE 1

| | Injector 380-Lateral 400 | | | | | Producer 385-Lateral 405 | | | | |
|---|---|---|---|---|---|---|---|---|---|---|
| Step | Procedure | FIG. | Item | Gauge 420 Reading (psi) | Pump Rate (BPM) | Procedure | FIG. | Item | Gauge 425 Reading (psi) | Flow Rate (BPM) |
| 1 | Breakdown Formation | 6A | 415 | 7500 | 5 | Monitor Pressure* | 6A | 405 | 5000 | 0 |
| 2 | Pump Pad | 6A | 410 | 8500 | 25 | Monitor Pressure* | 6A | 405 | 5000 | 0 |
| 3 | Pump Pad | 6B | 430 | 8500 | 25 | Pressure Contact | 6B | 435 | 6200 | 0 |
| 4 | Pump Proppant | 6B | 430 | 8000 | 25 | Monitor Fluid | 6B | 435 | 7000 | 4 |
| 5 | Stop Pumping | 6B | 430 | 6500 | 0 | Proppant Noted | 6B | 435 | 6500 | 0 |
| 6 | Observe Pressure | 6B | 420 | 6200 | 0 | Bleed to Closure Pressure | 6B | 435 | 6200 | 1 |
| 7 | Injectivity Test | 6B | 420 | 3000 | 2 | Flow Well | 6B | 435 | 2800 | 2 |

In embodiments, in step 1 the formation may be broken down and the conduit initiated in injector lateral 400, while simultaneously pressuring producer lateral 405 adjacent to the created conduit 410 in injector lateral 400 to slightly below tensile-splitting pressure.

In embodiments, in step 2, pad (stimulation fluid without a means to prop or hold open the fracture without pressure) may be pumped into conduit 410 while monitoring the pressure in lateral 405. In embodiments, this process may be continued until pressure significantly changes in lateral 405 indicating the conduit 430 has intersected lateral 405 at point 435, as shown in FIG. 6B. This can be seen in step 3 where the pressure in lateral 405 has increased from 5,000 psi in step 2 to 6,200 psi in step 3.

In embodiments, in step 4 proppant may be pumped into injector lateral 400 and monitored in producer lateral 405 by circulating fluid to surface or through downhole sensors. This can be seen in step 4 where the flow rate in lateral 405 has increased from 0 BPM to 4 BPM. The corresponding pressure has also increased from 6,200 psi to 7,000 psi.

In embodiments, in step 5 proppant may be detected in sufficient quantities in producer lateral 405 and pumping may be stopped. This can be seen where the pump rate and flow rate are both 0 BPM and the pressures are the same 6,500 psi.

In embodiments, in step 6, while observing the pressure in injector lateral 400, the pressure may be reduced or bled off in producer lateral 405 until closure of the tensile-split wall aperture onto the proppant has occurred. In embodiments, if there is no need to evaluate the aperture closure, operations may be concluded. This can be seen in both laterals 400 and 405 where the pressures had decreased to 6,200 psi while flowing lateral 405 at 1 BPM.

However, in embodiments where there may be a desire to test the conduits' permeability and communication to ensure sufficient pump rates can be achieved at desired pressures, operations may proceed to step 7 wherein an injection rate may be established in injector lateral 400, and the flow rate in producer lateral 405 may be choked to match the injection rate for injector lateral 400 to establish the circulation rate and pressure in both laterals 400 and 405. This can be seen where the pump rates are identical and pressures are different due to friction losses in the reservoir.

In embodiments, if pressure increases in the injector lateral 400 and then reaches a plateau, the rate may be acceptable, and operations may cease and proceed to step 8 where operations may move to the next tensile-splitting location. However, in embodiments, if pressure in injector lateral 400 continues to rise, a decision may be made to either retreat and restart at step 2 or accept the lower permeability and communication.

FIGS. 11A, 11B, 11C, 11D, 11E, and 11F illustrate graphically an embodiment of a method suitably employed for completing a geothermal well using an Enhanced Geothermal Enhanced Connection Method. In embodiments, the ECM generally comprises performing operations in an injector well 380 with a lateral 400 while simultaneously performing operations or monitoring data in a producer lateral 405. In embodiments, the laterals of both injector well 380, lateral 400, and producer well 385, lateral 405, may reside in the same reservoir and may be oriented in the same plane of stress regime. In embodiments, FIGS. 11A, 11B, 11C, 11D, 11E, and 11F graphically show the growths and corresponding well pressures and pump of flow rates for each step for conduits. Negative flow rates indicate fluid is moving out of the wellbore rather than into the wellbore.

In embodiments, step 1 may comprise the formation being tensile-split using water or gel to initiate conduit 560 in lateral 400, while simultaneously monitoring the pressure of lateral 405 in well 385 at a location normal to the created conduit 560 in well 380. This can be seen in the following Table 2 where the pressure and rate in well 380 is higher than that in well 385. In embodiments, an operator may start stimulation at the toe of well 380, which may be an injector well, through sleeve or perforations (pumping gel or fresh water).

TABLE 2

| | Well 380-Injector | | Well 385-Producer | |
|---|---|---|---|---|
| Step | Surface Gauge Press (psi) | Pump/Flow Rate (BPM) | Surface Gauge Press (psi) | Pump/Flow Rate (BPM) |
| 1 | 7500 | 20 | 6000 | 0 |
| 2 | 6500 | 0 | 6000 | 0 |
| 3 | 6000 | 0 | 7500 | 20 |
| 4 | 6000 | 0 | 6000 | 0 |
| 5 | 8500 | 25 | 6500 | 0 |
| 6 | 6500 | 0 | 8500 | 25 |
| 7 | 7000 | 0 | 8500 | 25 |

TABLE 2-continued

| | Well 380-Injector | | Well 385-Producer | |
|---|---|---|---|---|
| Step | Surface Gauge Press (psi) | Pump/Flow Rate (BPM) | Surface Gauge Press (psi) | Pump/Flow Rate (BPM) |
| 8 | 2000 | 0 | 2000 | 0 |
| 9 | 2500 | 2 | 2300 | −2 |
| 10 | 0 | 0 | 0 | 0 |
| Formation Parting Pressure = 6,200 psi | | | | |

In embodiments, in step 2 after pumping and creating conduit 560 of approximately 50 feet emanating from lateral section 400, the rate may be stopped and the pressure held at above fracture closure stress. In alternative embodiments, the pressure after stopping pumping in well 380 may be bled to below fracture closure pressure. This can be seen in Table 2 where both well 380 and well 385 show 0 rate but the pressure is higher in well 380 than well 385.

In embodiments, in step 3 pressure may be bled to a level slightly below the fracture initiation pressure in well 380 while simultaneously tensile-splitting lateral section 405 in well 385 using water or gel at a point along the lateral section 405 within 20 feet of well 380, lateral section 400's most recent tensile-splitting. In embodiments, stimulation may be started at the toe of well 385, which may be a producer well. This can be seen in Table 2 where the pump rate in well 385 is 20 BPM. In embodiments, pumping may be continued in well 385 until a pressure increase is noted in well 380 or, in an alternative embodiment, until after the conduit 560 has extended approximately 50 feet from the initiation point in well 385 and the pumping ceased.

In embodiments, in step 4 pressure is monitored in well 380 while creation of conduit 565 is underway in well 385. This is shown in Table 2 where contact has been made because the pressure in well 380 increased from 6,000 psi to 6,500 psi.

In embodiments, in step 5 the proppant material may then be pumped into well 380 until significant pressure is noted in well 385 or proppant is recovered. This can be seen in Table 2 where the pressure in well 385 is 6,500 psi and well 385 is producing fluid to surface as noted by the negative 5 BPM rate.

In embodiments, in steps 6, 7, and 8, if contact has not been made in well 385 by pumping in well 380, a designed tensile-splitting may be emanated from well 385 while monitoring pressure in well 380. Pumping is continued until contact is made. At the conclusion of pumping the pressure is bled down to approximately 2,000 psi which would be a pressure below fracture closure pressure.

In embodiments, once the tensile-splitting operation has been completed, an injectivity test may be performed in step 9 by pumping into well 380 with water at the desired rate and recovering fluid from well 385. This can be seen from Table 2 where well 380 has an injection rate of 2 BPM and well 385 has a negative 2 BPM flowrate (i.e. producing to surface). The difference in pressure is attributable to the reservoir friction pressure. In embodiments, if an acceptable rate and pressure for producing operations has been achieved for that conduit, the process is complete. If not, the process may be repeated from step 1. If there were 20 planned flow conduits between well 380 and well 385, then an acceptable rate for a single conduit would be $1/20^{th}$ of the designed rate. For example, if the design rate were 20 barrels per minute (bpm) at a pressure of 3,000 psi, then an acceptable rate for one conduit would be 1 bpm at a pressure less than 3,000 psi to account for flow friction along the lateral section. Additional flow conduits can next be created further towards the heel of the lateral sections by moving to step 1, for example, conduit 562 in FIG. 11F.

In embodiments, if treating more than one pair of wells at a time, then the methods described in relation to FIGS. 11A, 11B, 11C, 11D, 11E, and 11F may be modified by applying or reducing pressure in the desired wellbore using downhole pumps or wellhead chokes to affect the growth of the conduit where first contact and communication is noted and where there is a desire to grow the conduit in the opposite direction.

FIG. 12 presents methods proposed to be employed in injector wells and producer wells when certain conditions have not been met. In embodiments, the first step in the first optional method, wherein creation of the tensile-split conduit is underway by pumping in the injector 570 and communication has not been established with the producer 575. In embodiments, the following techniques may be employed: pump diverter materials; increase pump rate in injector; increase viscosity of fluid (cross-link); decrease viscosity of fluid; and pump twice design volume, no contact-move to next tensile-split location. As the above methods are employed simultaneously in the producer 575, the pressure and rate may be raised and lowered accordingly.

In embodiments, a second optional method may involve the following. In embodiments, after pressure communication has been determined between the injector 570 and producer 575, proppant or swelling material may be introduced to the injector 570. Further, in embodiments, simultaneously proppant may be monitored in the producer 575. In embodiments, if pressure increases in the injector 570 or additional proppant quantities are desired, pressure may be raised in the producer 575 to increase the conduit aperture width. If, however, proppant is being recovered in the producer 575 and there is a desire to pack the conduit further with proppant, pressure may be reduced, and the aperture and height will decrease.

In embodiments, a third optional method may involve the following. In embodiments, if after concluding the conduit creation, injectivity is below desired rates, the conduit may be reopened, and additional proppant or swell material may be inserted. In embodiments, rates and pressures higher than the original pump treatment may be required and/or changes to the fluid viscosity may be attempted. Simultaneously, pressures in one or more producers 575 may be raised or lowered depending on the expected outcome.

In embodiments, monitoring and recording downhole pressure, temperature, seismic, temperature, and other data may enable the optimum placement of a conductive conduit between injector 570 and producer 575, or multiple injectors 570 and producers 575, to be achieved. In embodiments, this monitoring may be used for every newly constructed conduit or only used until the parameters to create the conduit are fully understood.

Figure 13:
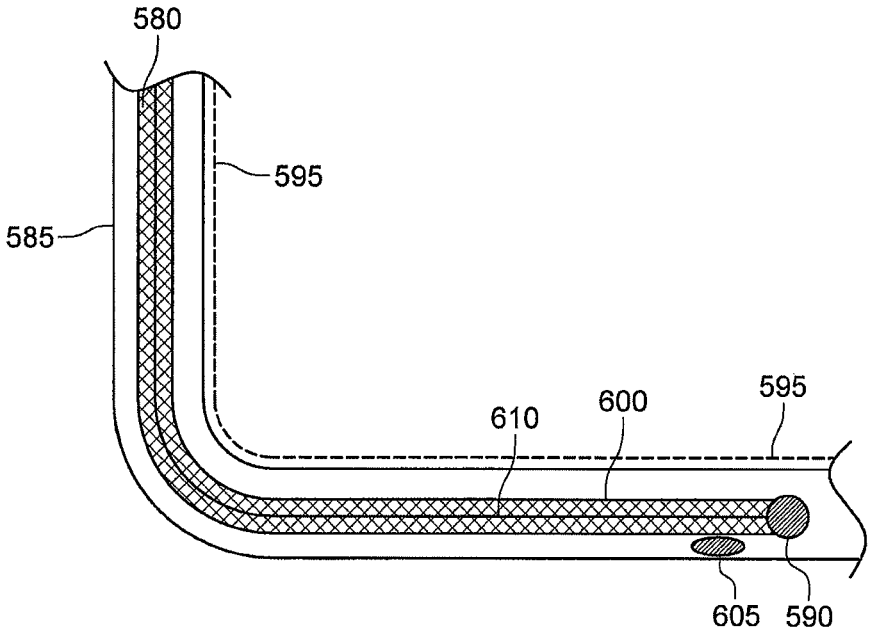
FIG. 13 presents methods and systems that may be used to permanently, or temporarily, collect treatment data.

FIG. 13 presents methods and systems that may be used to permanently, or temporarily, collect treatment data. In embodiments, well 580 may comprise a casing 585. In embodiments, casing 585 may comprise one or more sensors 590 or fiber cable 595 permanently affixed to it. In embodiments, fiber cable 595 may be used as a type of sensor to collect data such as temperature, sound, and strain every foot of its length, or fiber cable 595 may be used to transmit electrical data from the one or more sensors 590. In embodiments, coiled tubing 600 may be used as a means of conveying one or more sensors 590, fiber cable 595, and/or a control wire 610. Likewise, in embodiments the one or more sensors 590 may be employed in the casing 585 and/or on the coiled tubing 600 and RFID Tags 605 used to carry instructions to the sensors 590 or data from the sensors 590 by means of well circulation. Additionally, in embodiments, sensors 590 may comprise permanent sensors attached to the casing 585 such as pressure sensors and/or gamma ray sensors.

Further, in embodiments, sensors 590 may comprise temporary sensors on coiled tubing 600 and/or wireline for monitoring surface pressure, acting as downhole sensors (e.g., pressure, gamma ray detector, noise), or collecting downhole sensor data at the surface by wire or memory tool (e.g., circulated RFID tag 605 to collect data or downloaded when pull coiled tubing 600 out of hole).

Micro Seismic is another common means used in the industry to track the creation of conduits. Typically, these types of systems are installed in adjoining wells to collect the data. As described earlier, there are two primary means to execute communication between an injector and a producer or group of injectors and producers. Many of the descriptions described above involved the DCM where fluid may be pumped from a cemented injector well to an uncemented producer well. However, at least as prevalent is the FEM, where both injector and producer wells are cemented, and both have created conduits extending towards one another. The attempt is to have the created conduits intersect or form additional branches or splays, which intersect or contact perpendicular natural fractures which will act as connection points with the bulk formation.

Figure 14A:
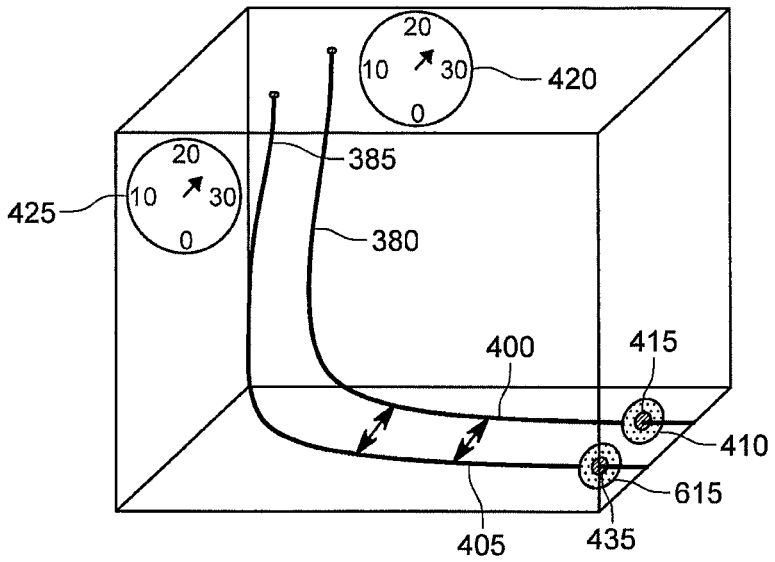
FIG. 14A illustrates an embodiment wherein two wells are simultaneously undergoing tensile-splitting towards each other.

FIG. 14A is a depiction of an embodiment wherein two wells are using the FEM process. In embodiments, well 380 may be a well with lateral 400 and tensile-split conduit 410 emanating from point 415. In embodiments, well 385 may be a well with lateral 405 parallel in the same plane to lateral 400. Further, in embodiments, well 385 may comprise tensile-split conduit 615 emanating from point 435. In embodiments, conduits 410 and 615 may not have come into contact with one another.

Figure 14B:
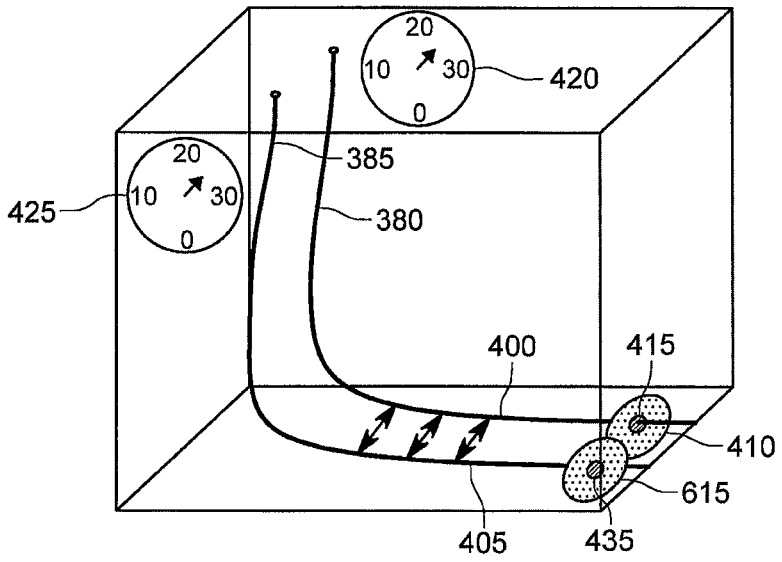
FIG. 14B illustrates an embodiment wherein the same two wells have created a flow conduit between them by means of the simultaneous tensile-splitting

In another embodiment shown in FIG. 14B, tensile-split conduits 410 and 615 may be in contact with one another or near to contacting one another.

In embodiments, the ability of the tensile-split conduits 410 and 615 to intersect may be enhanced with one or more of the following actions:

- start tensile-splitting both conduits 410 and 615 at the same time or start one conduit later than the other conduit;
- pump much higher rate and pressure in one conduit versus the other conduit;
- stop or reduce pumping in one well when intersection is noted in the other well;
- pump diverter material in one of the two wells to encourage the generation of branches or splay conduits off the primary conduit;
- pump proppant in one well while bleeding pressure in the other well;
- change the viscosity of the fluid in one conduit versus the fluid in the other conduit with for example cross-linking one, and pumping swellable material in one conduit while pumping conventional proppant in the other conduit.

The above list should not be limiting but other methods or combination of the above methods may be effective in some formations and more effective in others.

In embodiments, it may be important to locate the initiation points for tensile-split conduits in wells. Improper placement in EGS wells may limit efficient injected-fluid circulation to recover heat. In the embodiments shown in FIGS. 15A, 15B, and 15C, a planar view is depicted showing two horizontal wells 620 and 625. In embodiments, wells 620 and 625 may be cased and cemented wells. In embodiments, wells 620 and 625 may be oriented perpendicular to the maximum horizontal stress direction $\sigma_{Hmax}$. In embodiments, tensile stress conduits 630, 635, and 640 may be present as well.

Figure 15A:
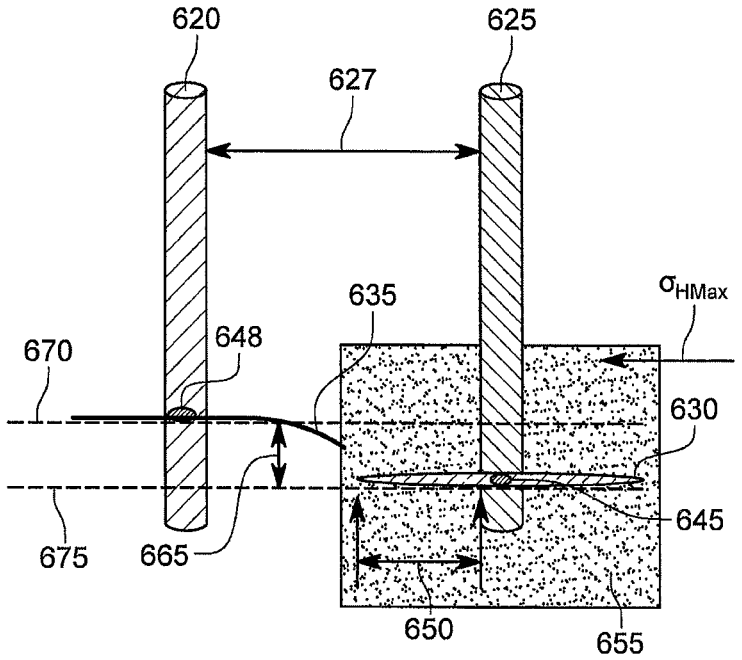
FIG. 15A illustrates an embodiment wherein a tensile-stress conduit and an affected rock stress area may be created during the stimulation of the conduit.

More specifically, FIG. 15A shows an embodiment wherein tensile stress conduit 630 emanating at point 645 in well 625, having a conduit-wing length 650, and an affected rock stress area 655 (noted by the dotted field) may be created during the stimulation of conduit 630. In embodiments, stress area 655 may be approximately equal in width to conduit-wing length 650. Further, a distance 627 is shown, and distance 627 is the distance between well 620 and well 625. Additionally, FIG. 15A shows an embodiment wherein conduit 635 emanates from a point 648 in well 620.

Figure 15B:
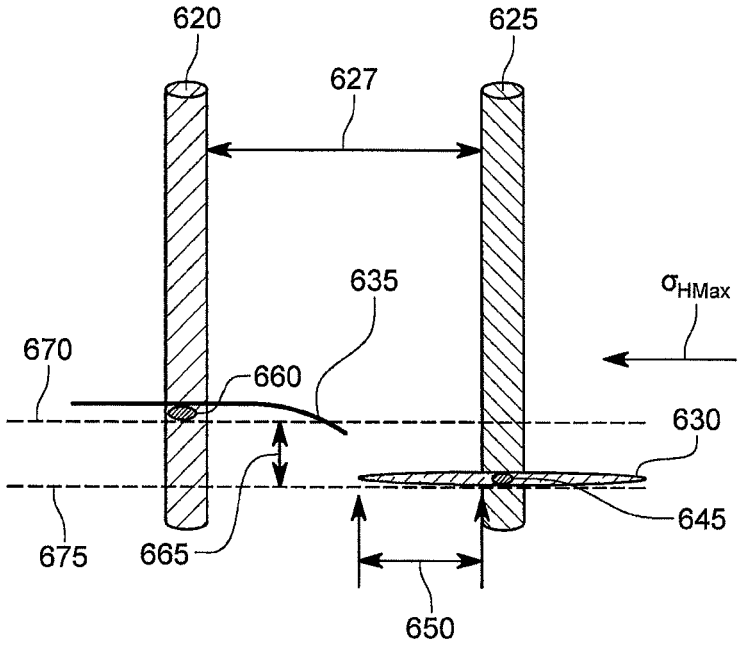
FIG. 15B illustrates two wells wherein pumping of a first conduit has concluded and tensile-splitting of a second conduit is underway.

In the embodiment shown in FIG. 15B, wells 620 and 625 are depicted. In embodiments, pumping of conduit 630 has concluded and stimulation of conduit 635 is underway emanated from point 660 and growing both toward and away from well 625. In embodiments, initiation point 660 of conduit 635 is shown, and distance 665 is the distance from parallel lines 670 and 675 through the two conduits parallel to the $\sigma_{Hmax}$. In embodiments, distance 665 should be less than 20 feet or conduit 635 will be too far away and will not curve and intersect conduit 630. Further, in embodiments the conduit-wing length 650 may be greater than half of the distance 627.

Figure 15C:
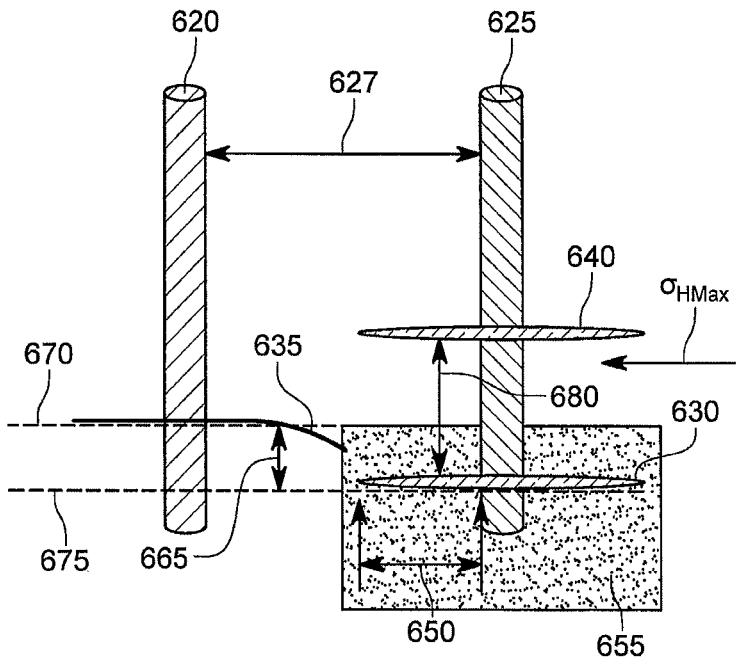
FIG. 15C illustrates an embodiment with two conduits and the required minimum distance between orthogonal axes after tensile-splitting has been completed.

In embodiment, FIG. 15C illustrates conduits 630 and 640 and the distance 680 between them. In embodiments, distance 680 may be approximately equal to or greater than distance 665, which may place the newly created conduit 640 out of the altered stress zone 655 and therefore will propagate parallel to the $\sigma_{Hmax}$. If conduit 640 were closer, it would veer away from conduit 630. Further, in embodiments the conduit-wing length 650 may be greater than the distance 680.

Figure 16A:
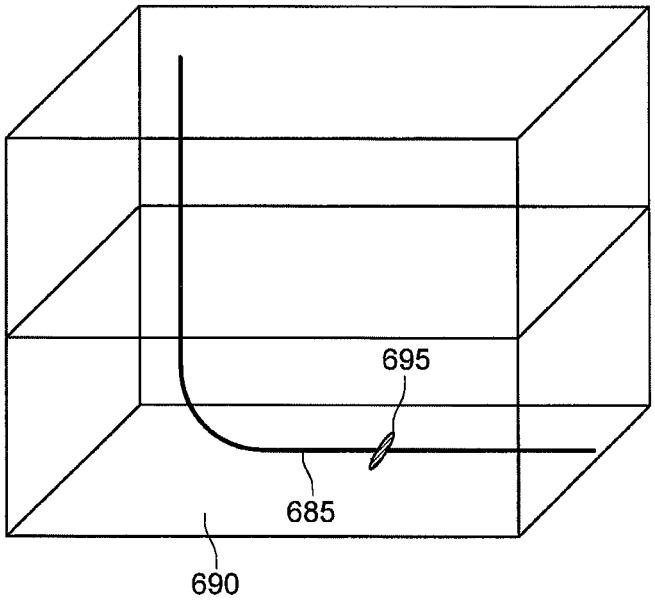
FIG. 16A illustrates an embodiment of a well in a formation.
Figure 16B:
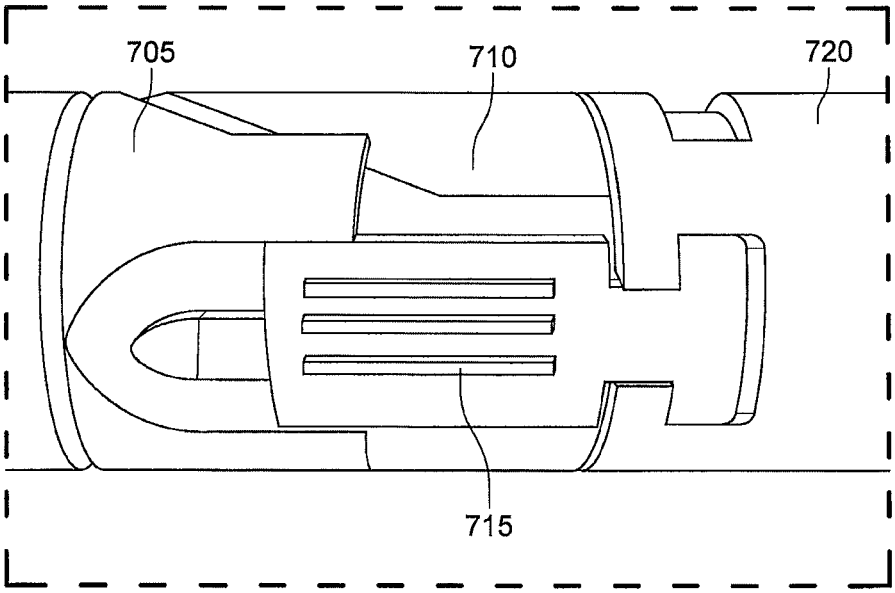
FIG. 16B illustrates an embodiment of a mechanical rock-cracking tool used to create a fissure or multiple fissures.
Figure 16C:
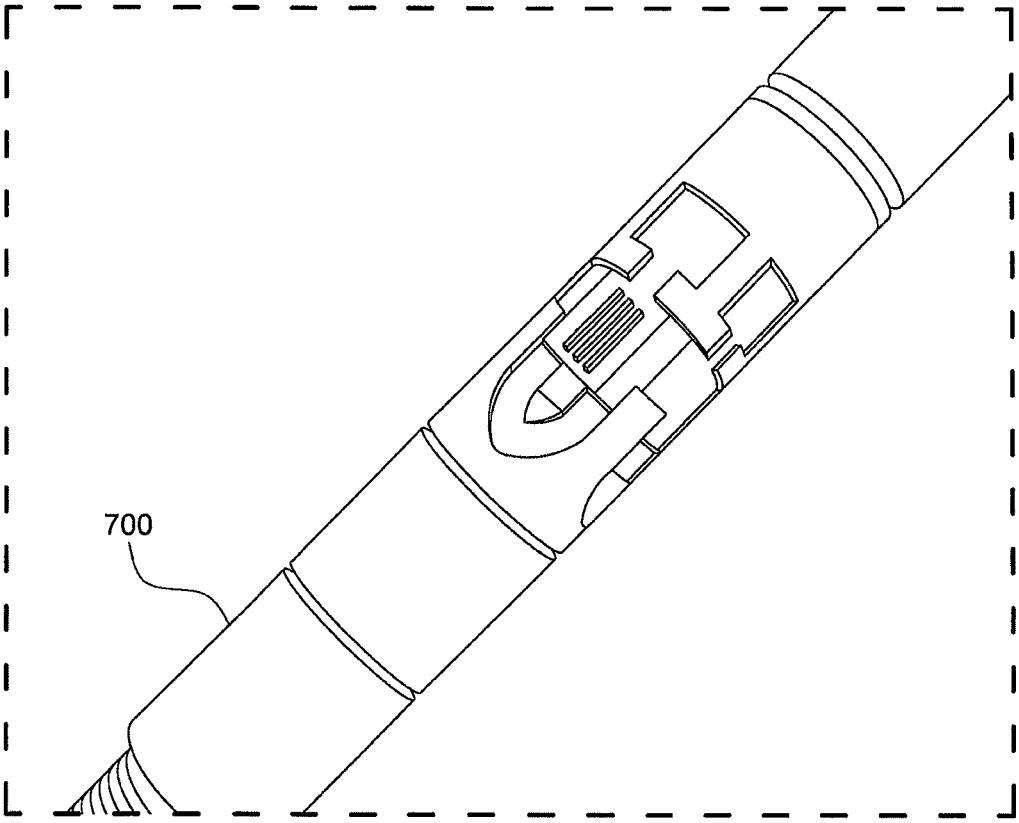
FIG. 16C illustrates an embodiment of a mechanical rock-cracking tool prior to testing.

The DCM method employs an open hole methodology to enhance the odds of intersecting a conduit deployed from a parallel horizontal well. To enhance the odds further the target well may be tensile-split beforehand. FIG. 16A illustrates an embodiment of a well 685 in formation 690. At a point 695 the formation 690 has been mechanically stressed to instigate a perpendicular fissure or multiple fissures radiating out and away from the well 685. FIGS. 16B and 16C illustrate a tool 700, which has been used in tests since the late 1990s to create such a fissure or multiple fissures, which contains cones 705 and shear pads 710 containing ridges 715 and a retainer 720. The tool 700 is actuated by a hydraulic piston and retracted with pipe movement. Similarly, external casing packers employing rubber expandable elastomeric elements may also be used to stress the formation 690 and create fissures emanating from the well 685. Having an area of pre-fissured rock would enhance the likelihood of contact since the tensile-split conduits would need to be extended a shorter distance.

In embodiments, during the completion of a pair of lateral sections where one is a cased hole and the other is an open hole, sand or other proppant added to the stimulation fluid in the cased lateral may enter the open hole lateral once connection is made. There may even be a desire to flow the open hole lateral during the completion to enhance the communication and placement of proppants between the laterals. Once fluid movement has stopped, sand may settle and form a bridge or plug in the open-hole lateral preventing future fluid movement.

To prevent bridges from forming, or to remove them after forming, a tubular string may be inserted in the open hole lateral at a point near the intersection of the stimulation fluid from the injector. Fluid may be circulated from the surface to the end of the tubing in a conventional or preferred reverse circulation mode to remove sand or other proppants or debris from the lateral. It may be preferable to have the tubular circulation string in the vertical part of the well during the stimulation and use it to remove debris after the conclusion of the stimulation.

A pump rate of 2 to 5 barrels per minute (Note: rate is for 2⅜" tubing) must be used to keep the solids in suspension. Pads of gel and/or surfactants may be added to the fluid to assist in the removal of the fill.

The tubular string may be threaded and coupled or a continuous coiled tubing string. Nozzles, beveled ends, or other tools/accessories may be added to the string to assist in the debris removal or other processes. Typical threaded and coupled or coiled tubing sizes used in this process are 2", 2⅜", and 2⅞" although smaller and larger sizes may be used.

The process described above may be used multiple times during the completion process. For example, the process may be used before, during, or after the completion of each stage. The process may also be used in multiple laterals of a multilateral well by simply moving the tubular string between laterals.

Figure 17:
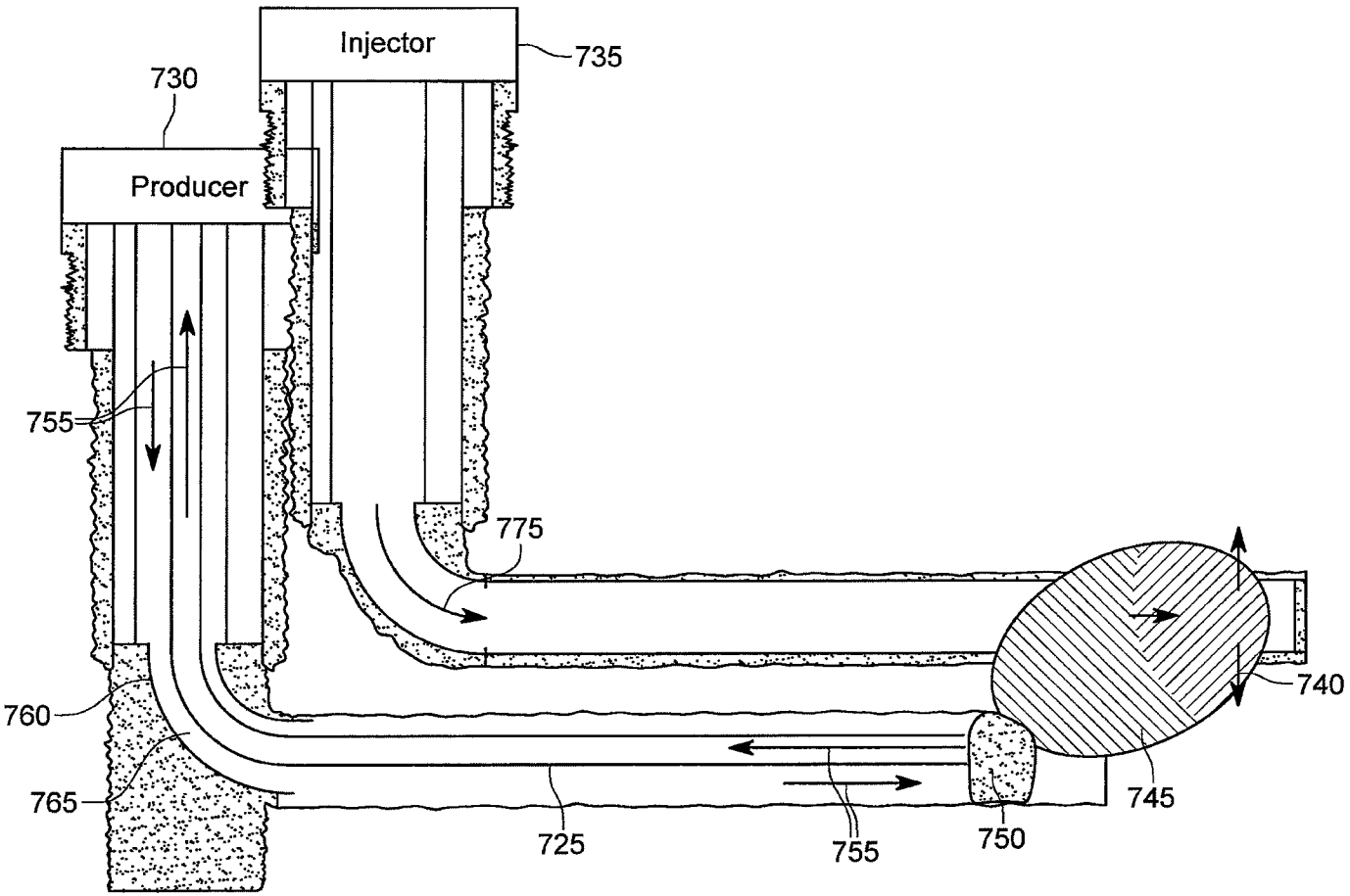
FIG. 17 illustrates an embodiment of a system whereby a tubular member may be used to remove debris from a producer lateral.

It is important to have unobstructed laterals during and after the creation of conduits between injector and producer laterals. FIG. 17 illustrates an embodiment of a system whereby a tubular member 725 may be used to remove debris from a producer well 730. Represented are an injector 735 and producer well 730. Injector well 735 may be a cased lateral and may have a sleeve or perforation 740 from which tensile-split conduit 745 contacts producer well 730 creating a debris plug 750. To remove debris plug 750, cleanout fluid may be pumped down the annulus of tubular member 725 breaking up debris plug 750 and escorting it up tubular member 725 and out of the producer well 730. Arrow 755 shows the direction of flow of the stimulation fluid down the injector wellbore 735 and out the port or perforation 740. Debris plug 750 may be a solid plug or simply be loose grains of sand or other particles restricting flow. The cleanout fluid may be water, gelled water, or a combination of water and gelled water pads to assist in capturing and removing of the debris solids in the debris plug 750. If more than one producer lateral is present, the tubular member 725 may be moved between laterals.

At the conclusion of the creation of flow conduits and wellbore cleanout, tubular member 725 may be positioned near the heel 760 of the well 730 to aid in assisting the producer well 730 to flow through the addition of a lighter fluid or a gas. The tubular string 765 may also be used to aid in circulating kill fluid if the need arises.

Additionally, evenly distributing the injected flowrate between each of the created conduits between a horizontal injection well and one or more horizontal production wells is of utmost importance in the completion design. However, the fluid loses pressure energy to friction as it flows from the source of the injection fluid (the "heel") to the far end of the horizontal section (the "toe"). Because of the higher pressure at the heel, more fluid is forced through the created conduits at the heel than at the toe. As mentioned previously, coiled-tubing-adjustable casing sleeves and perforation distribution are both means of evenly distributing the flowrate through the conduits. In a further embodiment, the relative lateral placement of injection and production wells may be an effective means to evenly distribute flow. In embodiments, the laterals of an injection and a production well may reside in the reservoir at a similar vertical depth, but with the heels of the two laterals placed further apart than the toes, whereby the injected fluid has a further distance to flow between the injector and producer wells at the heels than at the toes. This results in a relatively lower flowrate through the heel conduit due to the increased frictional energy losses from the longer flow path. For example, if the injection and production wells were placed 400 feet apart at the heel and 200 feet apart at the toe, the fluid flowing through the conduit at the heel might suffer twice the pressure drop as that at the toe. Computer modeling is used to balance the frictional energy losses suffered by the fluid flowing from heel to toe along the injector lateral (and toe to heel in the producer lateral) against the frictional energy losses suffered by the fluid flowing a longer distance through the reservoir from the injector to the producer at the heel than at the toe. The modeling is done at a range of fluid flowrates of economic interest.

Further, to achieve optimum placement and cost it may be required to use the FEN method near the heel and DCM method near the toe of the laterals of the injector and the producer wells. In an embodiment the laterals of injector and producer wells are drilled in a reservoir at the same vertical depth in the reservoir. The heels are placed further apart than the toes. The injector is cased and cemented across the entire lateral. Approximately one half of the lateral of the producer is cased and cemented and the other half is open hole or with an uncemented casing. For example, 20 injector entry points into conduits may be placed across a 5,000-foot lateral. If a total fluid flowrate of 20 barrels per minute (BPM) were pumped from the surface, an average allocation would be 1 BPM exit the injector at each conduit entry point. However, because there is more reservoir contact area between the heels of the wells than between the toes, to achieve a stable flood-front, and so minimize bypass of heat, more fluid would need to be injected near the heel than the toe to create an identical reservoir contact time. Therefore, injection rates near the heel will need to be higher rather than evenly distributed across the horizontal section.

Reusing suspended and abandoned wells originally drilled to explore for or to produce geothermal energy or hydrocarbons may reduce the cost and risk of constructing EGS horizontal wells. In many wells drilling to the target vertical depth to start the lateral can be more than half the total drilling cost, conferring material economic advantage to this claim. In addition, reusing existing wells may hasten permitting and reduce hurdles for other environmental or regulatory requirements. The mechanical and chemical integrity and longevity of the candidate well, and the suitability of the rock formations for EGS, are first verified using well records, cased logging, and other technologies. A window is then cut in the well casing at the appropriate depth, or the well is deepened to the target depth by drilling through the casing shoe at the bottom of the well. In both cases, the "build" section, to convert the well direction from vertical to horizontal, and the lateral are then executed.

When drilling long laterals in geothermal reservoirs containing natural fractures, there is a need to isolate sections of the lateral to allow proper control of fluid movement while simultaneously preserving the natural fracture wellbore connection of zones not requiring isolation. In embodiments, a casing string may be equipped with cementing sleeves containing open and closed positions only, as well as with isolation sleeves containing open, closed, and choked positions. The sleeves may be approximately evenly spaced apart such that zones approximately 350 feet in length may be available for flow and for large cement isolation zones. Zones of lengths ranging from 30 feet to 1,000 feet or more would also be possible. The zones may be spaced appropriately such that when used with the DCM method there would be a large target for the offset well to intersect with a newly created tensile-split conduit. Likewise in reservoirs not containing natural fractures, the sealed wellbore may allow new tensile-split conduits to be created through the isolation sleeves.

Additionally, in embodiments sleeves may be open, closed, or choked with shifting dogs deployed on coiled or jointed tubing. An example of this method is the Kobold Completions system referenced in Canadian patent CA2928453C.

In embodiments, small batch-mixed slurries of cement may be pumped into the annulus between the blank casing joints and the formation to form a seal. A circulation sleeve near the heel of the well (or elsewhere in the horizontal casing) may provide a path for return fluids. The newly completed cement plugs may then be used as a seal for flow control or as an isolation method for creating new tensile-split conduits. In embodiments, conventional high-temperature cement formulations, barite, resins, or other products could be used to form sealing plugs in the annulus between the casing and the formation.

Figure 18:
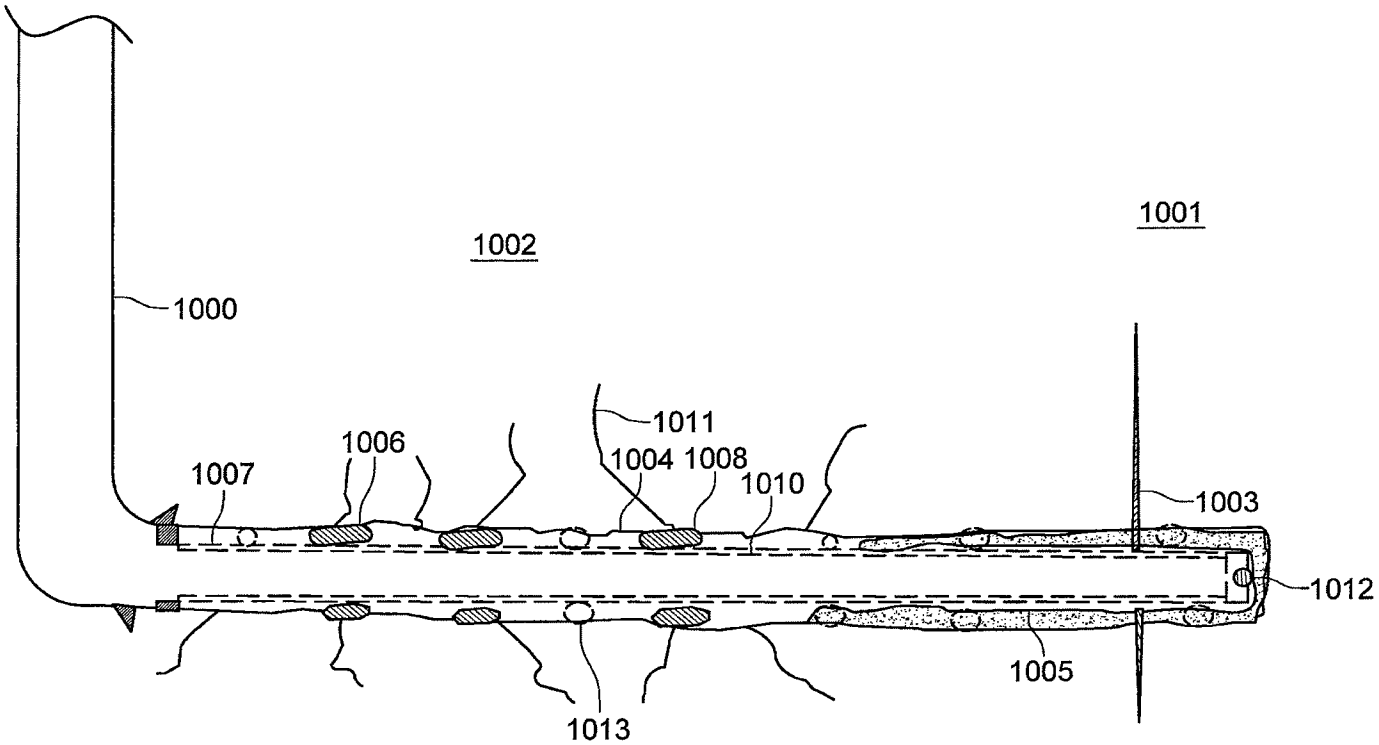
FIG. 18 illustrates an embodiment of a wellbore in a non-fractured formation and a fractured formation.

FIG. 18 illustrates a wellbore 1000 in a non-fractured formation 1001 and a fractured formation 1002. In embodiments, the lateral of well 1000 contains non-cemented sections 1004 and cemented sections 1005. In embodiments, a propped tensile-split conduit 1003 may be created in one of the cemented sections 1005 in non-fractured formation 1001. In embodiments, other sections of the wellbore 1000 in the fractured formation 1002 may contain cement isolation plugs 1006. In embodiments, a circulation sleeve 1007 may be located near the heel of the well 1000 for use as a conduit for returned circulation fluids in the casing open hole annulus. In embodiments, cemented sleeves 1008 and flow control sleeves 1009 may be placed between casing joints 1010 as desired. In embodiments, areas containing natural fractures 1011 may open for flow through flow control sleeves 1009. Likewise flow control sleeves 1009 may also be open for flow from propped tensile-split conduit 1003. In embodiments, a float shoe 1012, standoff band turbalizers 1013, and other conventional cementing accessories may also be added to enhance cement placement. In embodiments, coiled tubing and jointed tubing conventional fracturing shifting tools may be deployed to function the flow control sleeves 1009 (open/close/choke), circulation sleeve 1007 (open/close), and cementing sleeves 1008 (open/close) as desired for either stimulation or zone isolation.

Figure 19:
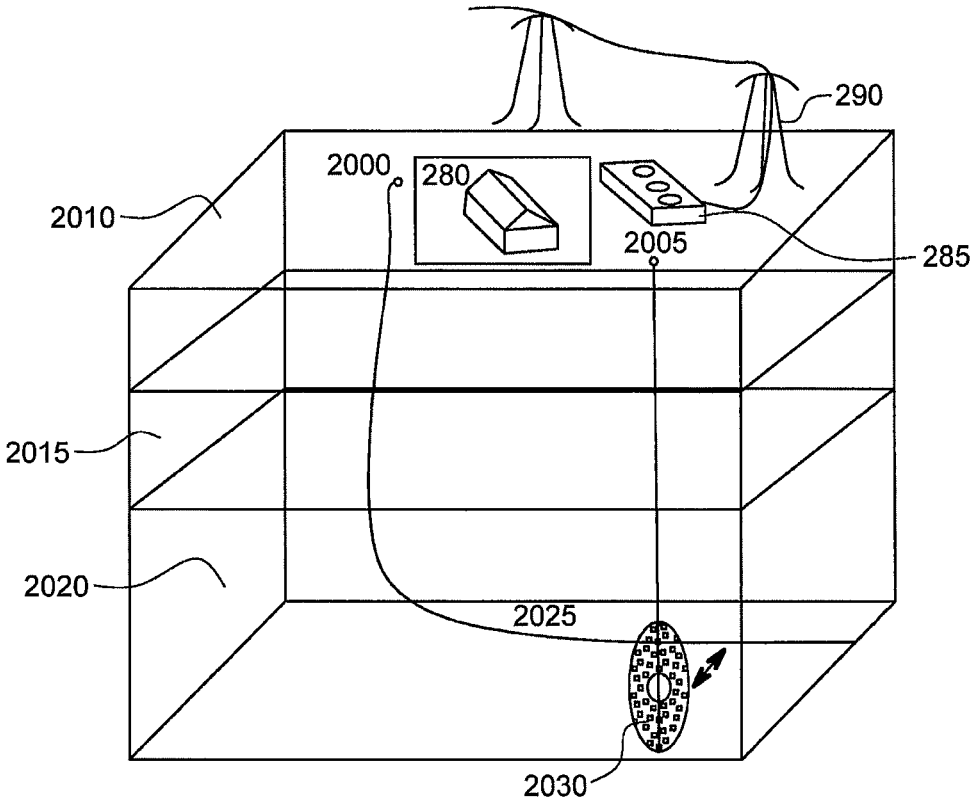
FIG. 19 is a side view schematic of a vertical and a horizontal well with a conduit emanating from the vertical well and intersecting the lateral section of the horizontal well.

FIG. 19 depicts an exemplary operating environment of an embodiment of the methods, systems, and apparatuses disclosed herein. Unless otherwise stated, the horizontal, vertical, or deviated nature of any figure is not to be construed as limiting the well to any particular configuration. As depicted, in embodiments the operating environment may suitably describe a first well 2000 and a second well 2005 that have been drilled by a conventional drilling rig or other means. In embodiments, first well 2000 and second well 2005 may emanate from a surface 2010 and intersect a geologic sedimentary formation 2015, such as a shale or sandstone formation, before passing through a geothermal formation 2020, such as a granite formation (or grano-diorite or basalt formation), forming a lateral section 2025 from first well 2000 and the vertical section of second well 2005 in geothermal formation 2020. In embodiments a vertical tensile-split conduit 2030 may emanate from perforations in the steel casing of second well 2005 and propagate in the direction of the arrows until the conduit 2030 intersects the lateral section 2025 of first well 2000.

Geologic understanding of regional rock stress can be used to place lateral section 2025 in an orientation that would have a high degree of certainty of success in connecting the two wells. Likewise, the distance between the vertical second well 2005 and the horizontal first well 2000 in the same plane could be designed to be approximately 100 feet apart or less. Drilling the vertical second well 2005 first would allow an accurate understanding of geologic conditions and enable the optimum location to place the laterals for the eventual reservoir development. The length of lateral section 2025 of the horizontal first well 2000 could be 500 feet or less depending on the degree of certainty of the regional stresses.

Figure 20B:
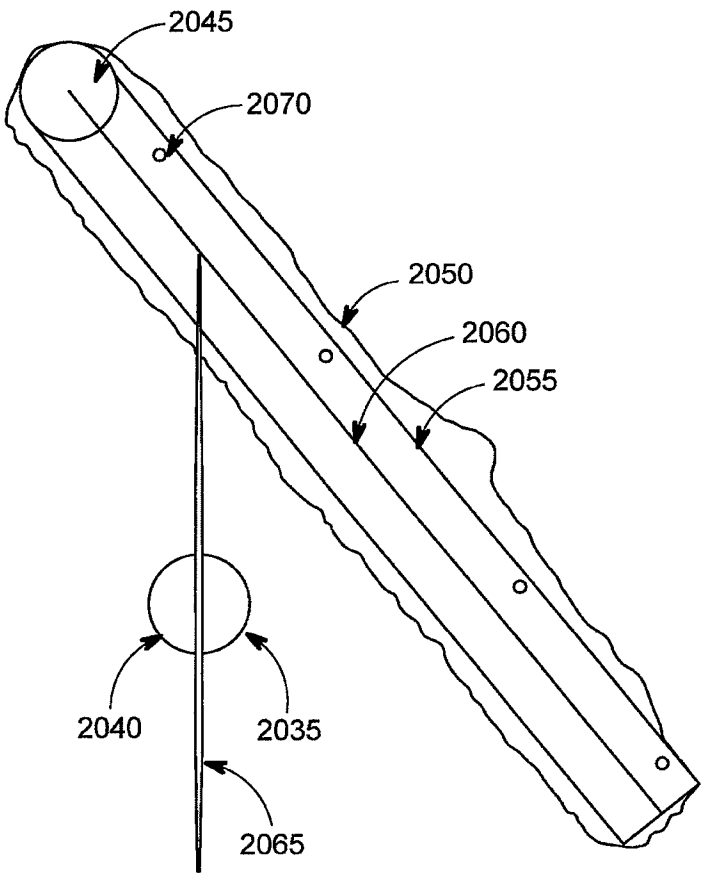
FIG. 20B is an alternative aerial view schematic for locating the propagating direction of a shear-stress induced tensile-split conduit using a vertical well, a straight lateral section of a horizontal well, and a pump-down temperature fiber.
Figure 20A:
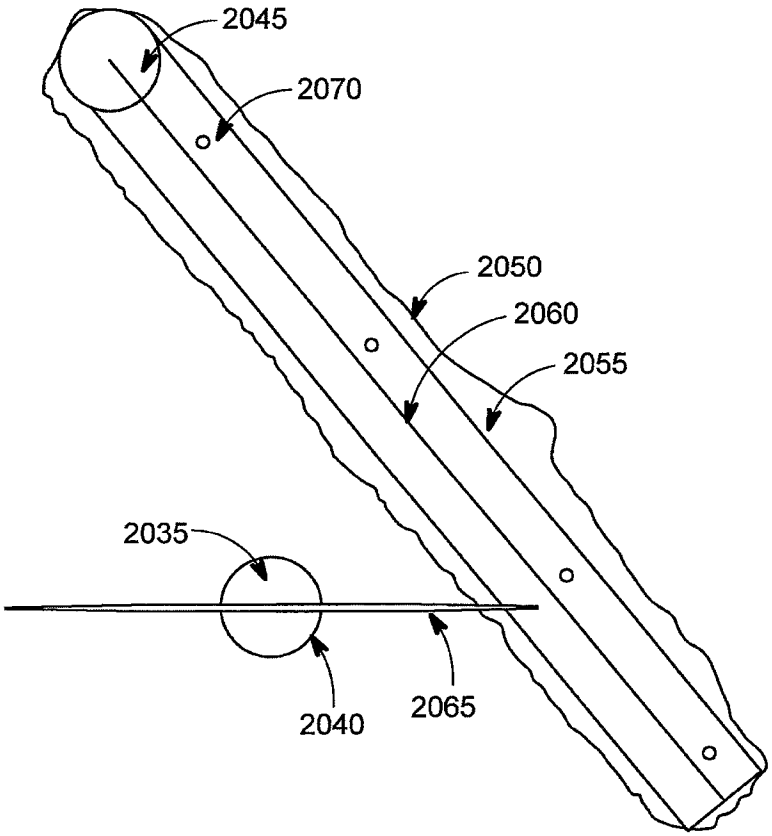
FIG. 20A is an aerial view schematic for locating the propagating direction of a shear-stress induced tensile-split conduit using a vertical well, a straight lateral section of a horizontal well, and a pump-down temperature fiber.

FIGS. 20A and 20B illustrate graphically an embodiment of a method suitably employed to identify the orientation and therefore direction of a shear-stress induced tensile-stress conduit. In embodiments, a well 2035 is a vertical well and has a casing 2040 cemented in the borehole. In embodiments, a well 2045 is a well with a horizontal lateral open hole 2050. Wells 2045 and 2035 reside in the same geothermal reservoir approximately 300 feet apart (but this could be less or much more). A depth in well 2035 may be chosen for the creation of an Enhanced Geothermal System (EGS) development as described above. The vertical well 2035 may be 300 feet deeper than the planned development depth to accommodate fracture height logs being used. The lateral open hole 2050 in well 2045 is at the same depth below sea level as the intended tensile stress initiation point in well 2035. The horizontal lateral open hole 2050 should have a hole size of approximately 6.25 inches or larger. This size would accommodate conventional 4.5-inch drill pipe if chosen for the monitoring string. Inside the lateral open hole 2050 in well 2045, a drill pipe 2055, or similar tubular string, may be run from the surface to the toe of the lateral open hole 2050. However, for most horizontal laterals larger wellbores are desired to allow higher circulation rates without incurring too high friction losses. A temperature sensing optical fiber 2060, like those marked by Halliburton under the trademarked name "Expressfiber," may be pumped at 1 to 2 barrels per minute (BPM) down the drill pipe 2055 and there is a continuous string of fiber 2060 from the surface to the toe of the well 2045. At the surface a DTS (or other appropriate) optical fiber reader may be attached to the fiber 2060. It should be noted that the fiber 2060 may be installed after connection between the injector and producer has been made.

The well 2035 may have conventional jet shaped perforating charges perforate a 4-foot section in the casing 2040, with perforations oriented in a spiral pattern to ensure perforations on all sides of the casing 2040. Alternatively, well 2035 may have a frac-sleeve cemented into the casing 2040 at the target depth. A minimum of 4-shots per foot with a minimum 0.25-inch hole may perforate the casing 2040. A shear-stress induced tensile-split conduit 2065 may be initiated by exceeding the formation breakdown pressure of typically between 0.65 and 0.75 psi per foot of depth. The pump rate may be increased and the shear-stress induced tensile-split conduit 2065 may propagate away from the casing 2040. The pump rate should be sufficient to propagate the fracture in a timely manner to overcome any volume losses due to the created conduit geometry or complexity and/or as a result of intersection with natural fractures.

For depth correlation, fluid may be pumped into the horizontal lateral open hole 2050 of well 2045 and through drill pipe 2055 and a plurality of out ports 2070 and back to the surface. Using the DTS at surface and the known location of the ports 2070, a depth correlation may be made.

Depicted in FIGS. 20A and 20B are two potential intersection points of conduit 2065 with horizontal lateral open hole 2050. At the intersection point there may be a dramatic change in temperature as the cooler conduit creating fluids intersect the well 2045 and start flowing on the outside of drill pipe 2055 and along horizontal lateral open hole 2050, to be recovered at the surface via well 2045.

In embodiments where the regional rock stresses are unknown with any degree of certainty, a horizontal lateral may be drilled in an arc, thus, increasing the probability of an intersection. It is possible to create a conduit parallel to the lateral section of a horizontal well and thus there would not be an intersection point in the configuration discussed in FIGS. 20A and 20B.

Figure 21:
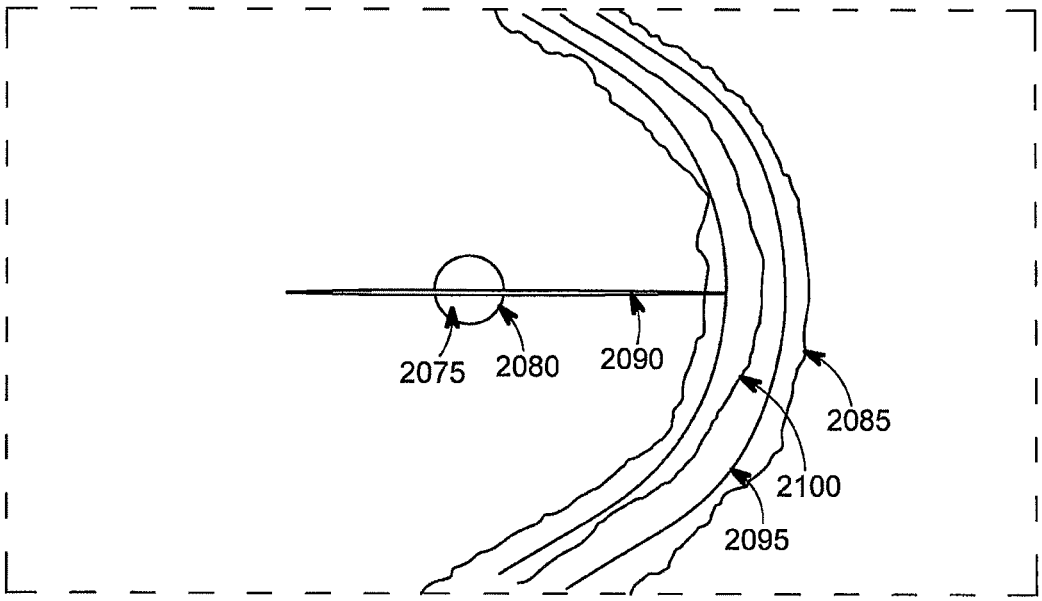
FIG. 21 is a schematic, aerial view of locating direction of a shear-stress induced tensile-split conduit using a curved lateral section of a horizontal well.

FIG. 21 depicts a vertical well 2075, with a cemented casing 2080. A horizontal lateral 2085 may be drilled at an arc such that it would be impossible not to intersect the lateral from a shear-stress induced tensile-split conduit 2090. A drill pipe 2095, or a similar tubular, may be installed in the curved lateral 2085 to carry a fiber detection system 2100.

Figure 22:
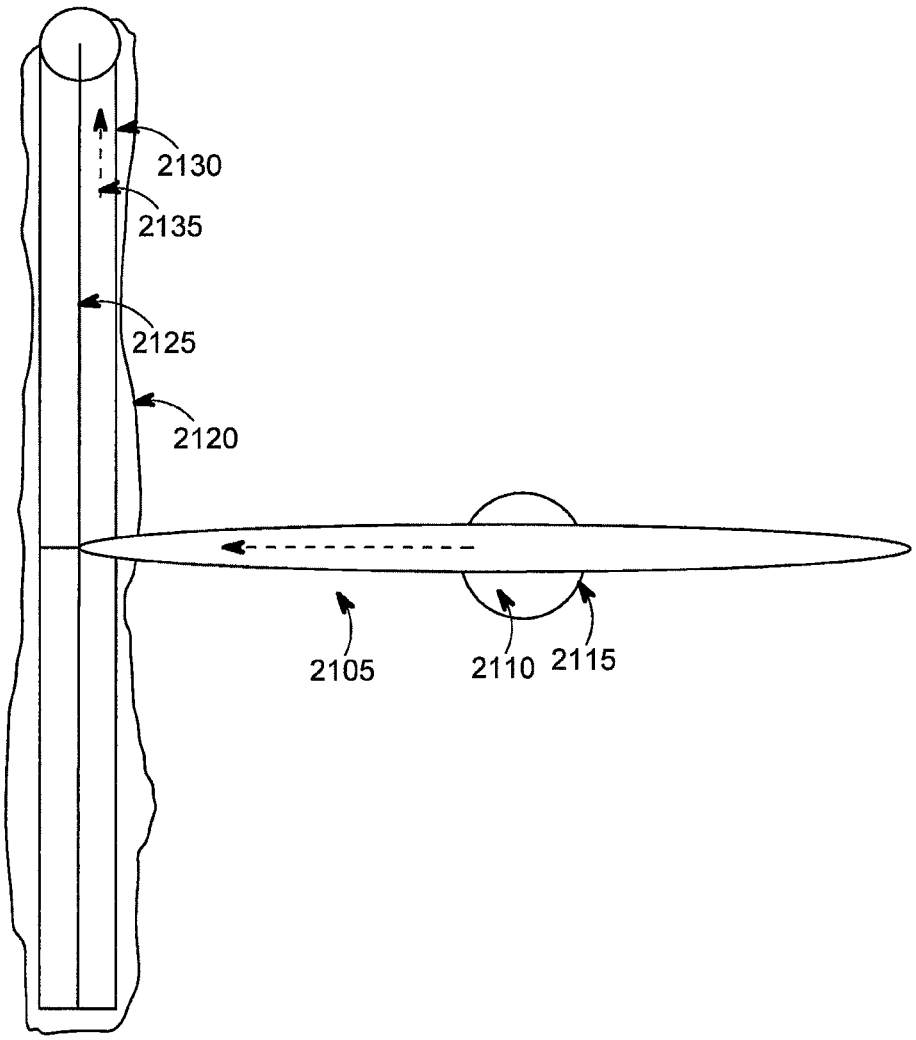
FIG. 22 shows a method for determining the transmissivity, or flow capacity, of a shear-stress induced tensile-split conduit.

In designing a development plan for an EGS Geothermal Reservoir it is important to understand the geometry of a shear-stress induced tensile-split conduit. Conduit properties like aperture-width, height, length, transmissivity, or flow capacity etc. are essential inputs to the basis of design. FIG. 22 depicts an arrangement where a conduit 2105 has been created from a vertical wellbore 2110 having a cemented casing 2115 and intersects the lateral section of a horizontal well 2120. Temperatures are monitored with a fiber 2125 installed in a tubular system 2130. The time it took to create the intersection; the volumes pumped; the fluid properties; etc. Can be captured at the time of intersection. This data can be input into computer models to estimate the geometric properties of the conduit 2105. As shown in FIG. 22 additional geometric properties may be calculated by continuing to pump and measuring temperature changes to the fiber 2125 over time and the fluid return to surface via an annular flow path 2135. The pump rate can be varied by applying back pressure on the well 2110 to simulate down hole producing conditions. Proppant can then be pumped, and changes observed. The wells 2110 and 2120 may be depressured and then pumping can then be restarted to understand the pressure required to initiate injection with a closed conduit. Tests may be conducted by injecting larger and larger volumes of proppant from the injector to find a suitable loading for eventual production design.

Once connection has been made between the injector vertical wellbore 2110 and producer horizontal well 2120 it may be desirable to reverse the directions of the arrows shown in FIG. 22 and inject into wellbore 2120 through conduit 2105 and produce in wellbore 2110. This would allow better definition as cooler fluids or higher rates may indicate a more drastic change in the response on the fiber 2125.

Figure 23:
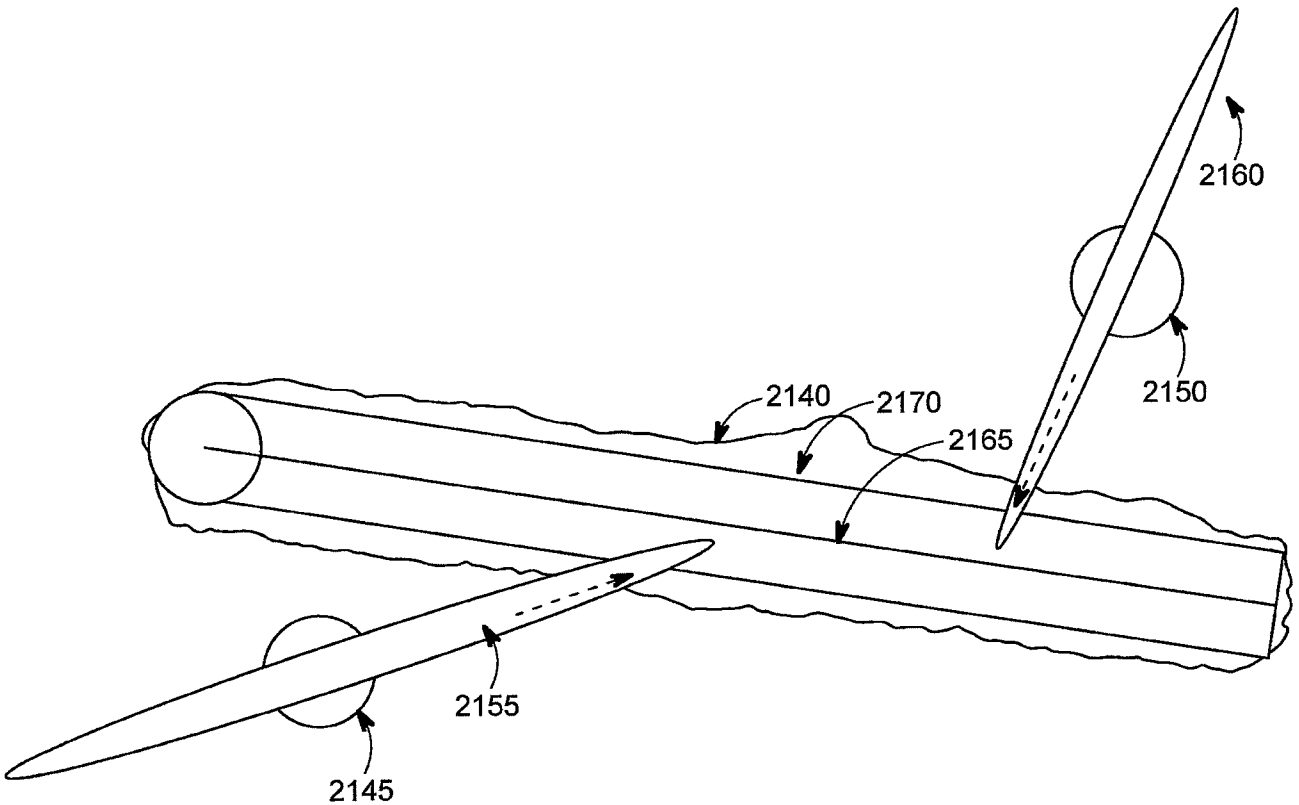
FIG. 23 is a schematic, aerial view of determining the shear-stress induced tensile-split conduit at two different locations in a geothermal reservoir.

Rock stresses in a reservoir may not be uniform or constant from one point in the lateral to another, either initially or as a result of induced shear stresses during tensile-splitting operations. In tectonically active areas there can be significant changes in in-situ stresses across the reservoir. To properly design an EGS development the orientation of future shear-stress induced tensile-split conduits must be understood. FIG. 23 depicts a method where a long lateral section of a horizontal well 2140 has been drilled across the reservoir. Both a vertical well 2145 and a vertical well 2150 have created shear-stress induced tensile-split conduits 2155 and 2160 in the reservoir rock intersecting the lateral 2140 at two different orientations. Temperatures are monitored with fiber 2165, installed in a tubular system 2170.

Figure 24B:
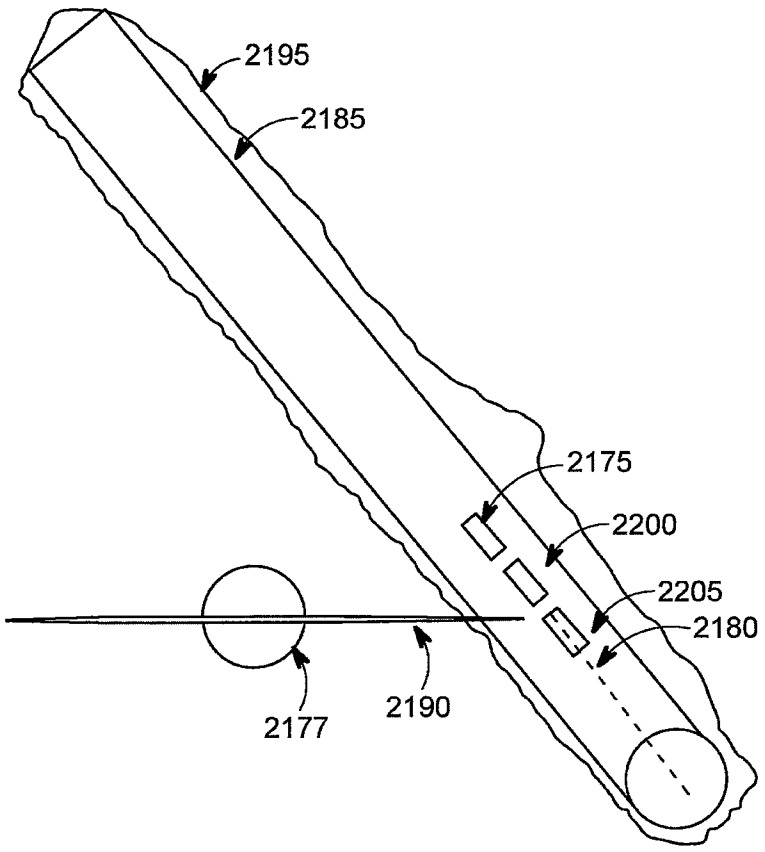
FIG. 24B is an alternative aerial view of a method to determine the intersection of a conduit and the lateral section of a horizontal well using temperature or gamma ray pump-down logging tools.
Figure 24A:
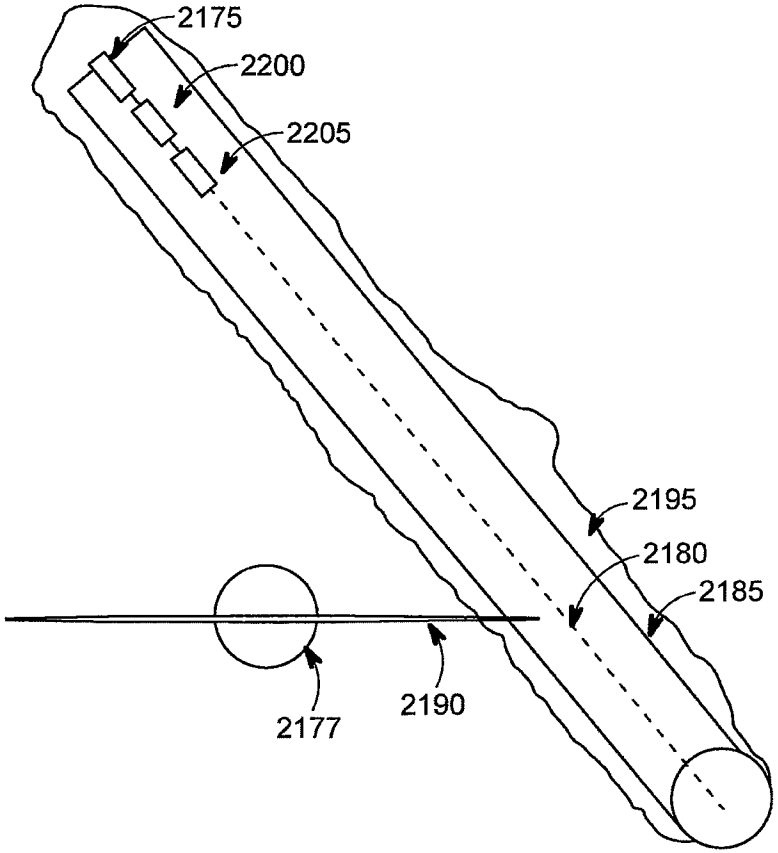
FIG. 24A is an aerial view of a method to determine the intersection of a conduit and the lateral section of a horizontal well using temperature or gamma ray pump-down logging tools.

There are alternatives to using a fiber for the determination of the intersection point of a shear-stress induced tensile-split conduit emanating from a vertical well 2177 and intersecting the hear-horizontal lateral of a horizontal well. FIGS. 24A and 24B depict the lateral sections of horizontal wells without a fiber installed. FIG. 24A depicts conventional temperature tool string 2175 attached to a conventional electric line braided wire 2180 and pumped to the toe of a well 2195 via the tubular string 2185. After intersection of the shear-stress induced tensile-split conduit 2190 with the lateral of horizontal well 2195 the temperature tool string 2175 is slowly retracted. FIG. 24B shows the location where a significant temperature change has been noticed indicating the intersection point.

FIG. 24B also depicts a gamma ray tool 2200 and a collar locator tool 2205 which can be run in tandem or separate from temperature tool 2175. For example, if radioactive sand were pumped in the stimulation fluid to create conduit 2190 it would be advantageous to run gamma ray tool 2200. Additionally, for correct depth control it would be advantageous to run collar locator tool 2205 with both of these logging options.

Although FIGS. 24A and 24B show tools being deployed by pumping, alternate deployment systems could be used, for example coiled tubing or wireline tractors.

In place of real-time tools transmitting data to surface on a fiber or wire it would be possible to run memory tools. They could be pumped down and retrieved via the use of a slickline type cable to reduce costs and surface footprints.

The above methods and procedures could also be used in cases to determine the orientation of natural fractures or fissures where a vertical well and the lateral of a horizontal well intersect the same natural fractures or fissures, by pumping from the vertical well to the lateral and finding the intersection point or points. If more than one intersection were found, this could point toward a much more complex fracture network.

Another embodiment shows a method to identify the number and potential orientation of a complex network of natural fractures or fissures in the rock. FIG. 25A depicts the lateral section of a horizontal well 2210 that has been drilled in a geothermal rock formation containing a multitude of natural fractures or fissures 2215. These fissures 2215 intersect the lateral section of horizontal well 2210 at many different orientations. Inside the lateral section of well 2210 is a tubular 2220 extending from the surface to the toe of the lateral section of well 2210. Tubular 2220 carries a fiber 2225 extending from the surface to the toe of the well. At the surface the fiber 2225 is attached to a DTS unit or other appropriate device to decode temperature, sonic or other properties that the fiber 2225 has been designed to detect. In a preferred embodiment the fiber 2225 has been configured to record temperature. Cooler-than-reservoir-temperature fluid has been pumped from the surface and has exited from frac sleeve ports 2230 or perforation clusters. Temperature of the fiber 2225 has been monitored to measure the approximate location of the potential fissures that are transmitting fluid. In embodiments, an observation well 2232 may be employed as well. After pumping, the temperature on the fiber 2225 is monitored as it warms. In FIG. 25B is shown a fissure 2235 oriented at approximately 25-35 degrees to fiber 2240. The temperature response on fiber 2240 will be elongated. In FIG. 25C is shown a fiber 2145 and a fissure 2150 oriented 90 degrees to the fiber 2145. The temperature response on fiber 2145 will be narrower than the response on fiber 2240 in FIG. 25B.

One of the primary differences in drilling horizontal wells versus vertical wells is the use of downhole motors and directional measurement assemblies in horizontal wells to the kickoff point and to create a horizontal or near horizontal wellbore. Some vertical or slightly deviated wells may use these tools for a short period to achieve a certain angle but are typically not used for the entire well.

One of the other primary differences is the potential to intersect multiple fracture systems at various states of depletion. This can cause downhole cross-flow issues from one natural fracture system to another.

Some authors, like those in patent CA3100013 assigned to Eavor Technologies Inc., recommend a method to sequentially seal fractures in underground reservoirs as the well is being drilled. This option is only limited to those completions where flow of hot-reservoir fluids is not wanted.

Figure 26:
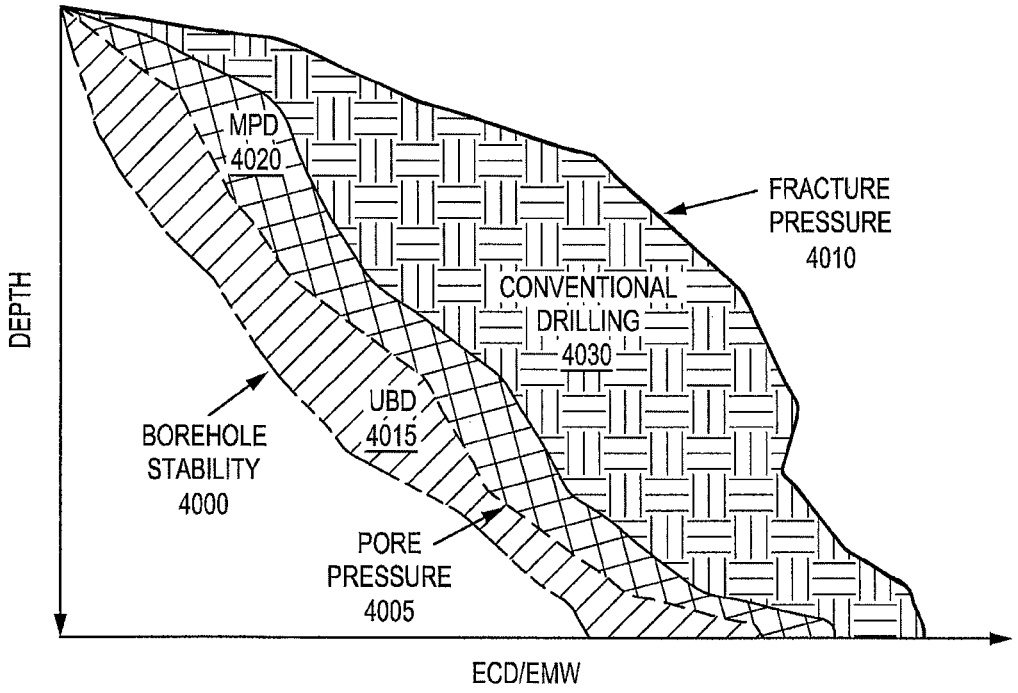
FIG. 26 is a line chart depicting the operating windows for Under Balanced Drilling (UBD), Managed Pressure Drilling (MPD), and Conventional Drilling in a reservoir between the borehole stability and fracture pressures.

FIG. 26 is a chart depicting the operating pressure window a well must stay within. On the Y-axis is depth, and on the X-axis is Effective Circulating Density (ECD) and/or Effective Mud Weight (EMW), which are equivalent terms (hereinafter collectively ECD) for the pressure exerted on the rock by the density of the drilling fluid column plus the pressure exerted by the fluid circulating. On the low end of the scale, the static density of the drilling fluid column must apply sufficient pressure to prevent borehole collapse or stability. On the other end of the scale is the maximum pressure that can be exerted on the formation without fracturing. Between the two extremes are three operating windows available to the driller.

The first method is Underbalanced Drilling (UBD) 4015 where the pressure exerted by the ECD is intentionally lower than a rock pore pressure 4005 when drilling through porous rock, or of a borehole stability pressure 4000 when drilling through non-porous impermeable rock. This may be accomplished by aerating the fluid.

Blind or partial returns of mud fluid (where some of the circulating fluid is lost in natural fractures) has a similar effect to UBD 4015 since the resulting intermittent circulation rates cause the overall fluid weight to be lower than the rock pore pressure 4005.

The second method is Managed Pressure Drilling (MPD) 4020 where the pressure exerted by the ECD is approximately equal to the rock pore pressure 4005. The third method is Conventional Drilling 4030 where the ECD is greater than the rock pore pressure 4005 (or borehole stability pressure 4000 in non-porous rock) but lower than a rock formation fracturing pressure 4010.

Tables 3-6 below address when and how each method is used.

TABLE 3

| Under Balanced 4015 | |
|---|---|
| Relative Fluid Hydrostatic | The drilling fluid has a density which exerts a hydrostatic pressure lower than the rock pore pressure 4005 but greater than the minimum borehole stability pressure 4000. This is commonly accomplished with the injection of a gas (e.g., nitrogen or air) into the drilling fluid at surface to reduce drilling fluid density. |
| Applications/ Objectives | This technique can be applied to create drilling fluid returns to surface that are not possible with conventional drilling fluids because of unfavorable combinations of rock pressure 4005, porosity, and permeability/fractures. In this environment, this technique has the following benefits:<br>Allows for effective drill cuttings removal which minimizes the likelihood of nonproductive time (NPT) events.<br>Minimizes the volume/costs associated with drilling fluid losses.<br>Can be used as a method to extend casing string setting depth. |
| Well Control Mechanisms | Well control during drilling is maintained by the ECD of the modified fluid and cuttings in the well and the use of surface equipment designed to process the planned production of well fluids.<br>During routine replacement of drill bit and/or Bottom Hole Assembly (BHA) components (tripping), the well is constantly "fed" fluid from surface to minimize influx of formation fluids. |
| Specialized Surface Equipment | Standard drilling equipment plus:<br>Rotating Blow Out Preventer (RBOP) installed on top of the Blow Out Preventer (BOP). This equipment creates a pressure seal around the drill string at surface and is used to create well back pressure.<br>Fluid separation and measurement equipment.<br>If required (e.g., Nitrogen) generation/storage and injection equipment. |

TABLE 4

| Blind or partial returns | |
|---|---|
| Relative Fluid Hydrostatic | The drilling fluid hydrostatic pressure is greater than the rock pore pressure 4005, and fractures or zones of very high permeability are present which result in intermittent drilling fluid returns ('partial returns') or 100% loss of drilling fluid ('blind'). |
| Applications/ Objectives | This technique can be applied when a limited drilling distance is necessary to complete the hole section. It is not normally applied to long drilling distances as the risk of NPT is high because the drill cuttings are not being effectively removed from the well. |
| Well Control Mechanisms | Well control is maintained by the ECD of the fluid and cuttings in the well. If an unexpected, high-pressure zone is encountered that exceeds the ECD, well control is maintained with the use of surface Blowout Preventers (BOP) and fluid circulation chokes. |
| Specialized Surface Equipment | Standard drilling equipment |

TABLE 5

| Managed Pressure 4020 | |
|---|---|
| Relative Fluid Hydrostatic | The drilling fluid hydrostatic pressure plus surface back pressure is precisely controlled to be equal to or slightly greater than the rock pore pressure 4005. This technique may or may not include the use of Nitrogen or other gas to reduce the density of the drilling fluid. |
| Applications/ Objectives | This technique can be applied towards any of the following objectives:<br>Improve ROP.<br>Minimize fluid losses or fluid invasion.<br>Extend casing string setting depth. |
| Well Control Mechanisms | Well control during drilling is maintained by the ECD of the fluid and cuttings in the well and the use of surface equipment designed to process the planned production of well fluids.<br>During routine replacement of drill bit and/or Bottom Hole Assembly (BHA) components (tripping), the drilling fluid is typically replaced with a fluid with a higher density to create a hydrostatic pressure slightly greater than rock pore pressure 4005. |

TABLE 5-continued

| Managed Pressure 4020 | |
|---|---|
| Specialized Surface Equipment | Standard drilling equipment plus:<br>Rotating BOP (RBOP) installed on top of the drilling rig BOP. This equipment creates a pressure seal around the drill string at surface and is used to create well back pressure.<br>Fluid separation and measurement equipment.<br>If required, gas (e.g., Nitrogen) generation/storage and injection equipment. |

TABLE 6

| Conventional 4030 | |
|---|---|
| Relative Fluid Hydrostatic Applications/ Objectives | The drilling fluid hydrostatic pressure is significantly greater than the rock pore pressure 4005.<br>Most common method of drilling and is applied when manageable well hazards are present, and rock formations being penetrated are either not sensitive to fluid invasion or will be stimulated. |
| Well Control Mechanisms | Well control is maintained by the ECD of the drilling fluid and cuttings in the well. If an unexpected, high-pressure zone is encountered that exceeds the well ECD, well control is maintained with the use of drilling rig surface Blowout Preventers (BOP) and fluid circulation choke(s). |
| Specialized Surface Equipment | Standard drilling equipment. |

Figure 27:
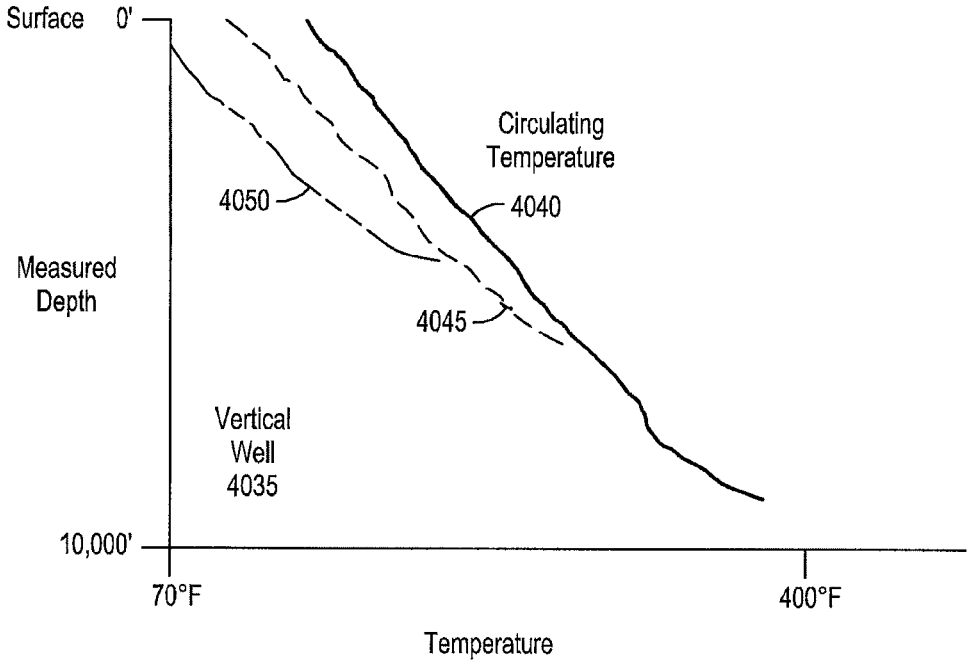
FIG. 27 is a line chart of measured depth versus reservoir temperature for a typical vertical well at three different depth progressions.
Figure 28:
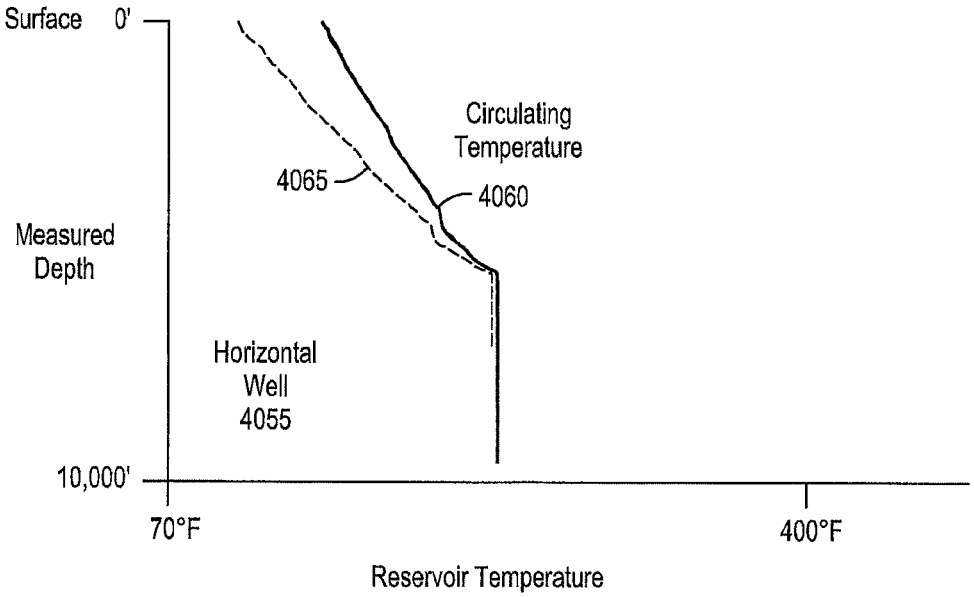
FIG. 28 is a line chart of measured depth versus reservoir temperature for a typical horizontal well at two different depth progressions.

Both bottom hole and surface drilling fluid temperatures behave differently in vertical versus horizontal drilling. As shown in FIG. 27 with regard to a vertical well 4035, the surface drilling fluid temperature will increase proportionally as the vertical well 4035 is deepened, assuming the geothermal gradient remains constant with depth. Curve 4050 shows the wellbore temperature profile at an initial depth. Curve 4045 shows the wellbore temperature profile at an intermediate depth, and curve 4040 shows the wellbore temperature profile when the well has reach its final total depth. FIG. 28 shows the horizontal drilling case wherein the surface drilling fluid temperature will increase at a different rate/depth than in FIG. 27 as wells are deepened. Curve 4065 shows the temperature profile when the well has reached an intermediate depth and 4060 shows the downhole temperature profile when the well has reached its final total depth.

Penetrating naturally flowing fractures while drilling can accelerate the increase in drilling fluid temperatures because heat conduction from the solid rock is enhanced by advection and convection from the naturally flowing fractures.

Figure 29:
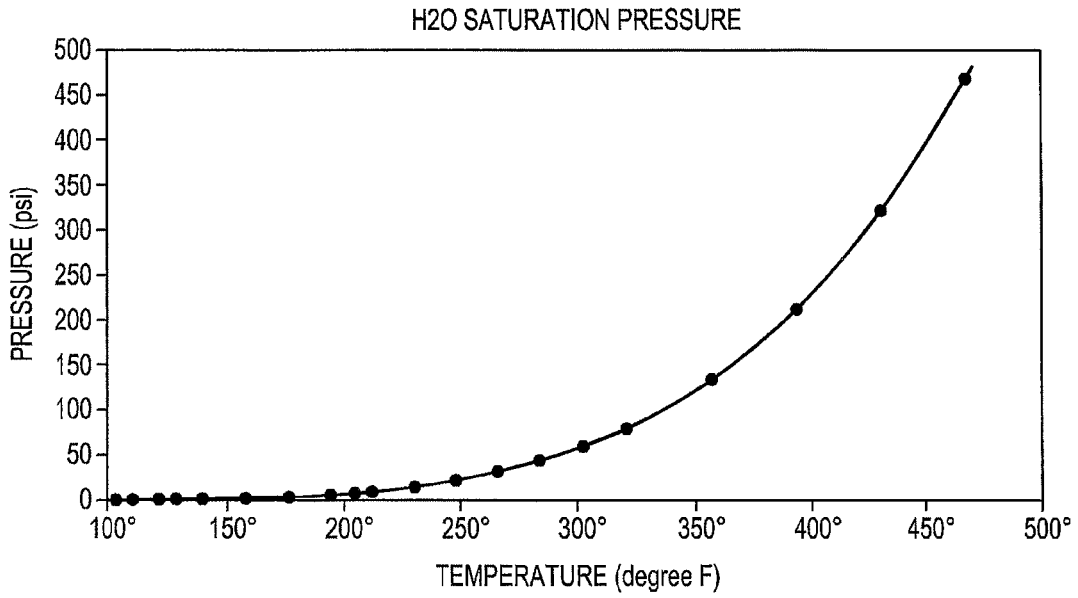
FIG. 29. Is a line chart of the saturation pressure of fresh water versus temperature.

An additional consideration is drilling at elevated drilling fluid circulating temperatures. Referring to FIG. 29 for the relationship between the water saturation pressure and temperature.

If the drilling fluid returns to surface at temperatures greater than 100 degrees Celsius (212 degrees Fahrenheit), back pressure is required to prevent the water/mix from flashing to steam in the well, which would create a dangerous well control situation. For example, if the drilling fluid returns to surface were about 200 degrees Celsius (292 degrees Fahrenheit), about 1.5 Mpa (220 psi) back pressure would be necessary to prevent the fluid from flashing to steam in the well.

While drilling, a rotating head is required to maintain the necessary back pressure. At surface, a choke and separator are used to vent the steam and return the remaining water to the mud pits for further cooling before pumping back down hole. A continuous supply of fresh water is required to make up for the fluid loss to steam.

With regard to high-temperature elastomer seals, EPDM (ethylene propylene diene monomer) synthetic rubber elastomers rated to as high as 250 degrees Celsius (482 degrees Fahrenheit) can be used in the BOP, rotating head, and other pressure containing equipment.

Ensuring equipment suitability at extreme temperatures is only part of the risk as this environment creates significant HSE risk that must be effectively managed.

As to potential hole collapse, when drilling horizontal wells in fractured reservoirs there is a heightened probability of hole collapse. Rubble zones may accumulate where the hole intersects fractures.

Detailed precautionary measures to minimize the hole collapsing and the drill-string sticking are presented below. And in cases of drill-string sticking, methods to minimize financial loss of tools and to enhance the chance of recovery are also presented.

- Drilling—measure the return flow rate to calculate whether the well fluid is in turbulent flow. Maintain mechanical agitation through rotation and reciprocation of the drill string.
- Conduct regular wiper trips to ensure the well stays clear and free of cuttings build-up.
- Blind drilling may be more advantageous than aeriated muds if only a very short section of hole is to be drilled.
- It may be possible to detect fractures through an increase in a specific mineral like calcite, or the occurrence of small fractures in the cuttings.

The following is an explanation of the pre-planning phase. Review offset drilling information and other available records:

- Expected list of formations and associated lithological description and depths
- Anticipated mud/strip logs to identify shows and cuttings description etc.

Historical well design
Identifying potential drilling hazards (lost circulation, over pressure, borehole instability).
ROP and bit type planned
Anticipated NPT summary
Anticipated drilling fluid circulating temperature
Evaluation activities i.e. core, DST, open/cased hole logging, testing
Define well design parameters:
Sub surface target definition:
Final Well Depth (True Vertical, lateral length if Hz)
Target entry coordinates and profile
Production/Injection flow rate
Fluid composition, temperature, pressure
Completion design and stimulation method
Evaluation requirements during drilling/frac/test/production
Completion/stimulation
Drilling hazard registry
Lithological definition
Pore pressure profile
Design the well to minimize friction or minimize parasitic loads:
Design well production casing and tubing for proper metallurgy to minimize corrosion.
Design well to limit friction flowing or circulation or injection pressures to less than 10% of produced electrical capacity generated on-site with reservoir fluid.
Design well location to minimize surface use but still allow simultaneous operations of workovers or completion activities.

Establish preferred surface location/options: The surface location for the well should be picked after analyzing the geologic layout of fractures and rock stresses and surface constraints like roads, population centers, electrical transmission facilities, water availability and options of water discharge.

Geological constraints and hazards:
major fractures and their direction
regional rock stresses
formation permeability and composition
till etc.
Regulatory design requirements e.g. base of ground water etc.
Surface proximity to population centers, electrical transmission facilities, road access for heavy and wide equipment.
Water availability for drilling, stimulation, cooling, etc.
Water discharge options
Cuttings disposal options Pilot well detailed planning and field execution: A vertical pilot well should be drilled to capture geologic reservoir information as well as temperature and interaction between drilling bits and methods. The drilling of this well can either be a decision point to stop the investment or the well could be used as a kickoff point for a horizontal lateral or as an observation well or used to assist in determining the direction of induced or natural fractures.

Establish program objectives
Develop conceptual well design, operations plan and budget class cost estimate
Assess risks and probability of success-pilot hole
Pilot well investment decision:
Prepare detailed well design, AFE class cost estimate and detailed operations plan
Drill and evaluate/test vertical pilot well
Assess risks and probability of success-horizontal pilot hole
Take core and other electrical logs to evaluate for future stimulation or production options
Test whether electromagnetic tools will transmit data in through the formations to surface.

Once the pilot well has been drilled the well may be used as a kickoff point for a horizontal well, as a vertical producer if it intersected natural fractures, or as an observation well for obtaining orientation of stimulated tensile-shear conduits using micro seismic, or long-term reservoir temperature measurements.

Horizontal well investment decision:
Plug back, kick off, build to Horizontal, option to set liner
Drill horizontal/lateral section
Evaluate and test—open hole horizontal section
Complete and suspend well as required
Observation well investment decision:
Stimulation
Fracture Orientation
Reservoir Temperature Measurement It is also important to mitigate operational risks. There are two primary operational risks which may be encountered with drilling long horizontal laterals in hot geothermal rock with natural fractures. The situation may be exacerbated in existing rock where fluids may have been drained in some fractures, but others may be at original pressure or even be above original pressure in trapped zones.

There is a risk of lost circulation where drilling fluids may be leaking off and no longer reaching the surface or even crossflow in the lateral from one fracture system to another. These losses may result in improper hole cleaning with cuttings debris piles forming in the lateral.

In a preferred embodiment, as the well is being drilled, close observation is made of the drilling fluid returns to the surface measuring the return fluid flow rate to ensure there are no losses. If losses were to occur the drill string would be pulled back and the situation evaluated before proceeding.

In another preferred embodiment, a low-cost drilling assembly would be run in case it became stuck and could be abandoned in the hole.

In another preferred embodiment, Managed Pressure Drilling 4020 or Underbalanced drilling 4015 methods may be used to ensure all cuttings are removed from the well. These types of methods typically are used in conjunction with EM measurement (survey) tools.

There is a risk of wellbore instability when drilling long laterals in hot geothermal naturally fractured formations. In this instance, the entire sections of the hole may collapse. This may occur because the formation is unconsolidated or from a drop in downhole pressure due to drilling fluid losses.

In a preferred embodiment, when drilling in a reservoir suspected to have hole stability issues special precautions must be taken. These include drilling only short sections (+/−3 meters) (+/−10 feet) of new hole at a time; continuously ream/clean the hole and conduct regular wiper trips of the entire open hole sections.

The operator should have ready access to wireline pump-down tools to locate where the drill string is stuck (free point indicator), and either sever (cut) the drill string at the point it is stuck or apply reverse torque and set off a charge to break and unscrew the connection above the stuck point. Lower cost mud motors and survey tools may be used to reduce the cost if needed to be abandoned.

Elastomers and electronic components of directional drilling survey tools may have limits on exposure times to elevated downhole temperatures. In a preferred embodiment, MPD 4020/UPD 4015 methods should be employed and should include:

Cool the drilling fluid returns using surface heat exchangers (mud coolers).

Dump/dilute a portion of the drilling fluid returns with fresh, ambient temperature water.

Utilize drilling pipe coatings as insulation to reduce the heat exchange capacity across the drill string.

In a preferred embodiment a cementing stage collar or sliding sleeve is inserted into the intermediate casing string. After cementing the intermediate casing, the annulus between the surface and intermediate casing is used as a conduit to pump cooling fluid to reduce the temperature of the fluid in the drill pipe which is being used to cool the downhole tools.

Maintaining proper fluid circulation by using MPD 4020 and UPD 4015 drilling methods while keeping close observation of drilling fluid rates and pressures is key to drilling hot naturally fractured geothermal reservoirs. Once the well has been drilled, completion designs may then be implemented to configure the well to produce the optimal amount of heat energy.

Figure 30:
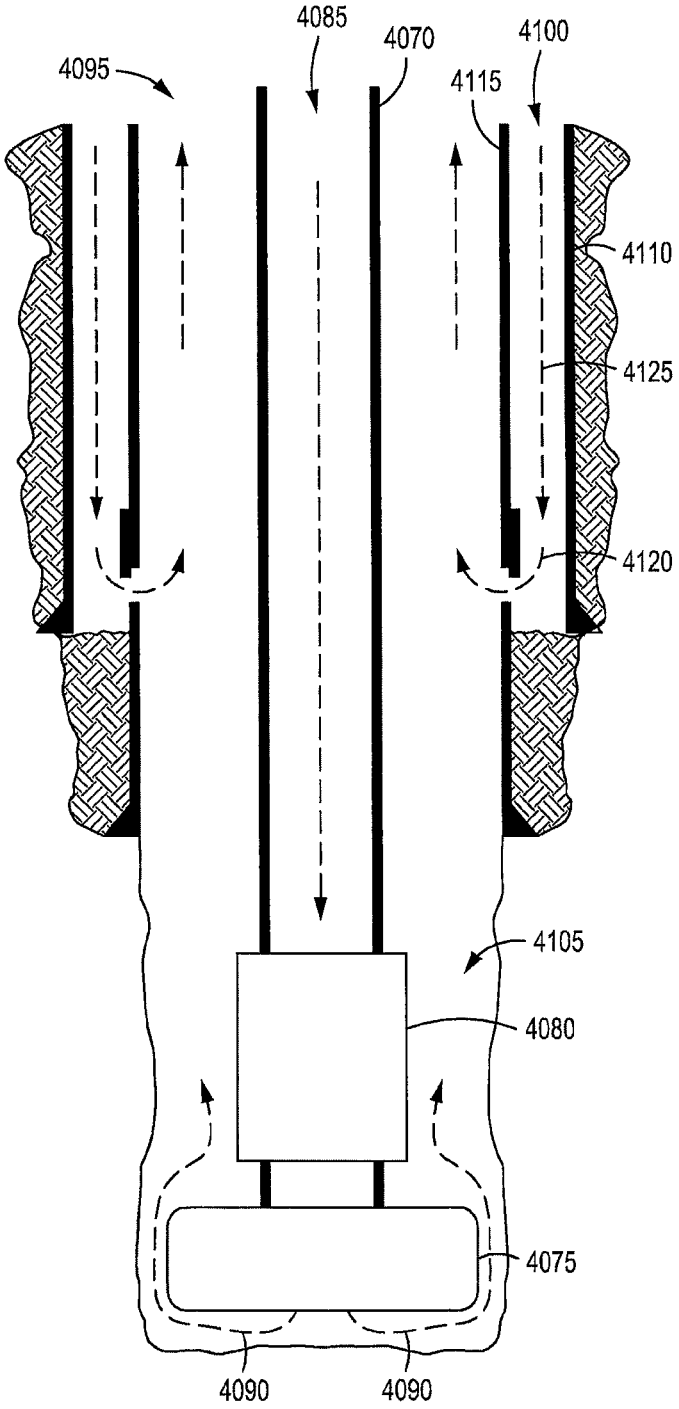
FIG. 30 is an embodiment of a casing design to provide additional drilling cooling water downhole to cool the drill string and MWD/LWD tools.

FIG. 30 depicts an exemplary operating environment where additional fluids are capable of being added to the fluid stream of a drilling well to assist in cooling the drilling fluid. A drill pipe 4070 is attached to a bit 4075 and downhole survey and formation measurement tools 4080. For conventional drilling purposes, primary drill fluid 4085 is pumped down drill pipe 4070 through tools 4080 and out bit 4075. Flow paths 4090 may flow in the direction of the arrows and up through a casing drill pipe annulus 4105. Along the way, the drill fluid 4085 is heated by the formation. To provide cooling of the fluid 4085, additional drilling fluid 4100 is pumped down a second annulus 4125 between a surface casing string 4110 and an intermediate casing string 4115 passing through a stage collar 4120. Stage collar 4120 may have previously been used to provide the conduit for cooling fluid 4085 after the cementing of casing string 4070. After the drilling has been completed, the second annulus 4125 between drill pipe 4070 and surface casing 4110 may be filled with cement and the stage collar closed. The amount of cooling which will be afforded to the primary drill fluid 4085 will be a function of the temperature of the formation from surface to stage collar 4120, the rate at which is pumped and the initial temperature and rate additional drilling fluid 4100 rate.

Figure 31:
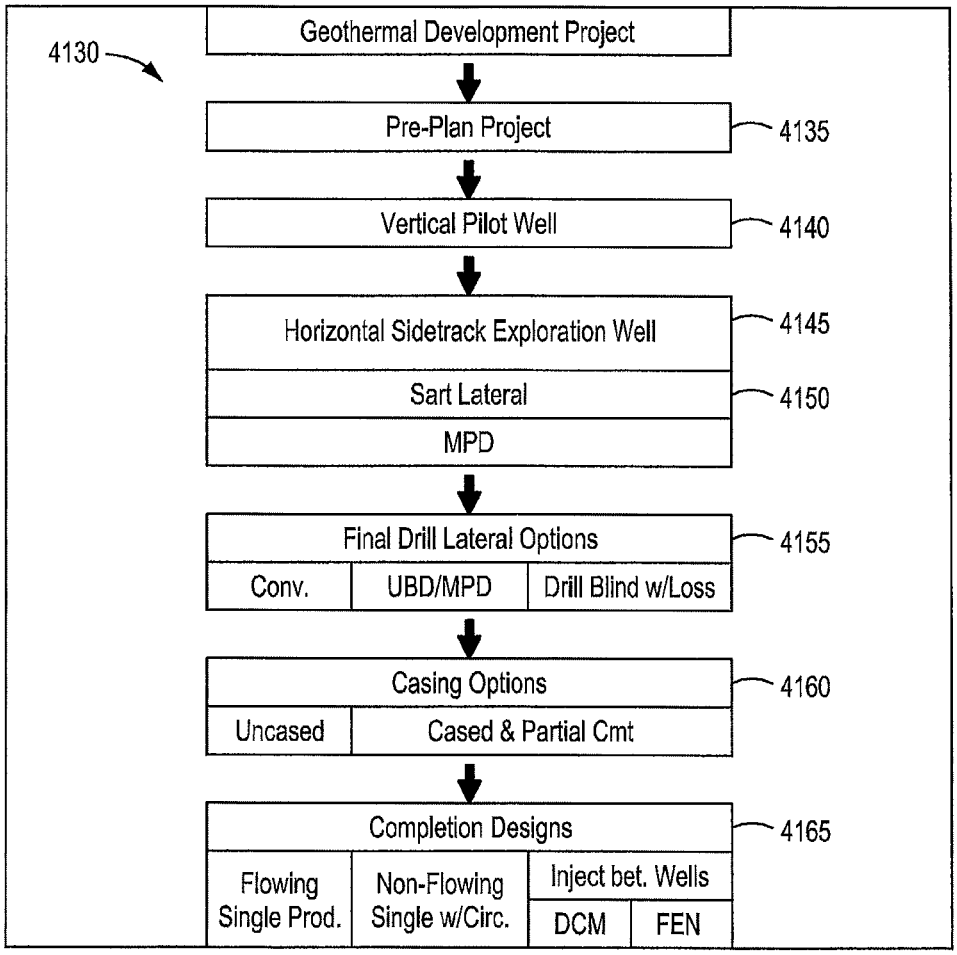
FIG. 31 is an embodiment of a decision tree flow chart to determine the optimum method to drill and complete geothermal reservoirs containing natural fractures and or non-fractured formations.

FIG. 31 is a flowchart of a Geothermal Development Method 4130 for geothermal reservoirs which may contain natural fractures, according to certain illustrative methods of the present disclosure. Using the embodiments described herein using managed pressure drilling at block 4155, and well isolation casing scheme at block 4160, for example, a fractured geothermal reservoir with built in isolation and flow control may be achieved. Alternatively, or in addition to, the isolation casing scheme may be also used from which to generate block 4165 DCM or FEN tensile-stressed conduits to connect multiple horizontal wells.

Method 4130 may be used from the pre planning of the development in block 4135 through the drilling of the pilot hole in block 4140 and into the drilling of the start of the horizontal lateral in block 4150, through the drilling of the lateral in block 4155, appropriately casing the lateral in block 4160 and into the final stimulation or completion of the lateral combined with other wells in block 4165.

In the preplanning of method 4130, block 4135, the location, number of wells, lengths of laterals, and information to be gained from the pilot hole is planned.

In the pilot well drilling block 4140 of method 4130, the drilling parameters are learned, rock properties are taken, induced and or natural fracture directions may be understood and the final plan for the drilling of the horizontal lateral is made.

In the start of lateral block 4150 of method 4130, drilling parameters are understood, including drilling speed, reservoir pressure and temperature, and localized natural fracture conductivity for flowing or drilling losses.

In the drilling of the lateral in block 4155 of method 4130, the optimum drilling method is determined. For example, if it is determined to drill underbalanced, air may be added to the drill fluid to use the UBD 4015, or losses may be tolerated, and the drill blind method may be used.

In the casing option block 4160 of method 4130, the final completion casing selection can be made. For example, if the cased and partial cement method is chosen then the location of cementing sleeves, frac sleeves and cement isolation zones are chosen and implemented. If it is determined to use either EGS completion method DCM or FEN then appropriately placed cemented sections will be implemented and fracture collars installed at the appropriate location.

In the final completion design block 4165 of method 4130 the casing configuration chosen from block 4160 is implemented. For example, it may be chosen to open all the sleeves and equip the well with a closed loop single well circulating fluid production method.

FIGS. 32A-F disclose an illustrative process of the method to determine the optimum techniques to drill a horizontal lateral in a geothermal reservoir with or without natural fractures.

FIG. 32A depicts a vertical well 4170 being drilled in a geothermal heat reservoir 4175. The well 4170 has intersected a natural fracture 4180. If the natural fracture 4180 produces with sufficient volume, then there would not necessarily any need to drill a horizontal lateral and may proceed as is. However, if greater volume is desired then a horizontal lateral may be added.

FIG. 32B illustrates the vertical well 4170 being drilled in the geothermal heat reservoir 4175 where no natural fractures have been encountered. This type of vertical well 4170 would not be suitable as is for a geothermal producer. This well 4170 could be used to obtain formation properties derived from core or electric logs to aid in determining which direction and at what depth a horizontal lateral could be placed. This well 4170 could also be used to aid in determining natural and induced fracture directions. Drilling data derived from drilling could also be used in bit selection for drilling a horizontal lateral. The well 4170 could also be used as the origination point for future drilling of the lateral, but plugging back, cutting a window, or using conventional bent sub drilling techniques to begin the lateral.

FIG. 32C illustrates an embodiment where a horizontal lateral 4185 has been drilled from the vertical well 4170 in geothermal reservoir 4175 and encountered natural fractures 4190*a*, 4190*b*, and 4190*c*.

FIGS. 32D and 32E are a side view and top view of a well 4195 that has vertical section 4170 and a horizontal section 4200 drilled in geothermal reservoir 4175 and not encountered any natural fractures. It would therefore be desirable to install conduits between wells to allow circulation and the harvesting of geothermal heat. Therefore, it would be beneficial to know the direction induced tensile stressed conduits would propagate in geothermal reservoir 4175. To aid in this determination, a vertical well 4205 had induced a tensile stressed conduit 4210, which has propagated and intersected horizontal section 4200. The point of this intersection will determine the direction of tensile stressed conduits in the reservoir 4175. With this knowledge, it would then be possible to lay out horizontal well paths which would intersect the conduits.

FIG. 32F illustrates vertical well 4170 that has horizontal section 4200 in geothermal reservoir 4175 which has intersected natural fractures 4190*a*, 4190*b*, and 4190*c* near the toe of the well 4170. However, there is a large section which did not intersect any natural fractures. This area of the well 4170 could be used to generate induced tensile stressed conduits to either intersect additional horizontal laterals or potentially intersect additional natural fractures.

FIGS. 33A-D illustrate EGS completion methods FEN and DCM coupled with reservoirs containing natural fractures intersecting a portion of the well.

Figure 33A:
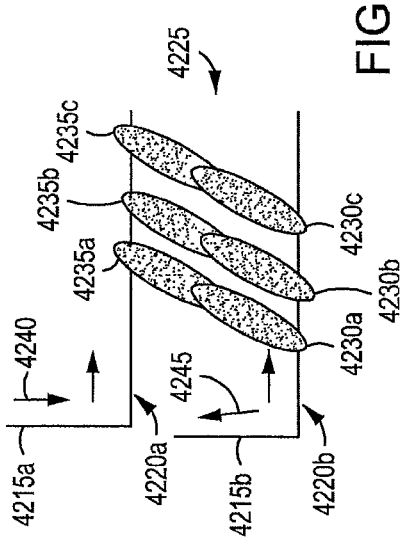
FIG. 33A illustrates an embodiment of a frac exchange network (FEN).

FIG. 33A illustrates an exemplary example of an EGS FEN method where vertical wells 4215*a* and 4215*b*, containing horizontal laterals 4220*a* and 4220*b*, respectively, have been drilled in a geothermal heat reservoir 4225. Induced tensile stressed conduits 4230*a*, 4230*b*, and 4230*c* have been created from lateral 4220*b*, and tensile stressed conduits 4235*a*, 4235*b*, and 4235*c* have been created from lateral 4220*a*. The conduits 4230*a* and 4235*a*, 4230*b* and 4235*b*, and 4230*c* and 4235*c* have come in contact within reservoir 4225 and are exchanging fluid in the direction of the arrows 4240 and 4245.

Figure 33B:
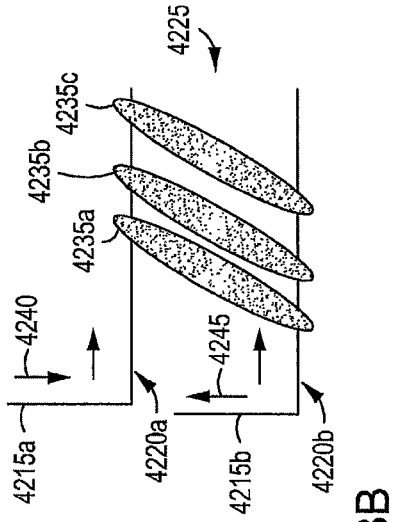
FIG. 33B illustrates an embodiment of a direct contact method (DCM).
Figure 33C:
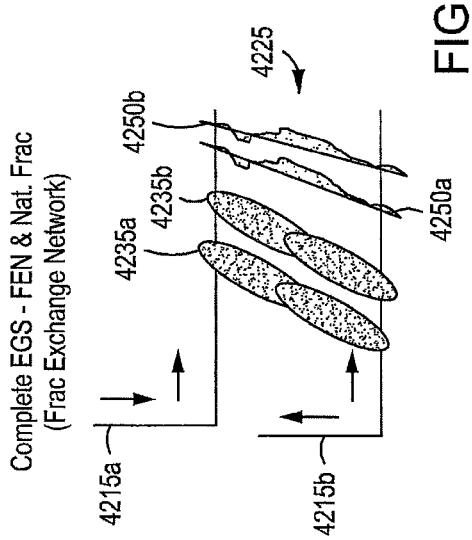
FIG. 33C illustrates an embodiment of a frac exchange network (FEN) and natural fractures.

FIG. 33C illustrates a combination EGS FEN and natural fracture completion method where induced tensile stressed conduits 4235*a* and 4235*b* and natural fractures 4250*a* and 4250*b* are both used the transfer fluids between wells 4215*a* and 4215*b*.

FIG. 33B illustrates an exemplary example of an EGS DCM method where vertical wells 4215*a* and 4215*b* containing horizontal laterals 4220*a* and 4220*b*, respectively, have been drilled in geothermal heat reservoir 4225. Induced tensile stressed conduits 4235*a*, 4235*b*, and 4235*c* have been created from lateral 4220*a* and intersect lateral 4220*b*. The conduits 4235*a*, 4235*b*, and 4235*c* have come in contact within reservoir 4225 and are exchanging fluid in the direction of the arrows 4240 and 4245.

Figure 33D:
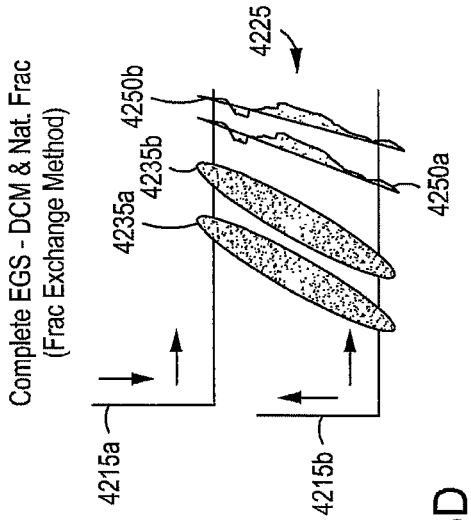
FIG. 33D illustrates an embodiment of a direct contact method (DCM) and natural fractures.

FIG. 33D illustrates a combination EGS DCM and natural fracture completion method where induced tensile stressed conduits 4235*a* and 4235*b* and natural fractures 4250*a* and 4250*b* are both used to transfer fluids between wells 4215*a* and 4215*b*.

Previously, the disclosure regarding FIGS. 16A, 16B, and 16C discussed the direct contact method ("DCM") and mechanically cracking rock. Generally, DCM employs an open hole methodology to enhance the odds of intersecting a conduit deployed from a parallel horizontal well. However, there may be circumstances where the geothermal reservoir comprises a hot, dry rock wherein the rock has minimal to no pore pressure. An example of this hot, dry rock is granite. In most instances, a pressured reservoir may require a small increase over the frac gradient to initiate a tensile stress conduit. For example, the pressured reservoir may comprise an existing rock pore pressure of 0.433 psi/ft (1.0 gm/cm$^3$) or higher. Such a pressured reservoir may require an increased pressure of 0.7 psi/ft (1.6 gm/cm$^3$) to initiate the tensile split conduit. However, geothermal reservoirs that do not have permeable rock may require the addition of the pressure normally associated with the pore pressure to the frac gradient to cause the initial split in the rock. For example, if the pore pressure was equal to 0.433 psi/ft (1.0 gm/cm$^3$), which is the normal gradient for fresh water, the geothermal reservoir without permeable rock may require a pressure greater than the frac gradient (0.7 psi/ft) plus the pore pressure (0.433 psi/ft) to initiate a tensile stress conduit. This means the pressure required to form the tensile stress conduit would be 1.133 psi/ft (2.61 gm/cm$^3$), which is the sum of the frac gradient (0.7 psi/ft) and the pore pressure (0.433 psi/ft).

The surface pressures required to initiate the tensile split in very deep reservoirs may be much higher than most commonly available equipment may be capable of providing. For example, in a reservoir with a depth of 18,000 ft (5,486 m), surface pressures of more than 20,000 psi (1,378.9 Bar) may be required to initiate the tensile split. Most commonly available equipment for performing these services is rated to provide working pressures of 10,000 psi (689.5 Bar) or 15,000 psi (1,034 Bar) to initiate the tensile split. Equipment for 20,000 psi (1,378.9 Bar) is not readily available and may be very expensive. Therefore, there is a need for a method and/or equipment to reduce the tensile split conduit initiation pressure to below the 15,000 psi (1,034 Bar) threshold of commonly available equipment. Although the equipment depicted in FIGS. 16A, 16B, and 16C may be appropriate for use in open hole wellbores that do not comprise casing, such equipment is not designed for use after casing has been installed and cemented into place.

In certain embodiments, heavier fluids may be substituted for fresh water to reduce the initial breakdown pressure. For example, clear brines are used extensively in oil and gas completions as non-formation damaging well control operations. In embodiments, if the wellbore is filled with a fluid, such as a heavy clear brine weighing approximately 16 pounds per gallon (ppg) (1.92 gm/cc), approximately twice the hydrostatic pressure of fresh water would be exerted given that the fresh water weighs 8.33 ppg (1 gm/cc). Therefore, at a given depth, the heavy clear brine would exert 0.83 psi/ft (18.8 kpa/m). For example, at a depth of 18,000 feet (5,486 m), a 16-ppg (1.92 gm/cc) heavy brine would exert a bottom hole pressure of 14,940 psi (1,030 Bar). This fluid change may reduce the surface-required breakdown pressure from approximately 20,000 psi to 15,000 psi, enabling standard completion equipment to be utilized.

Another advantage of employing heavier breakdown fluids is that the heavier breakdown fluids may cause induced tensile stressed conduits to grow deeper and come into contact with formations with higher temperatures.

Sleeves for stimulation and flow control in vertical and horizontal applications have been used in the relevant industry previously. One example of such sleeves may be found in U.S. Pat. No. 4,991,654, which discloses one or more embodiments of such sleeves intended for use in creating tensile split conduits.

Figure 34A:
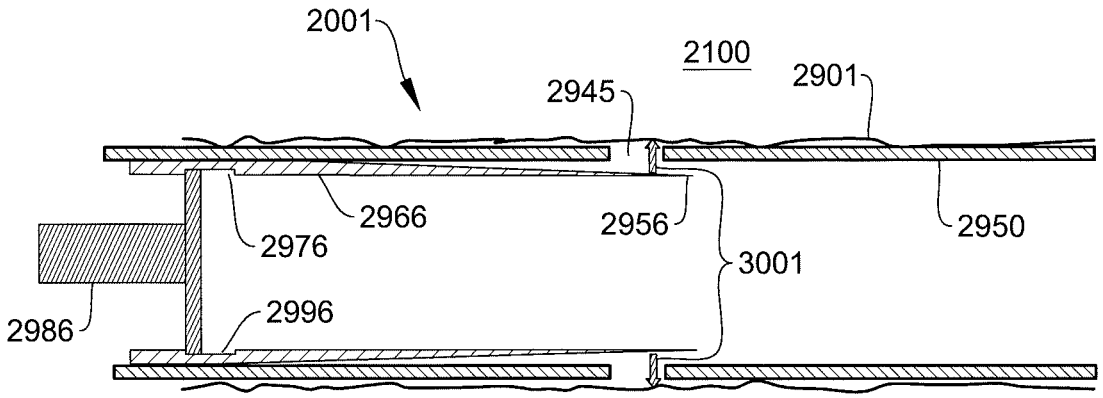
FIG. 34A illustrates an embodiment of a mechanical wedge tool before actuation.

FIG. 34A discloses an embodiment of a mechanical wedge tool 2001 before actuation. In embodiments, wedge tool 2001 may comprise a housing 2950, a chisel 3001, a sleeve 2966, a port structure 2945, and a shifting tool 2986. Further, wedge tool 2001 may comprise a recess 2996. Sleeve 2966 may comprise a first end 2956 and a second end 2976. In embodiments, sleeve 2966 may be machined so that the first end 2956 is tapered such that the first end 2956 is narrower than the second end 2976. Further, chisel 3001 may reside within the port structure 2945. Additionally, shifting tool 2986 may be attached to sleeve 2966 at recess 2996, wherein a portion of the shifting tool 2986 resides within recess 2996.

Figure 34B:
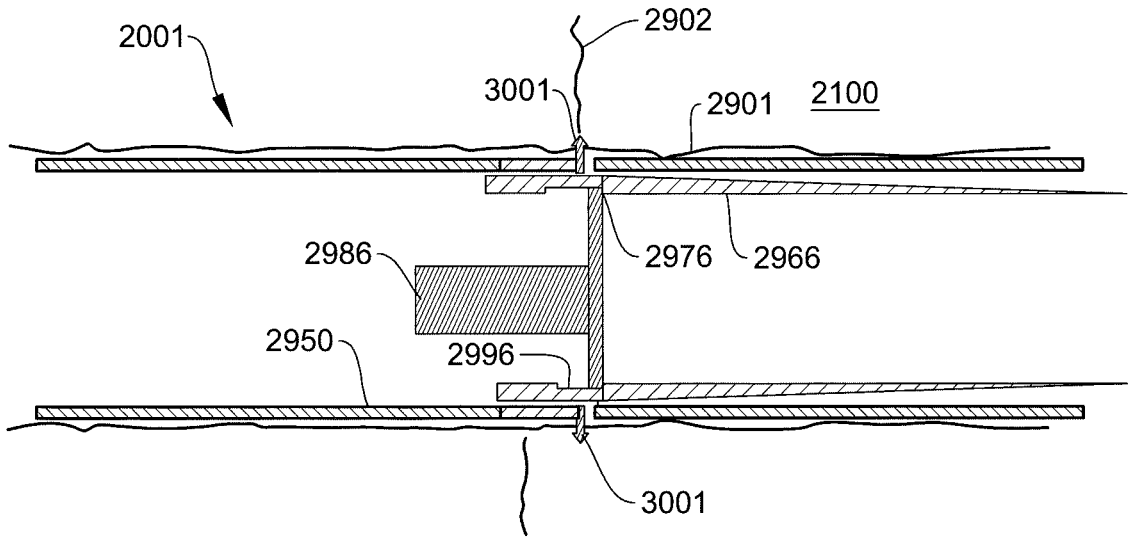
FIG. 34B illustrates an embodiment of a mechanical wedge tool after actuation.

FIG. 34B discloses an embodiment of wedge tool 2001 after actuation. In embodiments, wedge tool 2001 may be placed within a borehole wall 2901. Upon actuation, shifting tool 2986 may proceed downhole (to the right in FIG. 34B), wherein the portion of the shifting tool 2986 within the recess 2996 contacts the side of the recess 2996 closest to the second end 2976 of sleeve 2966, resulting in the movement of sleeve 2966 downhole. Given that sleeve 2966 is tapered in embodiments, as sleeve 2966 moves downhole, thicker portions of sleeve 2966 contact chisel 3001 causing chisel 3001 to extrude out and contact borehole wall 2901. As sleeve 2966 continues to move downhole, the movement of chisel 3001 may impart stress on the borehole wall 2901 and associated rock 2100 and cause the rock 2100 to fail, creating a fissure 2902.

In embodiments, the section of sleeve 2966 contacting chisel 3001 may be made significantly thicker than conventional sleeves to provide more movement of chisel 3001. For example, conventional sleeves are constructed such that the internal diameter of the conventional sleeve is the same as the casing the conventional sleeve is run on. For example, a casing with a 7-inch (17.8 cm) outer diameter, 35 ppf (52.1 kg/m), would have an internal diameter of 6.004 inches (15.24 cm), and therefore, a sleeve designed for such a 7-inch casing would have a similar internal diameter to reduce friction and provide the ability to run full-size tools in the wellbore. In embodiments where a 5.5-inch (14 cm) casing, 14 ppf (20.8 kg/m), comprises a 4.95-inch (12.6 cm) inner diameter when employing sleeve 2966 comprising a 7-inch (17.8 cm) outer diameter, such a configuration would allow approximately 0.5 inches (1.27 cm) of additional travel available for the chisel 3001. In such embodiments, given that the restriction would be on the order of less than 6 ft (1.8 m) over 5,000 ft (1,524 m) or 10,000 ft (3,048 m) of wellbore, the additional friction would be minimal. Even considering a 5,000 ft (1,524 m) lateral with 80 sleeves 2966 would add minimal additional pump friction at single cluster pump rates. In embodiments, using a smaller diameter sleeve 2966 may also allow shifting tool 2986 for 5.5-inch casing to be employed in sleeve 2966 with a 7-inch outer diameter.

Additionally, in embodiments of the wedge tool 2001, there may be one chisel 3001, and there may be a plurality of chisels 3001. For example, in one embodiment, wedge tool 2001 may comprise four chisels 3001, which may be arranged in a circular pattern around sleeve 2966, wherein each chisel 3001 is equidistant from its neighboring chisels 3001. Further, the plurality of chisels 3001 may be arranged at the same location as adjoining ports 2945 so that once the fissure 2902 was created, tensile-splitting hydraulic stimulation may proceed without any unnecessary friction or tortuosity that may be created if the ports 2945 and chisels 3001 are not aligned. This alignment may be especially important in embodiments where the borehole wall 2901 has been drilled such that the initiated fissure 2902 is perpendicular to the shifting tool 2986. In such embodiments, four chisels 3001 may act in the same stress direction to create one single fissure 2902.

Figure 35A:
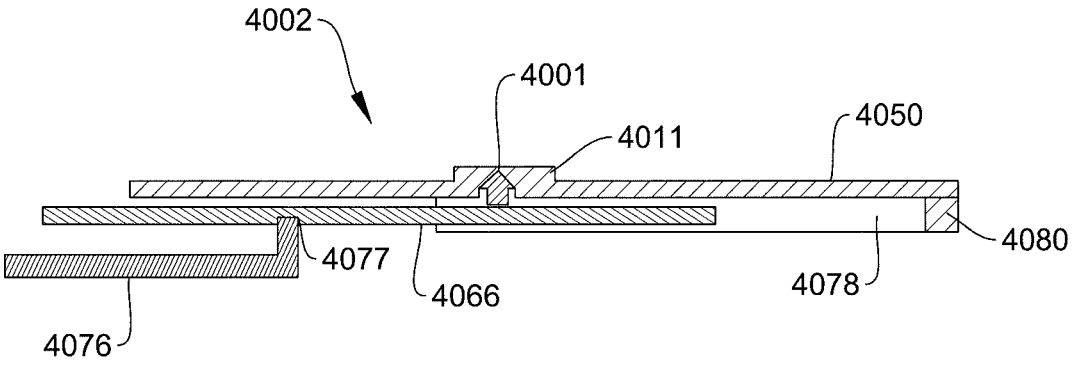
FIG. 35A illustrates an embodiment of a hydraulic wedge tool before actuation.
Figure 35B:
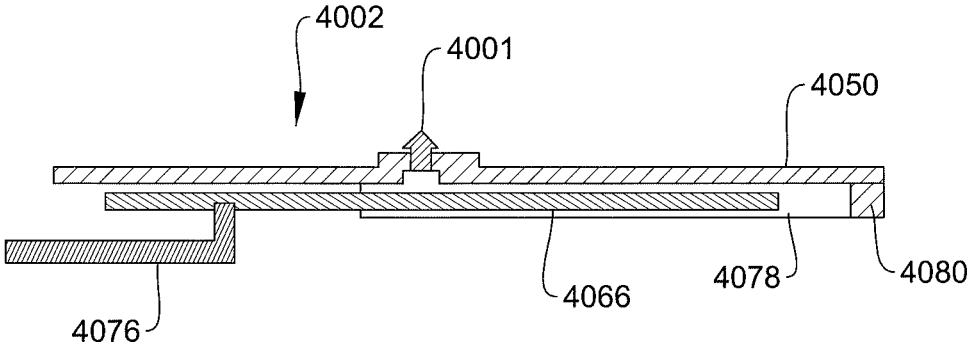
FIG. 35B illustrates an embodiment of a hydraulic wedge tool after actuation.
Figure 35C:
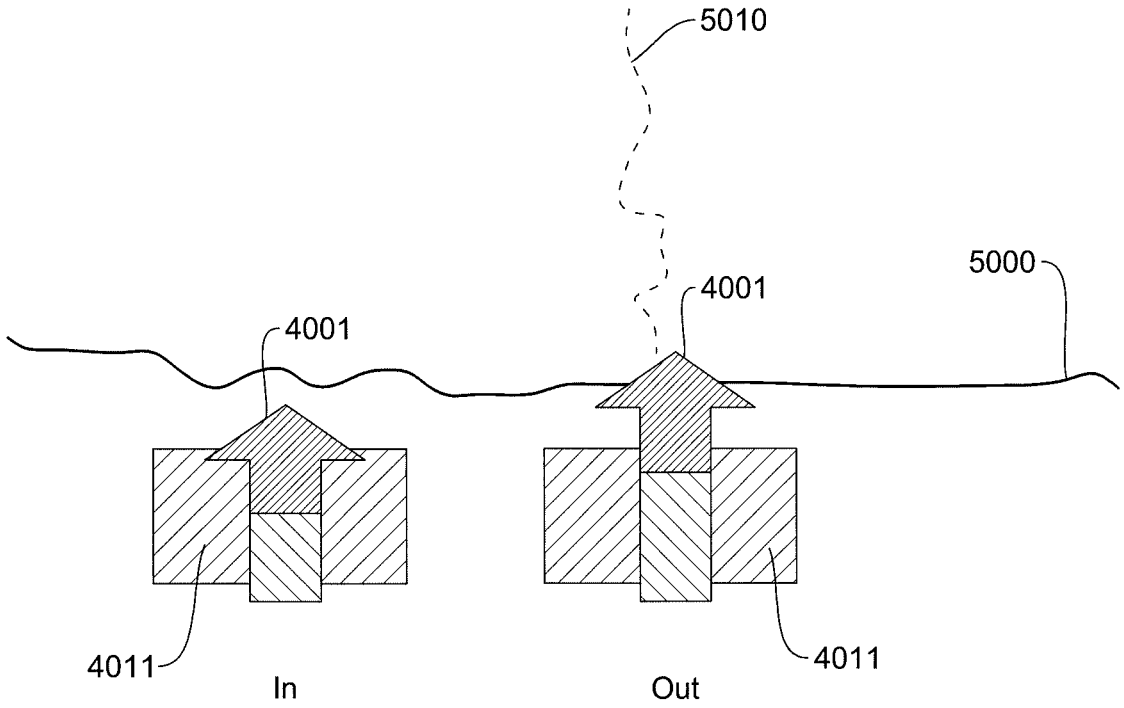
FIG. 35C illustrates an embodiment of a chisel and chisel housing.
Figure 35D:
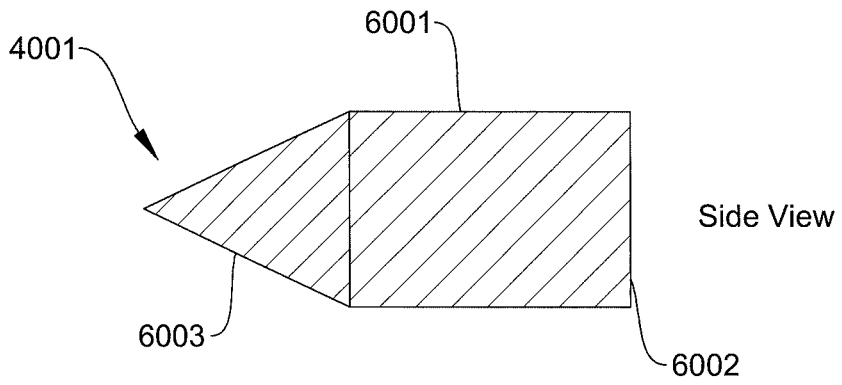
FIG. 35D illustrates a side view of an embodiment of a chisel.
Figure 35E:
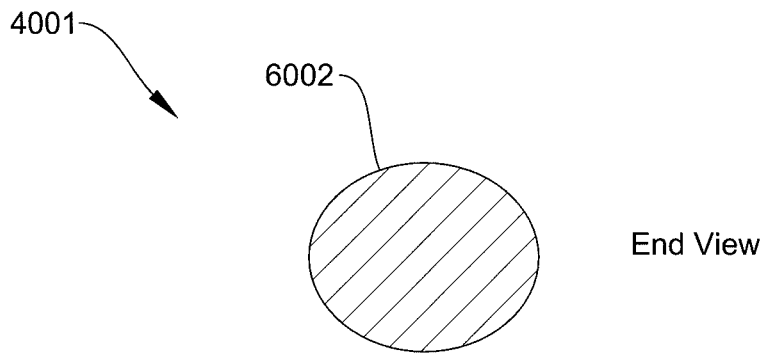
FIG. 35E illustrates an end view of a chisel.
Figure 35F:
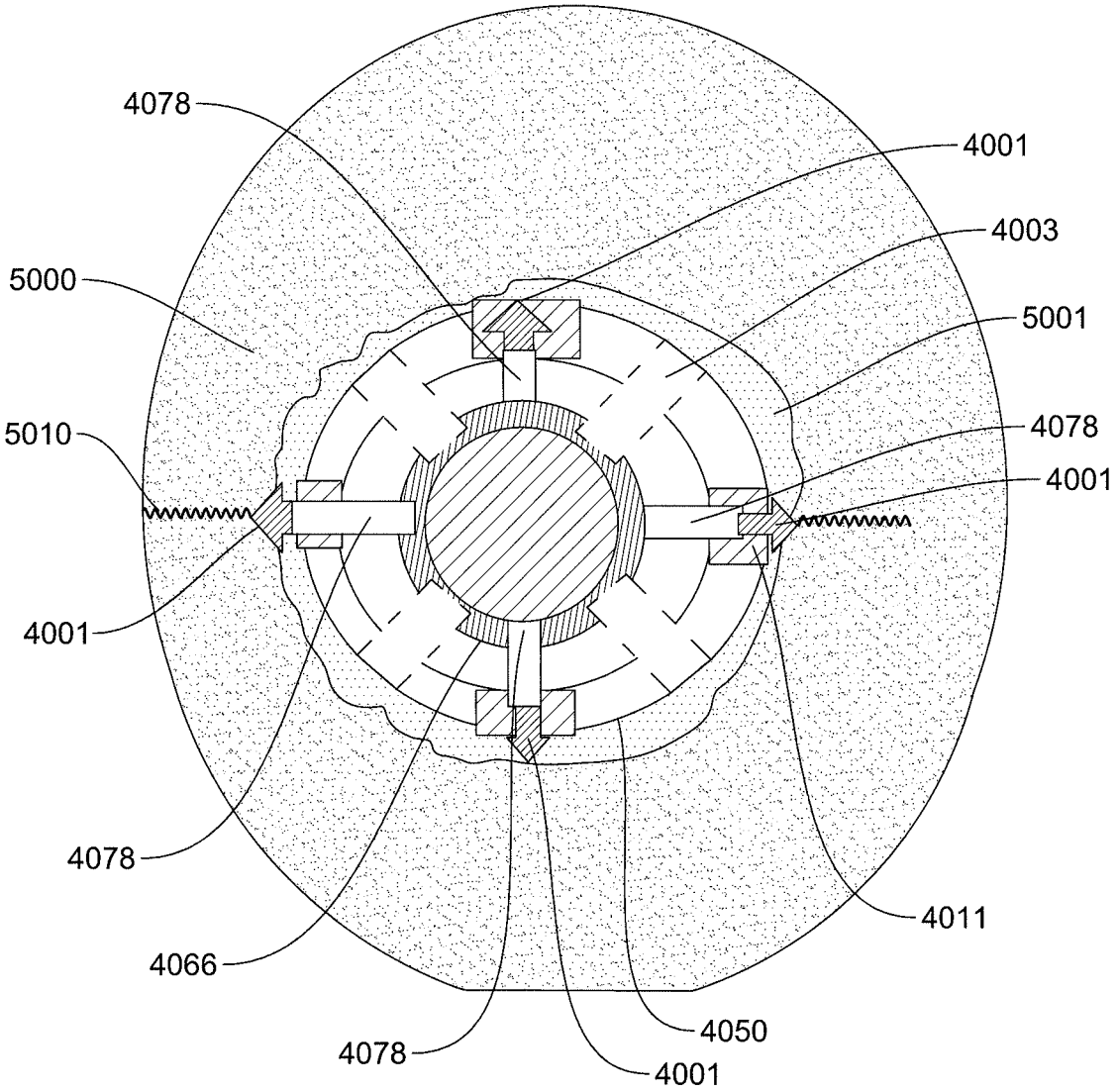
FIG. 35F illustrates an embodiment of a wedge tool downhole.

FIG. 35A illustrates a section embodiment of a hydraulic wedge tool 4002 before actuation. In embodiments, hydraulic wedge tool 4002 may comprise a housing 4050, a sleeve 4066, a chisel housing 4011, a chisel 4001, a plurality of ports 4003 (see FIG. 35F), a recess 4077, a pressure chamber 4078, and a burst disc 4080. Further, hydraulic wedge tool 4002 may be employed in conjunction with a shifting tool 4076. FIG. 35B illustrates an embodiment of wedge tool 4002 after actuation. FIG. 35C illustrates in more detail embodiments of chisel 4001 and chisel housing 4011. FIG. 35D illustrates a side view of an embodiment of chisel 4001, wherein chisel 4001 is shown to comprise a circular end 6002, a columnar shaft 6001, and a conical end 6003. FIG. 35E illustrates an end view of chisel 4001 showing circular end 6002. FIG. 35F illustrates an embodiment of wedge tool 4002 downhole, wherein wedge tool 4002 is positioned within cement 5001 and rock 5000.

In embodiments, hydraulic pressure may be employed with hydraulic wedge tool 4002 instead of mechanical force to push chisel 4001 into rock 5000 to initiate fissures 5010. As shown in FIG. 35A, initially, multiple chisels 4001 may be in a retracted position, wherein the multiple chisels 4001 may be adjoined to pressure chamber 4078. Shifting tool 4076 may latch into recess 4077. As hydraulic wedge tool 4002 is actuated, shifting tool 4076 may move downhole (to the right in FIG. 35A), wherein pressure in pressure chamber 4078 will increase, resulting in a reduction in size of pressure chamber 4078. As a result, hydraulic pressure acting on the end 6002 and shaft 6001 of chisel 4001 causes chisel 4001 to extend from housing 4050 and contact rock 5000. Increasing pressure in pressure chamber 4078 exerts more pressure on chisel 4001, eventually resulting in failure of rock 5000 and the creation of fissures 5010 in rock 5000. Tensile splitting conduit creation operations may then commence through ports 4003, which may be aligned with chisels 4001.

In embodiments, chisels 4001 may have alternative shapes to the shape shown in FIGS. 35D and 35E. Further, as shown in the embodiment of FIG. 35F, four chisels 4001 and four ports 4003 may be aligned such that when fissure 5010 has been created, wherein fissures 5010 are perpendicular to surrounding housing 4050, such that ports 4003 may be in the same conduit. Additionally, in embodiments, to ensure there is enough travel for sleeve 4066 to expose ports 4003 to allow for the pumping of stimulation fluids through sleeve 4066, burst disc 4080 or alternative devices may be employed. Thus, to aid in formation breakdown, the positioning and design of ports 4003 may provide for communication between the wellbore pressure inside sleeve 4066, the pressure of the formation or rock 5000 during movement of sleeve 4066, and the hydraulic pressure acting on chisels 4001. This interaction of pressures may allow a reduced pressure requirement on the chisels 4001 and may provide a pressure response when rock 5000 has failed and fissure 5010 has been created.

The following is an equation that may be employed to calculate how much hydraulic force would be required to initiate a tensile split conduit in a non-porous granite-type rock using the methods disclosed herein.

$$P = 0.5\pi(Sh\min + S_t)/(\sin(2\alpha) - \alpha)$$

wherein

P=load required on button base to crack the wellbore

Shmin=minimum horizontal stress (well drilled into Shmin direction)

Figure 36A:
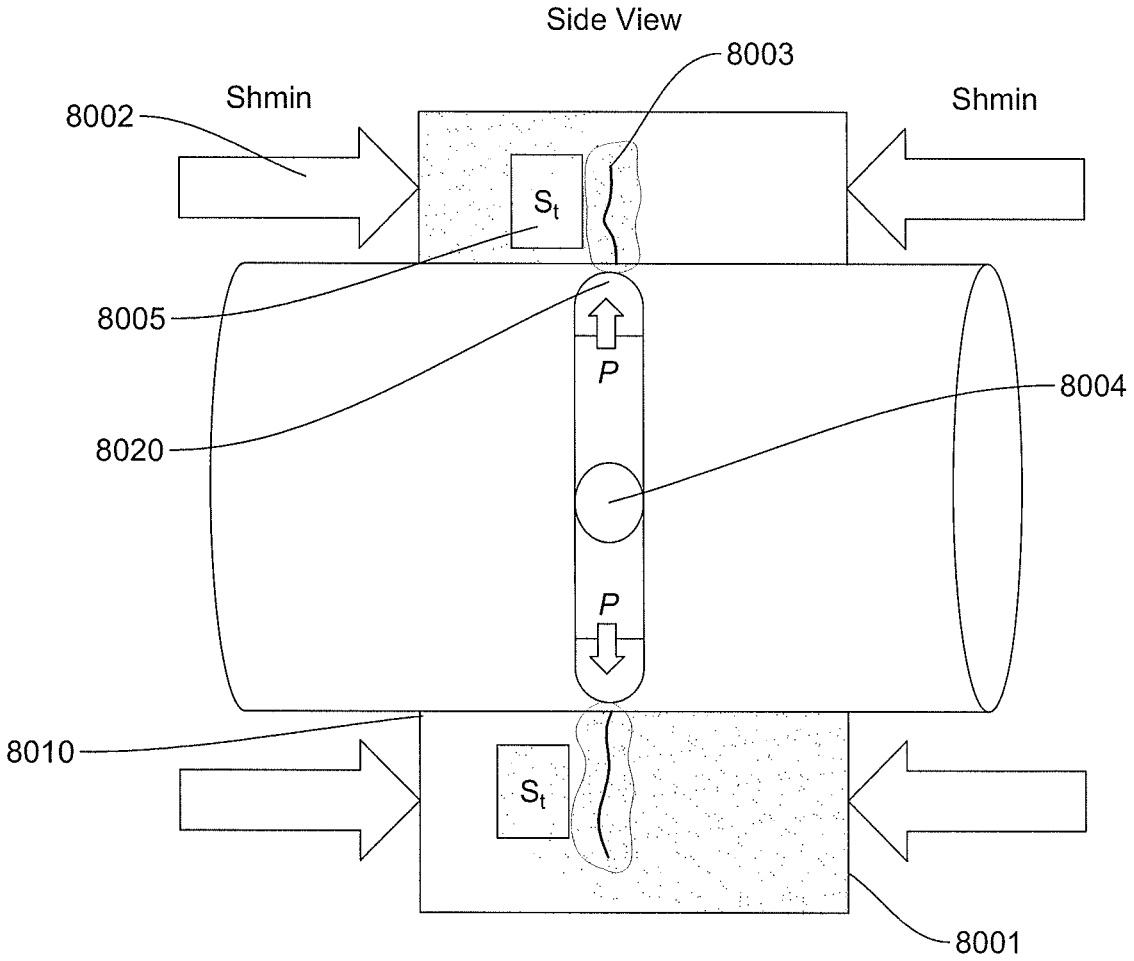
FIG. 36A illustrates a side view of an embodiment wherein a formation comprises granite.
Figure 36B:
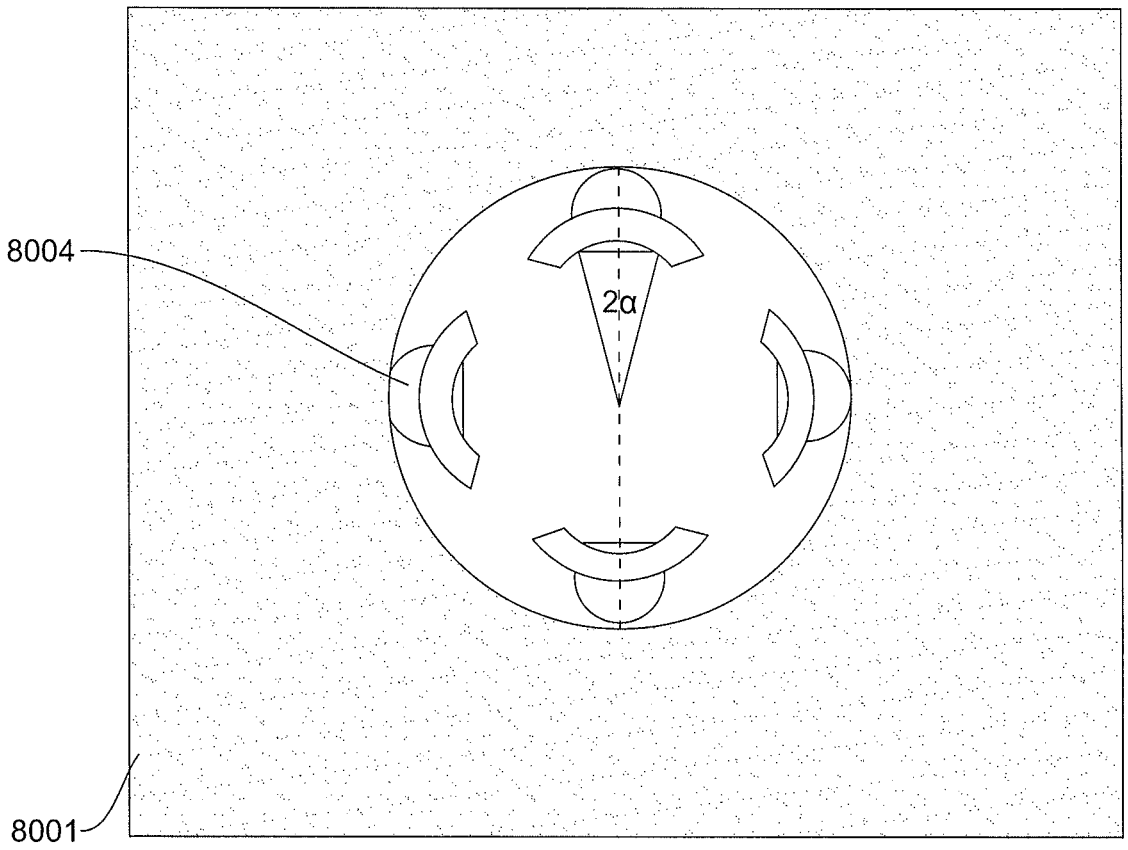
FIG. 36B illustrates a downhole view of an embodiment of a formation comprising granite.

$S_t$=the tensile strength of the rock $\alpha$ = angle encompassed between button base and well bore center~$\tan^{-1}(B/R - B) \times 2$ R=wellbore radius B=button base (chisel) radius FIG. 36A illustrates a side view of an embodiment wherein a formation comprises granite 8001, such as a Westerly Granite. FIG. 36B illustrates a downhole view of an embodiment of the formation comprising granite 8001. In embodiments, the granite 8001 may comprise a shear stress of 3,100 psi (213.7 Bar), which would be the same as the tensile strength ($S_t$) of the rock as shown in FIG. 36A. In embodiments, the granite 8001 may be buried in the earth with a minimum confining stress of about 17,900 psi (1,234 Bar) (17,900=21,300 feet×0.84 psi/ft frac gradient) (1,234 Bar=6,492 m×0.19 Bar/m). In embodiments, an 8.5-inch (21.6 cm) hole 8010 may be drilled through the granite 8001, and a frac sleeve 4066 (not shown) containing four buttons 8004 (or chisels) with a 1-inch diameter base end 6002 may be cemented into the hole 8010 with the buttons 8004 touching the granite 8001. Employing the equation in the previous paragraph, the hydraulic pressure required to be generated by the piston area 8020 in the frac sleeve 4066 (not shown) to act on the 1-inch base end 6002 to crack the granite 8001 may be created, wherein:

$S_t$=tensile stress 8005 required to create a traverse fracture 8003 perpendicular to the wellbore 8010 (psi)

P=pressure applied on the base end 6002 of the buttons 8004 exerting force on the internal wall of the wellbore 8010 (psi)

$$\alpha = \text{angle} - 15.5 \text{ degrees } (\text{base end } 6002 \text{ diameter of } 1 \text{ inch} = \alpha\tan(4.25/(4.25-0.5))\times 2 = 0.26 \text{ rad}$$

$$pi = 3.214 \text{ inches} = 0.5\times 3.124\times 21{,}000/(\sin((2\times 0.26)-0.26)) = 137{,}000 \text{ psi}$$

For four buttons 8004 with a 1-inch (2.54 cm) round cross-section, in embodiments 137,000 may be divided by 4 to yield 34,000 psi (2,344 Bar). For six buttons 8004, a more manageable 22,833 psi (1,574 Bar) would be required. In embodiments where four 1.5-inch button base ends 6002 were employed, the resulting force required to initiate the crack would be reduced to 25,000 psi (1,724 Bar). In embodiments where six 1.5-inch button base ends 6002 were employed, the resulting force required to initiate the crack would be further reduced to 16,666 psi (1,150 Bar). The above example and analysis are based on an embodiment wherein there is an 8.5-inch (21.6 cm) diameter of the wellbore 8010, a tensile strength of the granite 8001, such as Westerly Granite), of 3,100 psi (213.7 Bar), rock modulus 6E6 psi, Poisson's Ratio 0.25, and frac gradient of 0.84 psi/ft (1.94 gm/cc). This analysis illustrates that to overcome the tensile strength of the granite 8001 and the Shmin 8002, the buttons 8004 must move in all directions outwards of a minimum distance of 1/16 of an inch.

It is important to note that even though the embodiments described above employed to create fissures or cracks have been shown independently, it is envisioned that numerous sleeves may be run in a horizontal wellbore, enabling the creation of a conduit at each sleeve location.

It should also be noted that, although these methods just described are described as being employed in non-porous rock, such as granite, these methods will also work in porous rock to reduce the initial tensile stress conduit initiation pressure. Further, even in embodiments where the chisel 4001 does not initiate the fracture, the chisel 4001 will provide additional stress on the rock 5010 to reduce the amount of hydraulic pressure needed to initiate the fracture.

In other embodiments, hydraulic pressure alone, which may be generated by the movement of the sleeve piston 8020 channeled into the formation rock face 8001, may be sufficient to initiate the tensile split conduit.

Additionally, explosives have been used in the past to assist in the initial conduit initiation breakdown pressure, and explosives may be used in conjunction with the chisel methods described above. Further, low-compressible liquids and gases, such as nitrogen and carbon dioxide compressed at extremely high pressures, may also be used with the methods described herein and should be discharged at a location near perforations or holes in sleeves as well.

Figure 37:
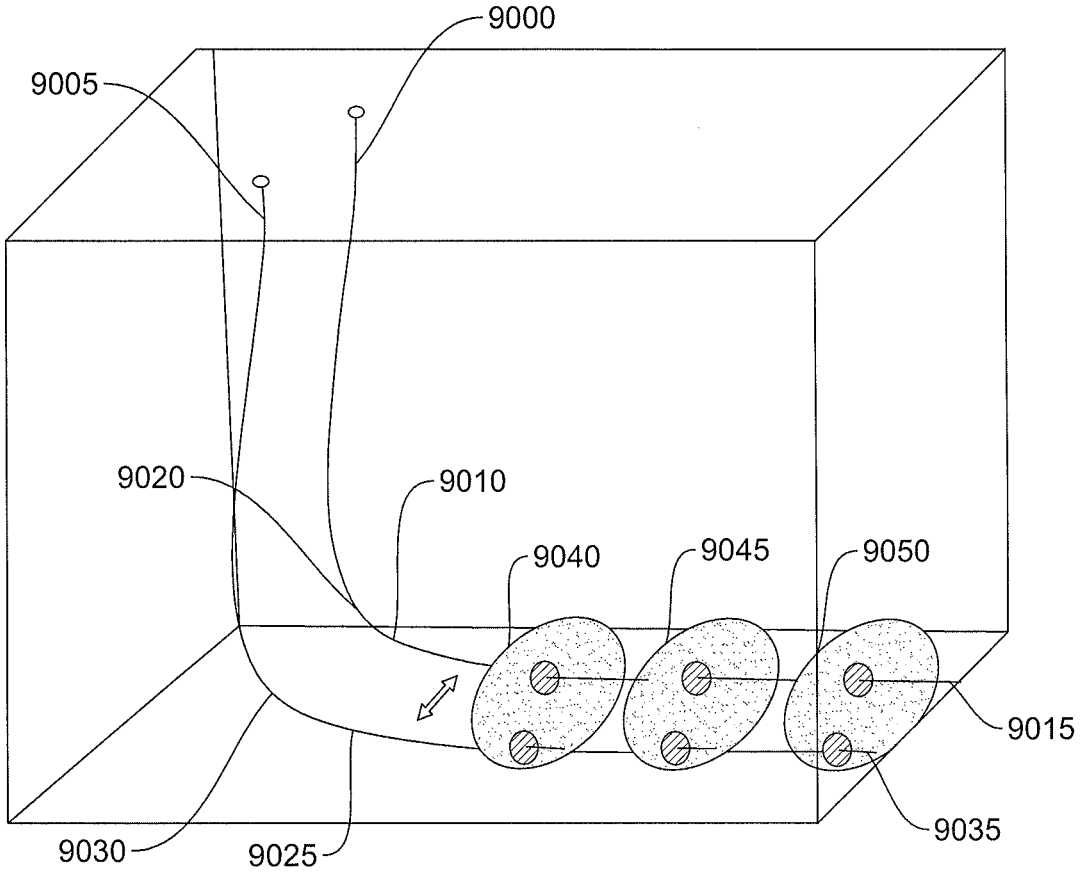
FIG. 37 illustrates an injection well and a production well.

FIG. 37 illustrates an injection well 9000 and a production well 9005. In embodiments, injection well 9000 may comprise a lateral 9010, a heel 9020, and a toe 9015. Further, production well 9005 may comprise a lateral 9025, a heel 9030, and a toe 9035. Additionally, conduits 9040, 9045, and 9050 may allow for communication between lateral 9010 and lateral 9025. Optimizing equal injection rates in the lateral 9010 may be performed by controlling the friction pressure in the conduits 9040, 9045, and 9050 through the placement of proppant. For example, to reduce the friction pressure losses in the conduits 9040, 9045, and 9050, a higher amount of proppant may be used. More specifically, conduits 9040, 9045, and 9050 may have more proppant placed in the conduits nearer the toe 9015 than at the heel 9020, such that conduit 9050 would have the most proppant and conduit 9040 would have the least amount of proppant.

In addition to the quantity of proppant, the size of the proppant may also vary by placing larger size proppant in the conduit near the toe 9015, conduit 9050, in comparison to the size of the proppant in the conduit closer to the heel 9020, conduit 9040. Proppant strength may also be varied by placing higher strength proppants in the conduits near the toe 9015, conduit 9050, in comparison to the strength of the conduit closer to the heel 9020, conduit 9040. Further, only placing proppant near the wellbore face of the injection well 9000 may be desirable to ensure that the conduits 9040, 9045, and 9050 are taking fluid and to reduce the tortuosity of nearby wellbores.

In certain embodiments, heavier fluids may be substituted for fresh water to reduce the initial breakdown pressure.

What is claimed is:

1. A method of mechanically cracking rock, comprising:

providing a mechanical wedge tool comprising:

a housing, a chisel, a sleeve, wherein the sleeve comprises a first sleeve end and a second sleeve end, and further wherein the sleeve is tapered such that the first sleeve end is narrower than the second sleeve end, and further wherein the first sleeve end is farther downhole than the second sleeve end, a port structure, wherein the chisel resides in the port structure prior to actuation, a recess, and a shifting tool, wherein the shifting tool is attached to the sleeve at the recess, and further wherein the shifting tool is positioned on the surface end of the mechanical wedge tool;

placing the mechanical wedge tool within a borehole, wherein the sleeve of the mechanical wedge tool is cemented in the borehole; and actuating the mechanical wedge tool, wherein the shifting tool is forced downhole and farther inside the housing until the shifting tool contacts the second sleeve end, wherein the continued movement of the shifting tool downhole pushes the sleeve downhole inside the housing, and further wherein the downhole movement of the sleeve causes the chisel to extrude from the port structure, wherein the chisel is forced into contact with the wall of the borehole until the chisel creates a fissure in the wall of the borehole.

2. The method of claim 1, wherein the mechanical wedge tool is attached to a casing, wherein the sleeve comprises a greater thickness than the casing.

3. The method of claim 1, wherein the mechanical wedge tool comprises a plurality of chisels.

4. The method of claim 3, wherein the plurality of chisels is arranged in a circular pattern around the sleeve, wherein each of the plurality of chisels is equidistant from each neighboring chisel.

5. The method of claim 4, wherein the mechanical wedge tool comprises a plurality of port structures.

6. The method of claim 5, wherein each of the plurality of chisels is positioned in one of the port structures, wherein tensile-splitting hydraulic stimulation may proceeds once the fissure is created.

7. The method of claim 1, wherein the sleeve is oriented in a horizontal borehole, wherein a single fissure is created perpendicular to the sleeve.

8. A method of hydraulically cracking rock, comprising:
providing a hydraulic wedge tool, comprising:
a housing,
a chisel, wherein the chisel is initially in a retracted position,
a chisel housing,
a sleeve, wherein the sleeve comprises a first sleeve end and a second sleeve end, and further wherein the sleeve is tapered such that the first sleeve end is narrower than the second sleeve end, and further wherein the first sleeve end is farther downhole than the second sleeve end,
a plurality of ports,
a recess,
a pressure chamber, wherein the pressure chamber is adjoined to the chisel,
a burst disc, and
a shifting tool, wherein the shifting tool is latched into the recess;
placing the hydraulic wedge tool within a borehole; and
actuating the hydraulic wedge tool, wherein the shifting tool is forced downhole and farther inside the housing, and further wherein the hydraulic pressure in the pressure chamber increases, wherein the size of the pressure chamber is reduced, and further wherein the hydraulic pressure in the pressure chamber acts on the chisel, wherein the chisel extends from the housing and contacts the wall of the borehole until the chisel creates a fissure in the wall of the borehole.

9. The method of claim 8, wherein the hydraulic wedge tool comprises a plurality of chisels.

10. The method of claim 9, wherein each of the plurality of chisels is aligned with one of the plurality of ports.

11. The method of claim 10, wherein each fissure created by the plurality of chisels is perpendicular to the housing.

12. The method of claim 8, wherein the borehole is in a granite formation.

13. The method of claim 8, wherein the sleeve is cemented in the borehole.

14. The method of claim 8, wherein the borehole is filled with fluids heavier than fresh water.

15. The method of claim 8, wherein the borehole is partially filled with fluids heavier than fresh water.

* * * * *